US012529196B2

(12) United States Patent
Niemela et al.

(10) Patent No.: US 12,529,196 B2
(45) Date of Patent: Jan. 20, 2026

(54) ARTICULATING VEHICLE SNOW PLOW

(71) Applicants: Cal G. Niemela, Chassell, MI (US); Philip J. Quenzi, Atlantic Mine, MI (US)

(72) Inventors: Cal G. Niemela, Chassell, MI (US); Philip J. Quenzi, Atlantic Mine, MI (US)

(73) Assignee: Cal G. Niemela, Chassell, MI (US)

( * ) Notice: Subject to any disclaimer, the term of this patent is extended or adjusted under 35 U.S.C. 154(b) by 965 days.

(21) Appl. No.: 17/463,837

(22) Filed: Sep. 1, 2021

(65) Prior Publication Data

US 2022/0064885 A1 Mar. 3, 2022

Related U.S. Application Data

(60) Provisional application No. 63/155,591, filed on Mar. 2, 2021, provisional application No. 63/073,704, filed on Sep. 2, 2020.

(51) Int. Cl.
*E01H 5/06* (2006.01)

(52) U.S. Cl.
CPC ..... *E01H 5/062* (2013.01); *E01H 5/065* (2013.01); *E01H 5/066* (2013.01)

(58) Field of Classification Search
CPC ..... E01H 5/06; E01H 5/062; E01H 5/065; E01H 5/066; E01H 5/067
See application file for complete search history.

(56) References Cited

U.S. PATENT DOCUMENTS 1,552,714 A 9/1925 Linzy
1,594,095 A 7/1926 Fey et al.
(Continued)

FOREIGN PATENT DOCUMENTS

CA 324061 7/1932
CA 629099 10/1961
(Continued)

OTHER PUBLICATIONS

European Search Report of corresponding Application No. 21194335.2, dated Jun. 10, 2022.
(Continued)

*Primary Examiner* — Joseph M Rocca
*Assistant Examiner* — Robert E Pezzuto
(74) *Attorney, Agent, or Firm* — Gardner, Linn, Burkhart & Ondersma LLP

(57) ABSTRACT

A vehicle mounted articulating snow plow apparatus is provided for clearing snow from roads and driveways. The snow plow includes a blade assembly having a center blade and an extendable wing blade coupled to each end of the center blade. The blade assembly can be raised and lowered relative to the vehicle and ground surface and can be rotated about a vertical axis. Each extendable blade is independently pivotable relative to the center blade through an arc of greater than one-hundred eighty degrees (180°) about a vertical axis. The blade assembly is extendable and retractable between at least a stowed configuration, wherein the extendable blades extend laterally inboard alongside the center blade, and a linearly extended configuration, wherein the extendable blades are outboard of the center blade. The blade assembly includes an actuation mechanism to pivot the extendable blade relative to the center blade.

20 Claims, 55 Drawing Sheets

(56) References Cited

U.S. PATENT DOCUMENTS

| | | | | |
|---|---|---|---|---|
| 2,218,512 | A | 10/1940 | Ball | |
| 2,281,289 | A | 4/1942 | Hewitt | |
| 2,504,774 | A | 4/1950 | Williamson | |
| 2,769,254 | A | 11/1956 | Wright | |
| 2,919,504 | A | 1/1960 | Rubin | |
| 2,991,566 | A | 7/1961 | Sumner et al. | |
| 3,061,955 | A | 11/1962 | Violette | |
| 3,231,991 | A | 2/1966 | Wandscheer et al. | |
| 3,233,687 | A | 2/1966 | Grimes | |
| 3,241,254 | A | 3/1966 | Ulrich | |
| 3,279,104 | A | 10/1966 | Wandscheer et al. | |
| 3,332,159 | A | 7/1967 | Dunn | |
| 3,429,381 | A | 2/1969 | Launder et al. | |
| 3,468,042 | A | 9/1969 | Coy | |
| 3,657,828 | A | 4/1972 | Anderson | |
| 3,800,447 | A | 4/1974 | Harvey | |
| 3,803,733 | A | 4/1974 | Ramsey | |
| 3,908,289 | A | 9/1975 | Ross | |
| 4,023,287 | A | 5/1977 | de Brito | |
| 4,073,077 | A | 2/1978 | Essel et al. | |
| 4,130,952 | A | 12/1978 | Dion | |
| 4,164,820 | A | 8/1979 | Krickovich | |
| 4,275,514 | A | 6/1981 | Maura | |
| 4,369,847 | A | 1/1983 | Mizunuma | |
| 4,403,432 | A | 9/1983 | Biance | |
| 4,498,253 | A | 2/1985 | Schmidt | |
| 4,506,465 | A | 3/1985 | Johnson | |
| 4,667,426 | A | 5/1987 | Howard et al. | |
| 4,802,293 | A | 2/1989 | Smith | |
| 4,837,951 | A | 6/1989 | Verseef | |
| 4,907,357 | A | 3/1990 | Lilienthal | |
| 5,046,271 | A | 9/1991 | Daniels | |
| 5,050,322 | A | 9/1991 | Burkhard | |
| 5,058,295 | A | 10/1991 | Holland | |
| 5,079,866 | A | 1/1992 | Farrell | |
| 5,185,946 | A | 2/1993 | Farrell | |
| 5,209,307 | A | 5/1993 | Hotte | |
| 5,228,734 | A | 7/1993 | Pollastro | |
| 5,265,355 | A | 11/1993 | Daniels | |
| 5,392,538 | A | 2/1995 | Geerligs et al. | |
| 5,410,824 | A | 5/1995 | Pedersen | |
| 5,450,910 | A | 9/1995 | Strzyzewski | |
| 5,493,797 | A | 2/1996 | Jackson | |
| 5,524,555 | A | 6/1996 | Fanuzzi | |
| 5,595,007 | A | 1/1997 | Biance | |
| 5,655,318 | A * | 8/1997 | Daniels | E01H 5/065 37/231 |
| 5,860,230 | A * | 1/1999 | Daniels | E01H 5/06 37/231 |
| 5,930,922 | A | 8/1999 | Altheide | |
| 6,151,809 | A | 11/2000 | Altheide | |
| 6,154,985 | A | 12/2000 | Champagne et al. | |
| 6,163,987 | A | 12/2000 | Schommer | |
| 6,247,254 | B1 | 6/2001 | Wessman | |
| 6,408,548 | B1 | 6/2002 | Altheide | |
| 6,453,582 | B1 | 9/2002 | Fulton, III | |
| 6,516,544 | B1 | 2/2003 | Matisz et al. | |
| 6,516,894 | B1 | 2/2003 | Newton et al. | |
| 6,877,258 | B2 | 4/2005 | Frey | |
| 7,134,227 | B2 | 11/2006 | Quenzi et al. | |
| 7,263,789 | B2 * | 9/2007 | Hollinrake | E01H 5/062 37/231 |
| 7,429,158 | B2 | 9/2008 | McFarland | |
| 7,493,710 | B2 | 2/2009 | Frey et al. | |
| 7,584,557 | B1 | 9/2009 | Nistler | |
| 7,681,337 | B2 | 3/2010 | Watson | |
| 7,686,563 | B2 | 3/2010 | Frey et al. | |
| 7,730,644 | B2 | 6/2010 | Frey et al. | |
| 7,874,571 | B2 | 1/2011 | Frey et al. | |
| 8,096,066 | B2 | 1/2012 | Gandolfi | |
| 8,528,237 | B1 | 9/2013 | Bacall | |
| 8,776,406 | B2 | 7/2014 | Stephan | |
| 8,850,724 | B2 | 10/2014 | Bloxdorf | |
| 9,555,746 | B2 | 1/2017 | Weihl | |
| 9,719,227 | B2 | 8/2017 | Martin et al. | |
| 9,957,679 | B2 | 5/2018 | Lovell et al. | |
| 10,106,950 | B2 | 10/2018 | Martin et al. | |
| 10,150,428 | B2 | 12/2018 | Weihl | |
| 10,865,534 | B2 | 12/2020 | Martin et al. | |
| 2002/0074758 | A1 | 6/2002 | Frey | |
| 2002/0095824 | A1 | 7/2002 | Johnson | |
| 2003/0226289 | A1 | 12/2003 | Geerligs | |
| 2005/0246926 | A1 * | 11/2005 | Verseef | E01H 5/066 37/281 |
| 2006/0150443 | A1 | 7/2006 | Angeletti | |
| 2009/0119954 | A1 | 5/2009 | Lemieu et al. | |
| 2009/0223091 | A1 | 9/2009 | Livingston et al. | |
| 2011/0239491 | A1 | 10/2011 | Chen | |
| 2012/0279093 | A1 | 11/2012 | Niemela et al. | |
| 2012/0311893 | A1 * | 12/2012 | Knott | E01H 5/066 172/265 |
| 2013/0160333 | A1 | 6/2013 | Becicka et al. | |
| 2013/0298429 | A1 | 11/2013 | Niemela et al. | |
| 2016/0375839 | A1 | 12/2016 | Weihl | |
| 2017/0298583 | A1 * | 10/2017 | Budrow | E01H 5/061 |
| 2019/0203436 | A1 | 7/2019 | Martin et al. | |
| 2020/0354910 | A1 | 11/2020 | Niemela et al. | |

FOREIGN PATENT DOCUMENTS

| | | |
|---|---|---|
| CA | 671590 | 10/1963 |
| CA | 1161462 | 1/1984 |
| CA | 2090992 | 5/1996 |
| CA | 2581876 | 9/2008 |
| CA | 2598782 | 9/2008 |
| CA | 2638121 | 2/2009 |
| CA | 2673840 | 2/2010 |
| CA | 2862174 | 3/2015 |
| CA | 3023386 | 5/2019 |
| CA | 3025237 | 5/2020 |
| CA | 3036882 | 9/2020 |
| CN | 109973447 | 7/2019 |
| FR | 3084682 | 2/2020 |
| KR | 101567510 | 11/2015 |
| WO | 2018/126324 | 7/2018 |

OTHER PUBLICATIONS

Boss Products, Boss Snowplow Expanding Wing Drag Pro: Rear Mounted Plow Owner's Manual, copyright 2018, 28 pages, Boss Products, Iron Mountain, Michigan.

YouTube Video, Rolling the Rollover Plow Over !: Frink plow, published Mar. 3, 2014, accessed Nov. 11, 2020, https://www.youtube.com/watch?reload-9&v=zBVSsEh1CHQ.

Horst Loader Attachments, HLA Snow: Snow Brochure, identified as printed on Jul. 2018, 36 pages, Horst Loader Attachments, Listowel, Ontario CA.

Wausau-Everest, American Sno-Plows, Reverse-A-Cast, Jul. 21, 2008, wauasau-everest.com.

* cited by examiner

ARTICULATING VEHICLE SNOW PLOW

CROSS REFERENCE TO RELATED APPLICATION

The present application is related to U.S. provisional applications Ser. No. 63/073,704, filed Sep. 2, 2020, and Ser. No. 63/155,591, filed Mar. 2, 2021, which are both hereby incorporated by reference herein in their entireties.

FIELD OF THE INVENTION

The present invention is directed to vehicle-mounted snow moving equipment, and more particularly, to an articulating extendable plow for snow removal.

BACKGROUND OF THE INVENTION

Vehicle mounted snow plowing equipment typically includes snow plows mounted to the front or rear of a vehicle, with limited vertical actuation, and configured to move snow or debris from the forward or rearward travel path of the vehicle. Other types of vehicle mounted snow plowing equipment include pivoting snow plows mounted to a vehicle and configured to move snow or debris adjacent to one side of the travel path of the vehicle. Vehicle mounted snow plowing equipment typically provides snow removal for a width of ground or surface that is substantially the width of the vehicle, or slightly wider than the width of the vehicle. Vehicle mounted snow plowing equipment typically requires an operator of the vehicle to maneuver the vehicle into an ideal position prior to removing the snow or debris from the surface.

SUMMARY OF THE INVENTION

The present invention provides a vehicle mounted articulating snow plow apparatus to clear snow and debris from surfaces that are adjacent to (in the vicinity of) a vehicle. The snow plow apparatus includes an articulating snow pushing plate or blade assembly that includes a center snow pushing plate or blade and at least one extendable snow pushing side wing, plate, or blade that is pivotably coupled to and extendable from an outboard end of the center blade. The extendable blade is pivotable through an arc of about one-hundred eighty degrees, and preferably up to about two-hundred seventy degrees, relative to the center blade. The apparatus includes a support frame for raising and lowering the blade assembly relative to the vehicle and the ground surface adjacent to the vehicle. The apparatus is configurable to clear various path widths, and may be configured to match the width of a road, driveway, or other surface. The apparatus is configurable to clear path widths having a width at least the width of the center blade up to a width that is equal to the entire width of the blade assembly when it is in a fully linearly extended position.

For purposes of this disclosure, the terms "sweep and its facsimiles refer to a pivoting or rotating movement of an element about one of its ends about a generally upright or vertical axis (e.g. a wing blade sweeping forward or rearward through a generally horizontal plane); the terms "twist" and its facsimiles refer to a pivoting or rotating movement of an element about its middle region about a generally upright or vertical axis (e.g. a blade assembly twisting clockwise through a generally horizontal plane to permit windrowing of debris/snow); the terms "tilt" and its facsimiles refer to a pivoting or rotating movement of an element about a generally horizontal axis that is perpendicular or oblique to a forward direction of travel of a vehicle (e.g. a blade assembly tilting in a generally vertical plane such that a lower edge of the blade assembly moves forward or rearward, similar to the motion of a swing on a swing set); the terms "slant" and its facsimiles refer to a change in an elements angular orientation relative to its typical lateral and horizontal orientation (e.g. a blade assembly slanting to an oblique angle relative to the horizontal plane of the vehicle to adapt to/overcome an uneven ground surface); the term "oscillate" and its facsimiles refer to an elastic, pivoting or rotating movement of an element about its middle region relative to its typical lateral orientation about a generally horizontal axis (e.g. a blade assembly oscillating about an axis that is generally parallel the vehicle's longitudinal axis to temporarily adapt to/overcome an uneven ground surface, e.g. the blade assembly may slant while it oscillates); and the term "float" and its facsimiles refer to a movement of an element to momentarily/temporarily adjust the element's position (e.g. a blade assembly floating upward relative to its typical position in order to overcome a raised shoulder on one side of the vehicle and subsequently return to its initial/typical position, e.g. the blade assembly may slant and/or oscillate in order to float over an obstacle).

According to one form of the present invention, a snow plow apparatus is provided for use with a vehicle. The snow plow apparatus includes a support frame that can be coupled to the vehicle. A portion of the support frame is selectively operable to raise and lower relative to the vehicle. The apparatus includes a snow pushing plate or blade assembly that is pivotably coupled to a rear portion of the support frame and adapted for selectively clearing snow or debris from a surface adjacent the vehicle when the support frame is in a lowered position in which the lower portion of the plate assembly is in contact with a ground surface adjacent to the vehicle. The plate assembly may be pivotable relative to the support frame about a tilt axis that is parallel to the lateral axis of the vehicle. For example, the plate assembly may be selectively pivotable about the tilt axis between a normal upright plowing position and a tilted plowing position in which the bottom portion of the plate assembly is positioned outwardly and away from the vehicle as compared to the plate assembly's upright position. For example, with the apparatus mounted to a rear of a vehicle, in the tilted plowing position the bottom of the plate assembly is positioned rearward and away from the vehicle, as compared to the plate assembly's upright position. The plate assembly includes a center snow pushing plate coupled at a center portion to the support frame. The plate assembly may be pivotable relative to the support frame about a vertical twist axis that is parallel to the vertical axis of the vehicle when the plate assembly is in the upright plowing position. For example, respective outboard ends of the blade assembly can be moved forward or rearward relative the forward travel direction of the vehicle, such as for angling the plate assembly to windrow snow laterally away from the plate assembly. The apparatus may further include a rotation or twist actuator between the support frame and the center plate for pivoting the plate assembly about the twist axis.

An extendable snow pushing plate or wing is pivotably coupled at a first end to an outboard end of the center plate and pivotable relative to the center plate about a sweep axis that is parallel to the vertical twist axis. The second end of the wing is moveable through an arc of greater than about one-hundred eighty degrees (180°) in a plane that is perpendicular to the sweep axis and the vertical axis of the vehicle when the plate assembly is in the upright position.

Preferably, the wing is pivotable through an arc of about two-hundred seventy degrees (270°) relative to the center plate. The wing is selectively extendable and retractable between a stowed configuration in which the wing is extends laterally inboard and alongside the center plate, and a linearly extended configuration in which the wing is positioned laterally outboard of the center plate such that the wing and the center plate form a generally linear snow pushing surface. Preferably, when in the stowed configuration, the wing is parallel to and alongside the center plate to assume a particularly compact or small footprint. The blade assembly includes a first wing sweep actuation mechanism, such as in the form of a hydraulic cylinder actuator, to pivot the wing relative to the center plate about the vertical sweep axis. The sweep actuation mechanism may include an articulating linkage assembly disposed between the wing and the center plate with the first sweep actuator coupled between the articulating linkage assembly and either the center plate or the extendable plate. The wing sweep actuator and the articulating linkage assembly cooperate to pivot the wing relative to the center plate about the vertical sweep axis. The snow plow apparatus is operable to clear snow or debris when the support frame is in a lowered position such that the lower portion of the plate assembly is in contact with a ground surface adjacent to the vehicle, regardless of the position of the wing relative to the center plate. In other words, the snow plow apparatus is operable to clear snow or debris with the wing in the stowed configuration, the linear extended configuration, as well as any other forward/rearward swept position.

In one aspect, the snow plow apparatus includes a second wing or sweep actuator coupled between the articulating linkage assembly and either the center plate or the wing, whichever of those is not coupled to the first sweep actuator. The first sweep actuator, the second sweep actuator, and the articulating linkage assembly cooperate to pivot the wing relative to the center plate. Optionally, the snow plow apparatus includes a mechanical actuator synchronizer to coordinate the operation of a first hydraulic actuator cylinder and a second hydraulic actuator cylinder such that the actuators' strokes are maintained generally equal to one another. The synchronizer includes a linkage assembly, a tracking pin, and a pin guide bracket which all cooperate with the extendable plate, center plate, a hinge between the wing and center plate, and the articulating linkage assembly to synchronize the piston strokes of the first and second actuators.

In another aspect, the support frame includes a primary support arm coupled between a forward portion of the vehicle and a center portion of the rear side of the center plate. A cylindrical sleeve is provided at the distal end of the support arm for pivotably coupling the plate assembly with the support arm. A coupling shaft is disposed between the center blade and the cylindrical sleeve. An oscillation bushing is disposed between the cylindrical sleeve and the coupling shaft to permit the plate assembly to slant, float, and/or oscillate relative to the primary support arm and to accommodate uneven or slanted ground surfaces.

In yet another aspect, the support frame includes a first portion and a second portion that are selectively movable relative to one another. The apparatus also includes a lift actuator operably coupled between the first portion and the second portion to move the first portion and the second portion relative to one another to selectively raise and lower the plate assembly relative to the ground surface adjacent to the vehicle. Optionally, the lift actuator includes a trip or break-away function that permits the blade assembly to move away from an object impacted by the blade assembly, to protect the snow plow apparatus and vehicle from damage. In another aspect, the support frame may include a four-bar linkage disposed between the first portion and the second portion. The four-bar linkage may include a torsion bar disposed between two bars of the four-bar linkage and/or may include a plurality of tension chains disposed between two bars of the four-bar linkage.

An extendable link may be provided between the support frame and the plate assembly to control tilting of the plate assembly about the tilt axis. In the event that the plate assembly impacts a heavy or immovable object, the extendable link is operable to direct pressurized fluid into the lift actuator to force the plate assembly to move upwardly away from the heavy or immovable object impacted by the plate assembly. As such, the extendable link may provide protection from damage for the snow plow apparatus and/or the vehicle.

In yet another aspect, the snow plow apparatus includes one or more snow plate or blade angle sensors, such as in the form of a contactless sensor, to monitor an angle between the wing and the center plate and/or the angle between the center plate and the support frame. The angle sensors communicate the relative positions of the blade assembly to an operator, such as when the operator is in the passenger cabin of the vehicle. In still another aspect, the plate assembly includes an elastically deformable excluder disposed at a lower portion of a hinge coupled between the wing and the center plate. The excluder fills a gap or space that is formed between the lower portion of the first end of the wing and the lower portion of the outboard end of the center plate. The excluder is also configured to contact the ground surface simultaneously with the bottom edge of the plate assembly when the plate assembly is in the lowered position. Optionally, the excluder is formed of a round or cylindrical body that is dimensioned to fill the gap between the wing and center plate.

In still another aspect, the snow pushing face of each of the wing and the center plate includes a moldboard that is configured to efficiently move and direct snow or debris along the surface of the respective plate. The moldboard may have a profile shape that is flat, curved/contoured, or a combination of flat and curved/contoured. Optionally, the apparatus may include selectively deformable moldboards.

In another aspect, the wing and the center plate each includes a pivotable contact plate or trip releasable edge that is disposed at a lower portion of the respective plate. The contact plate is configured to release upon impact with heavy and immovable objects and further configured to return to its initial position that it occupied prior to the impact event. The contact plate is provided to reduce or eliminate damage to the snow plow apparatus from impact events.

In yet another aspect, the plate assembly may be configured such that when the wing is in the stowed configuration the snow pushing face of each of the wing and the center plate are facing away from one another. In an alternative aspect, the plate assembly may be configured such that when the wing is in the stowed configuration the snow pushing face of each of the wing and the center plate are facing one another. The support frame may be coupled between the center plate and the rear end of the vehicle such that when the wing is in the linearly extended configuration the snow pushing face of each of the wing and the center plate are facing forward and toward the vehicle. Alternatively, the support frame may be coupled between a rear portion of the center plate and the front end of the vehicle such that when the wing is in the linearly extended configuration the snow pushing face of each of the wing and the center plate are facing forward and away from the vehicle.

According to another form of the present invention, a deformable moldboard assembly is provided for a plow blade and includes a moldboard actuation bracket and a deformable moldboard. The actuation bracket is pivotably coupled to an upper portion of a plow blade and the deformable moldboard is coupled between an upper portion of the actuation bracket and a portion of a debris pushing face of the plow blade. The moldboard assembly includes an actuator, such as a hydraulic linear actuator, operable to pivot the actuation bracket relative to the plow blade. The actuation bracket and the moldboard are movable between a stowed position in which the moldboard is linear and parallel to the debris pushing face of the plow blade, and a deployed position in which the moldboard is deformed in a curvilinear manner such that an upper portion of the moldboard contours outward and away from the debris pushing face of the plow blade. The moldboard is formed of a pliable material capable of deforming as the actuation bracket moves relative to the blow blade and capable of returning to its substantially original form when the actuation bracket returns to the stowed position. Optionally, the actuator may be a linear actuator that is coupled between a portion of the plow blade and a portion the actuation bracket such that when the linear actuator extends, the actuation bracket pivots toward the deployed position and when the linear actuator retracts, the actuation bracket pivots toward the stowed position.

Accordingly, a vehicle mounted articulating snow plow apparatus is provided for clearing snow from roads and driveways. The snow plow includes a blade assembly having a center blade and an extendable wing blade pivotably coupled to each end of the center blade. The blade assembly can be raised and lowered relative to the vehicle and the ground surface and can be rotated about a vertical axis. Each extendable blade is moveable relative to the center blade through an arc of greater than about one-hundred eighty degrees (180°) about a vertical axis, and preferably movable up to at least about two-hundred seventy degrees (270°). The blade assembly is selectively extendable and retractable between at least a stowed configuration and a linearly extended configuration. The blade assembly includes an actuator and articulating linkage assembly to pivot the extendable blade relative to the center plate. Additional actuators are provided to raise and lower the blade assembly relative to the vehicle and to rotate the blade assembly relative to the support frame.

These and other objects, advantages, purposes and features of this invention will become apparent upon review of the following specification in conjunction with the drawings.

DESCRIPTION OF THE PREFERRED EMBODIMENTS

Figure 1:
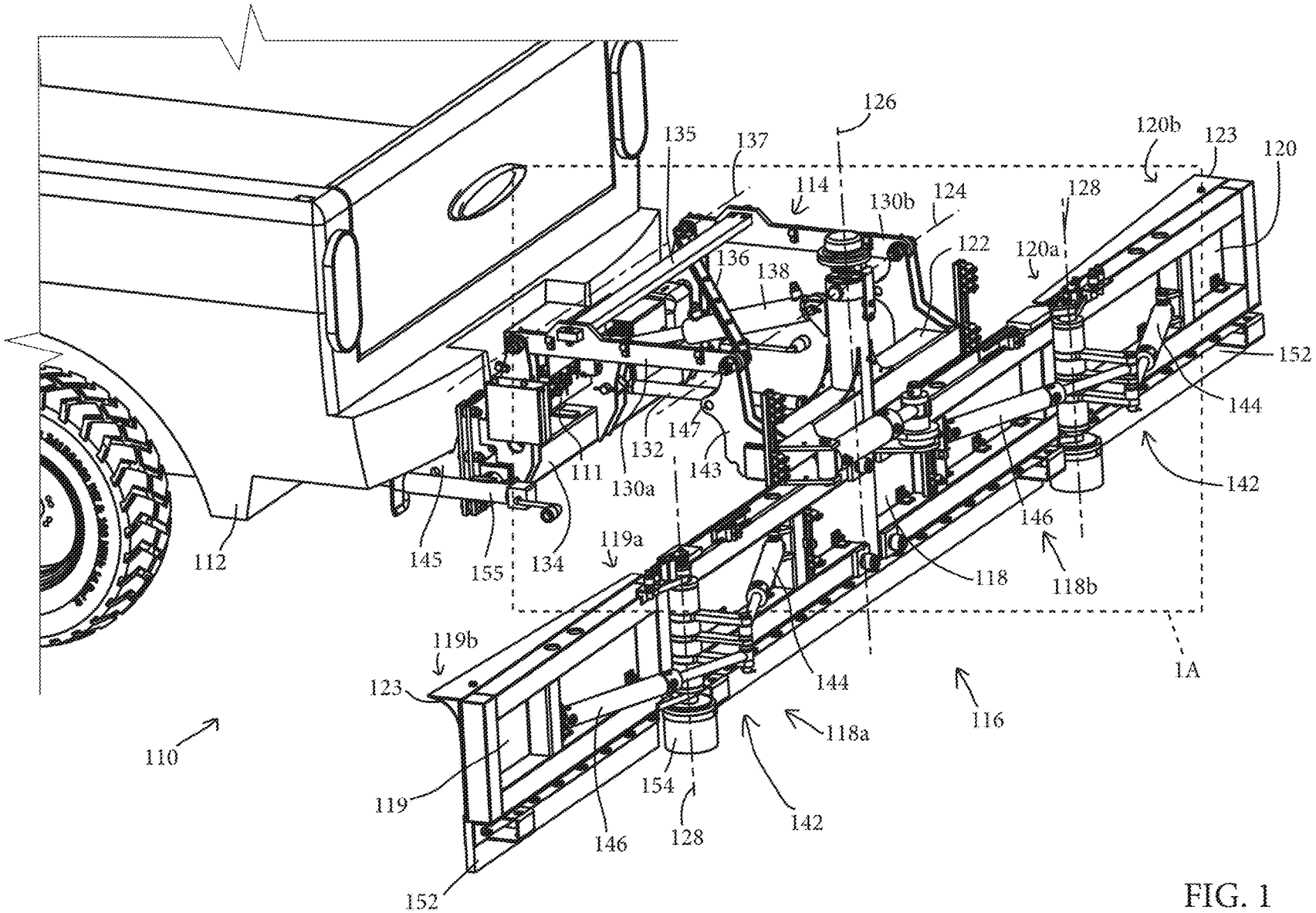
FIG. 1 is a rear-side perspective view of a vehicle mounted articulating snow plow apparatus in accordance with the present invention, depicted in a lowered position with an extendable plow blade assembly in a linear extended configuration, with the entirety of the plow blade assembly positioned in a neutral position relative to the forward travel direction of the vehicle.

Referring now to the drawings and the illustrative embodiments depicted therein, an articulating snow plow apparatus 110 for attachment to a vehicle 112 is provided for clearing snow and other debris from road, driveways, and other surfaces adjacent to (in the vicinity of) the vehicle (FIG. 1). The apparatus 110 includes a raising and lowering support frame 114 for securing an articulating plow blade or plate assembly 116 to the vehicle 112. The plow blade assembly 116 includes a center blade or plate 118 that is pivotably coupled to the support frame 114 such that the center blade is rotatable about a vertical axis relative to the vehicle 112. A left side extendable plow wing blade, or plate 119 and a right side extendable plow wing blade, or plate 120 are pivotably coupled to respective outboard ends of the center blade 118, with each side wing 119, 120 being pivotable about the respective outboard end of the center blade 118 through an arc of at least about one-hundred eighty degrees (180°). A hydraulic system 111 is provided with apparatus 110 to control the various movements of the blade assembly 116 (FIGS. 1, 1A, 6, and 10).

Figure 2:
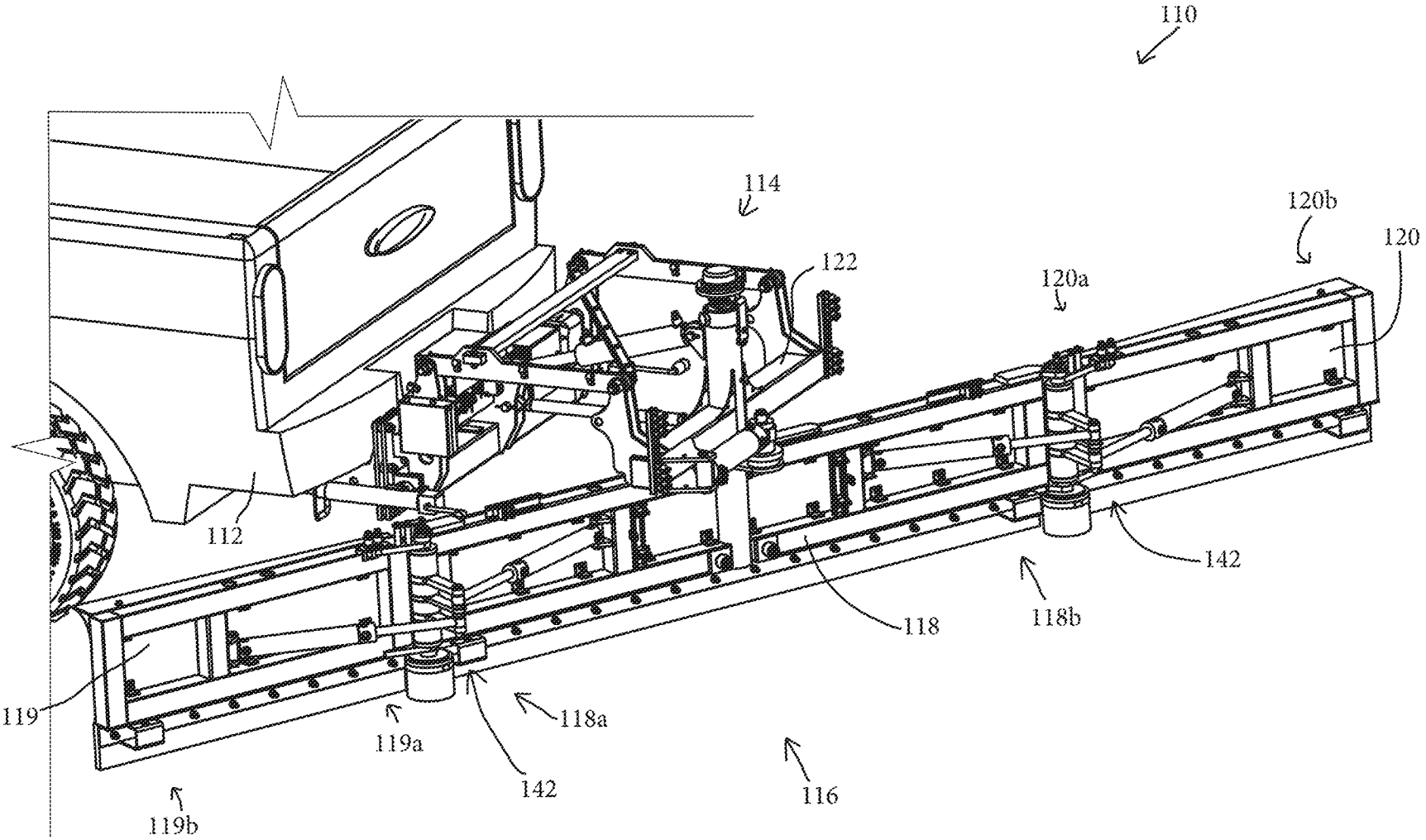
FIG. 2 is another rear-side perspective view of the articulating snow plow apparatus of FIG. 1, depicted in the lowered position with the plow blade assembly in the linear extended configuration and twisted at an oblique angle relative to the forward travel direction.
Figure 3:
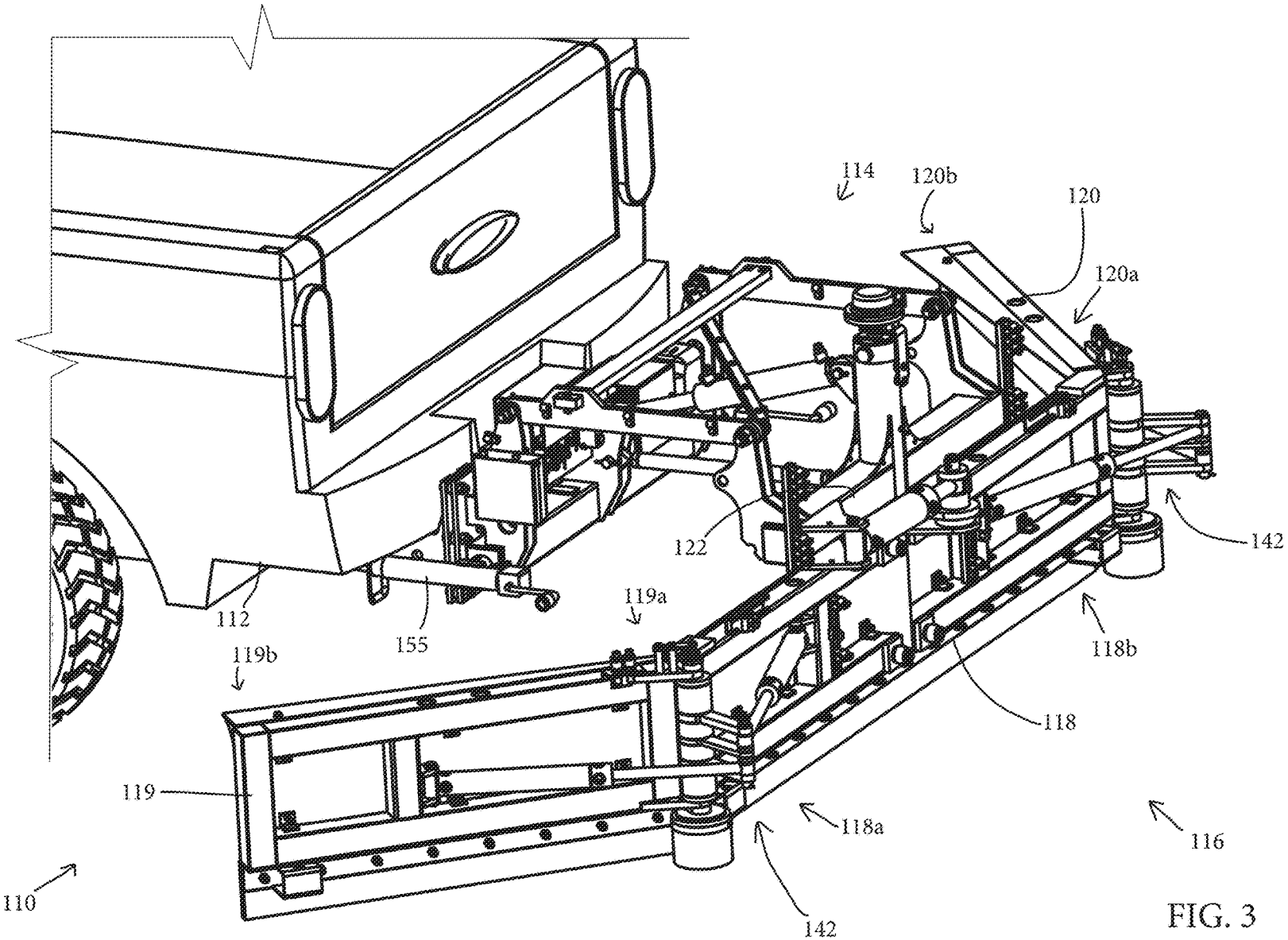
FIG. 3 is another rear-side perspective view of the articulating snow plow apparatus of FIG. 1, depicted in the lowered position with a center portion of the plow blade assembly in the neutral position and the plow wings in a forward-swept position relative to the center blade portion and the forward travel direction.
Figure 6:
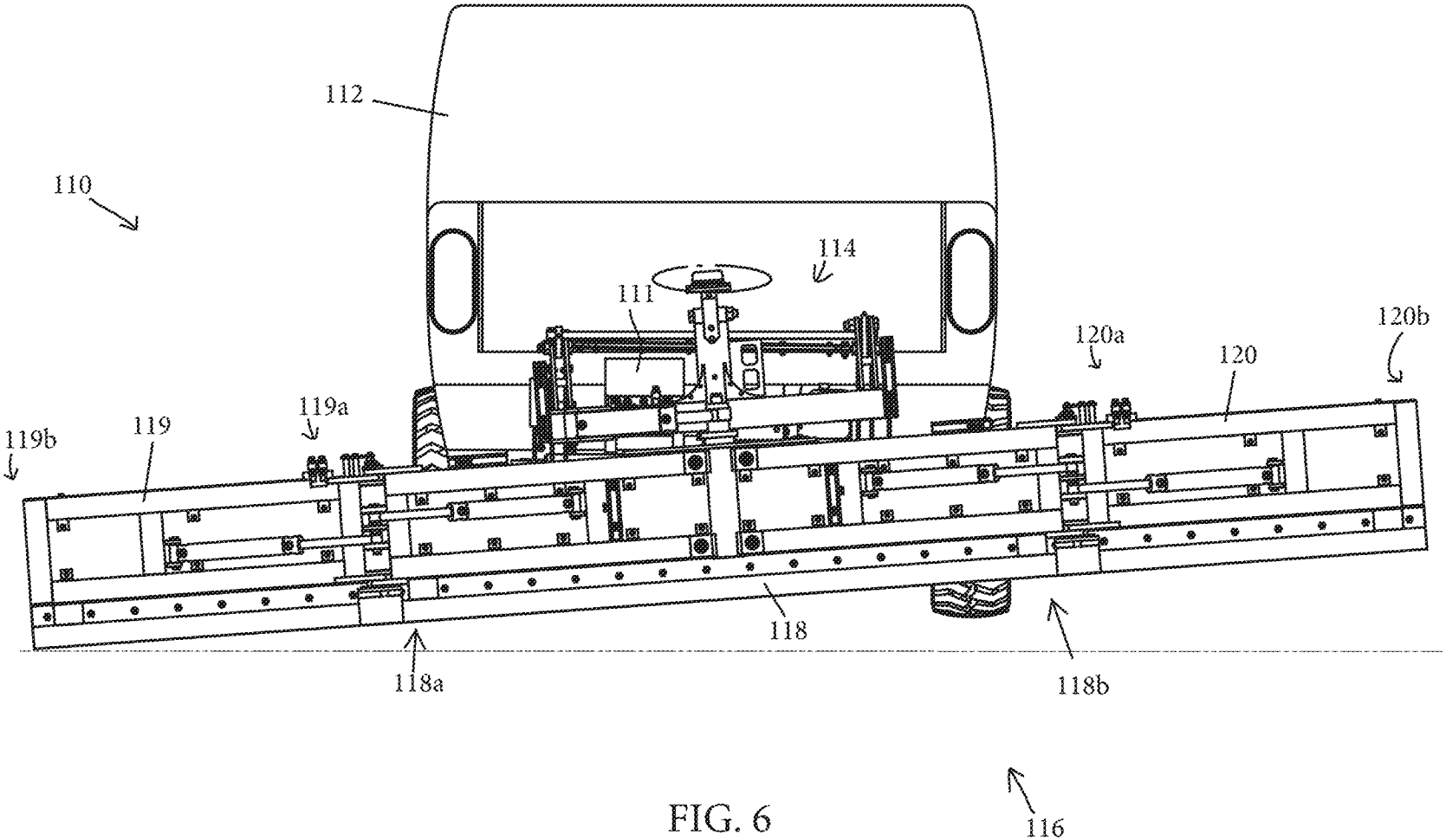
FIG. 6 is a rear elevation view of the articulating snow plow apparatus of FIG. 1, depicted with the plow blade assembly in the linear extended configuration and in a slanted position relative to the lateral axis of the vehicle.
Figure 9:
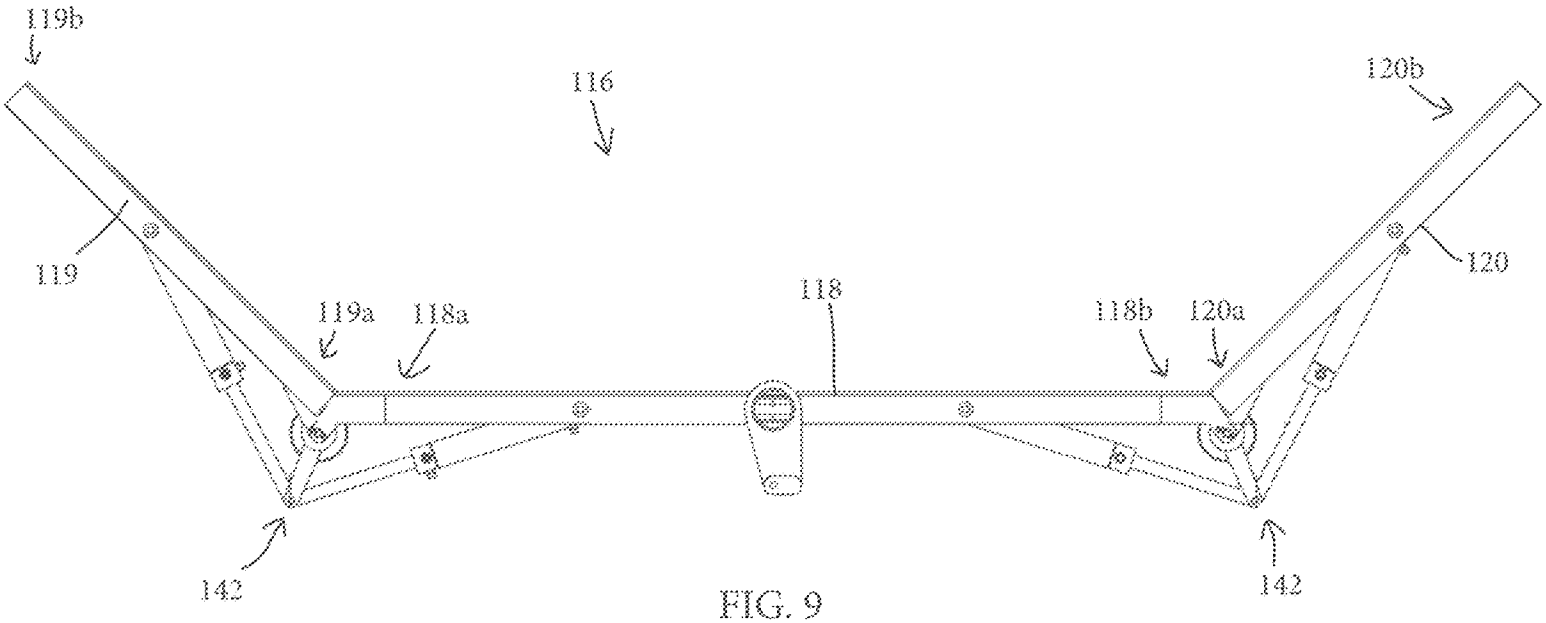
FIG. 9 is another top plan view of the blade assembly of FIG. 1, depicted with the plow wings in a forward-swept position.
Figure 10:
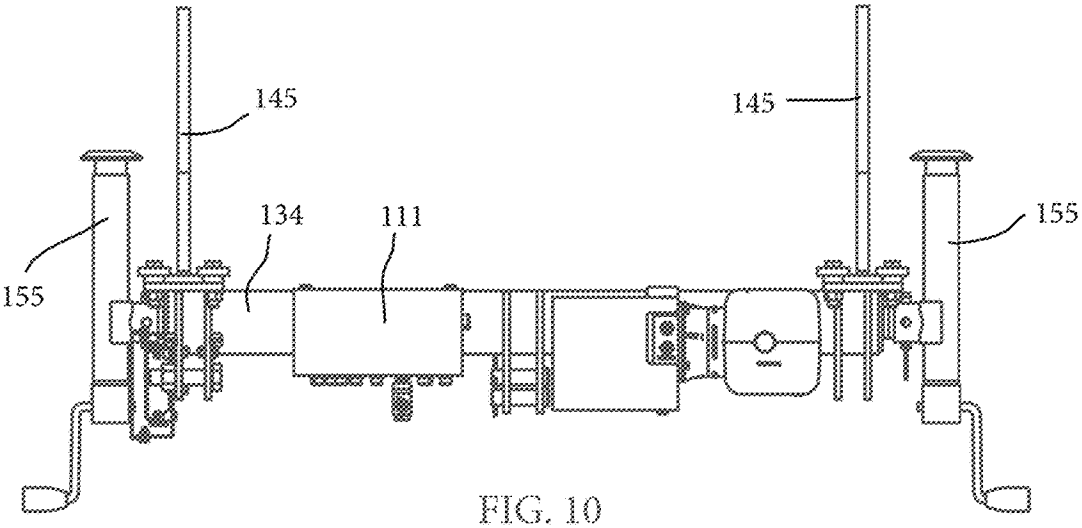
FIG. 10 is a top plan view of a vehicle mounting frame of the articulating snow plow apparatus of FIG. 1.
Figure 14:
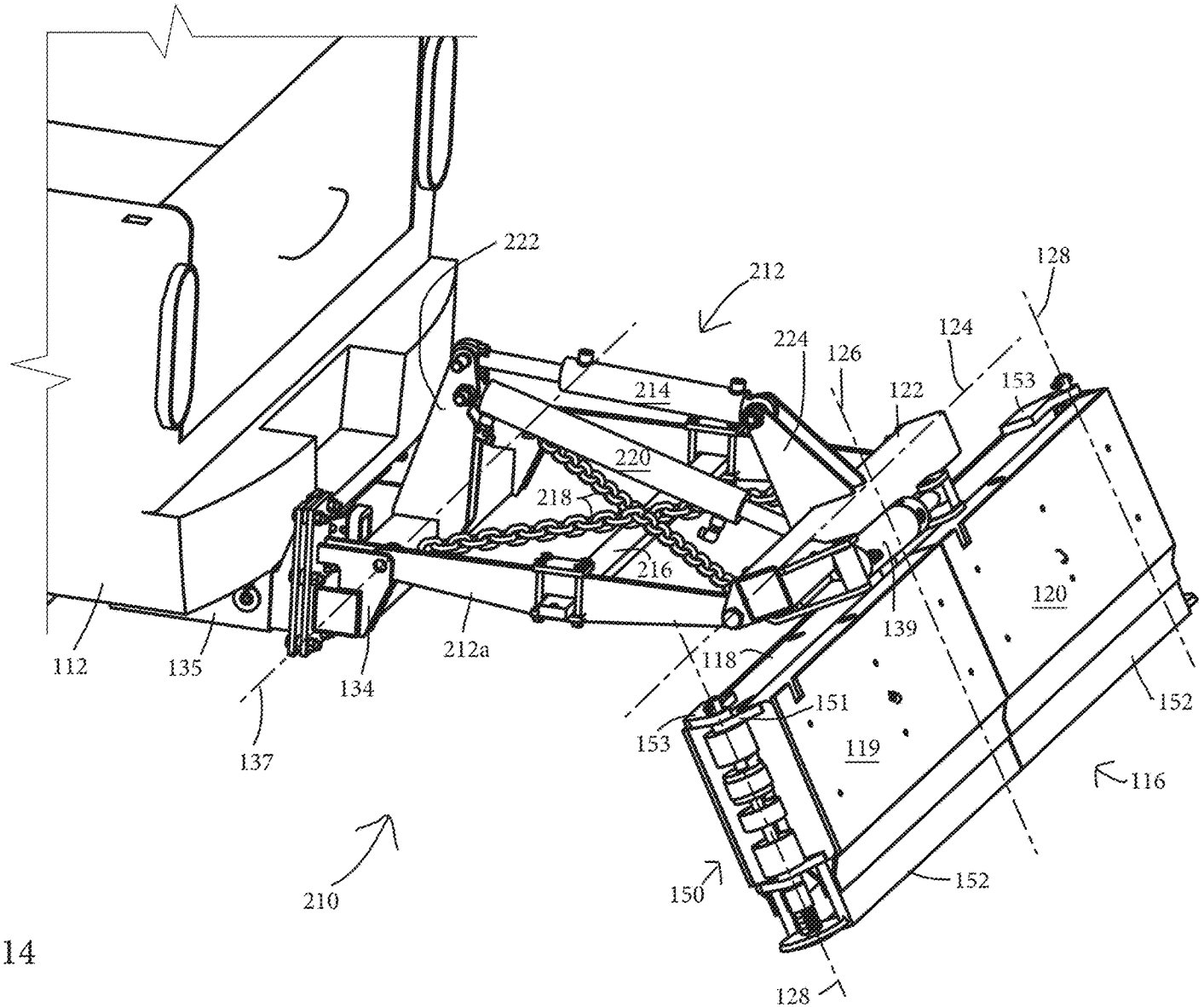
FIG. 14 is a rear-side perspective view of another vehicle mounted articulating snow plow apparatus in accordance with the present invention, depicted in a lowered position with an extendable plow blade assembly in a closed or stowed configuration, with the entirety of the plow blade assembly positioned in a rearwardly tilted position relative to the lateral axis of the vehicle and a neutral position relative to the forward travel direction of the vehicle.

As previously defined, for purposes of this disclosure, "sweep" refers to pivoting or rotating of an element about one of its ends about a generally upright or vertical axis. For example, as best shown in FIGS. 3 and 9, plow wings 119, 120 are each swept forward relative to the center plate 118 through a generally horizontal plane. "Twist" refers to a pivoting or rotating of an element about its middle portion about a generally upright or vertical axis. For example, as best shown in FIG. 2, blade assembly 116 is twisted clockwise relative to support frame 114 through a generally horizontal plane such that the blade assembly 116 can windrow snow toward a particular side of the blade assembly and the vehicle. "Tilt" refers to a pivoting or rotating of an element about a generally horizontal axis that is perpendicular to a forward direction of travel of a vehicle. For example, as best shown in FIG. 14, the blade assembly 116 is tilted such that the lower edge of the blade assembly 116 is rearward of its corresponding upright position. "Slant" refers to an angle change of an element relative to its typical lateral and horizontal orientation. For example, as best shown in FIG. 6, the blade assembly 116 is slanted counterclockwise in a generally vertical plane with the right end of the assembly 116 upward and above the ground surface.

Figure 4:
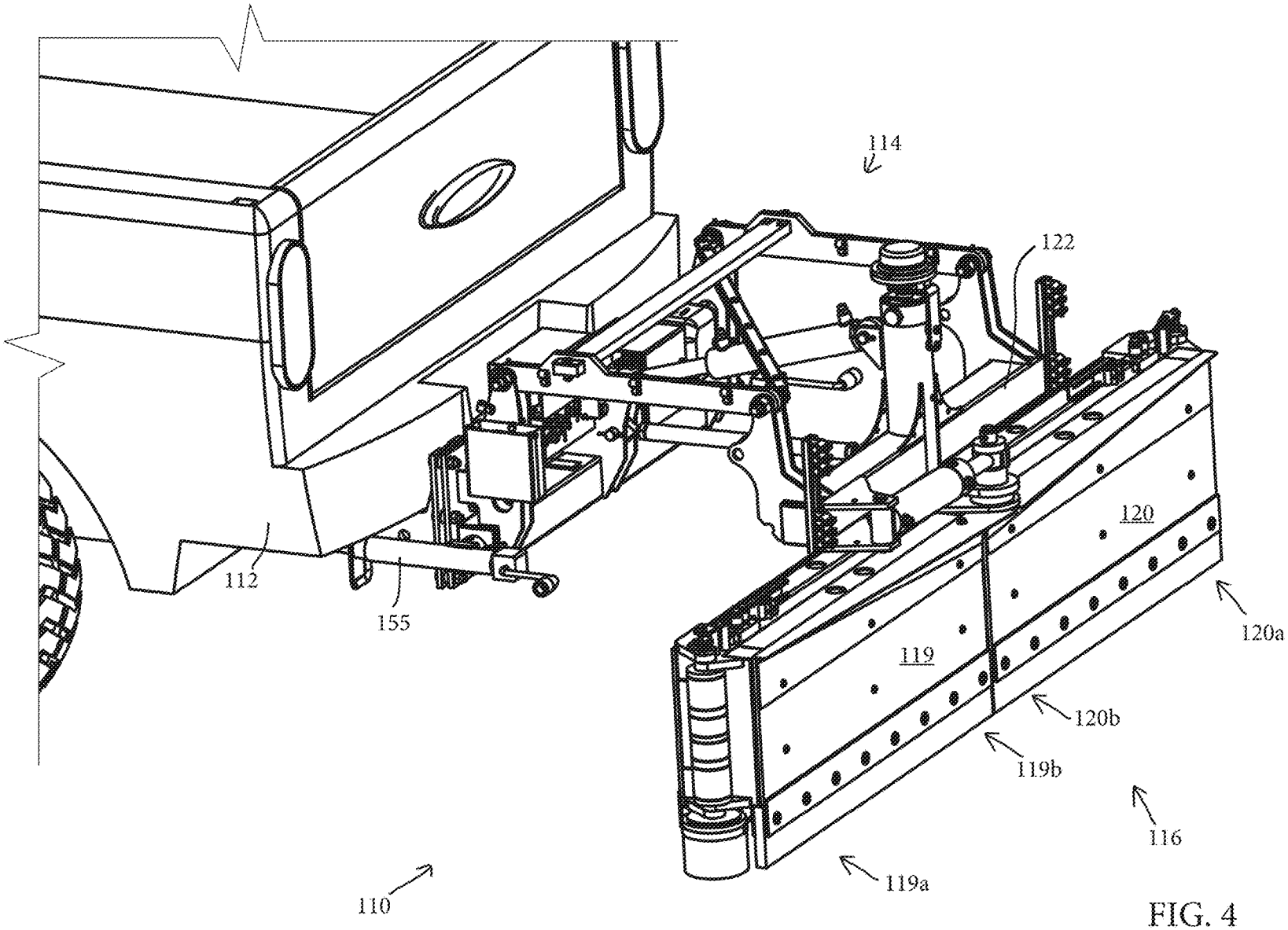
FIG. 4 is another rear-side perspective view of the articulating snow plow apparatus of FIG. 1, depicted in the lowered position with the plow blade assembly in a closed or stowed configuration, and the entirety of the plow blade assembly in the neutral position.
Figure 5:
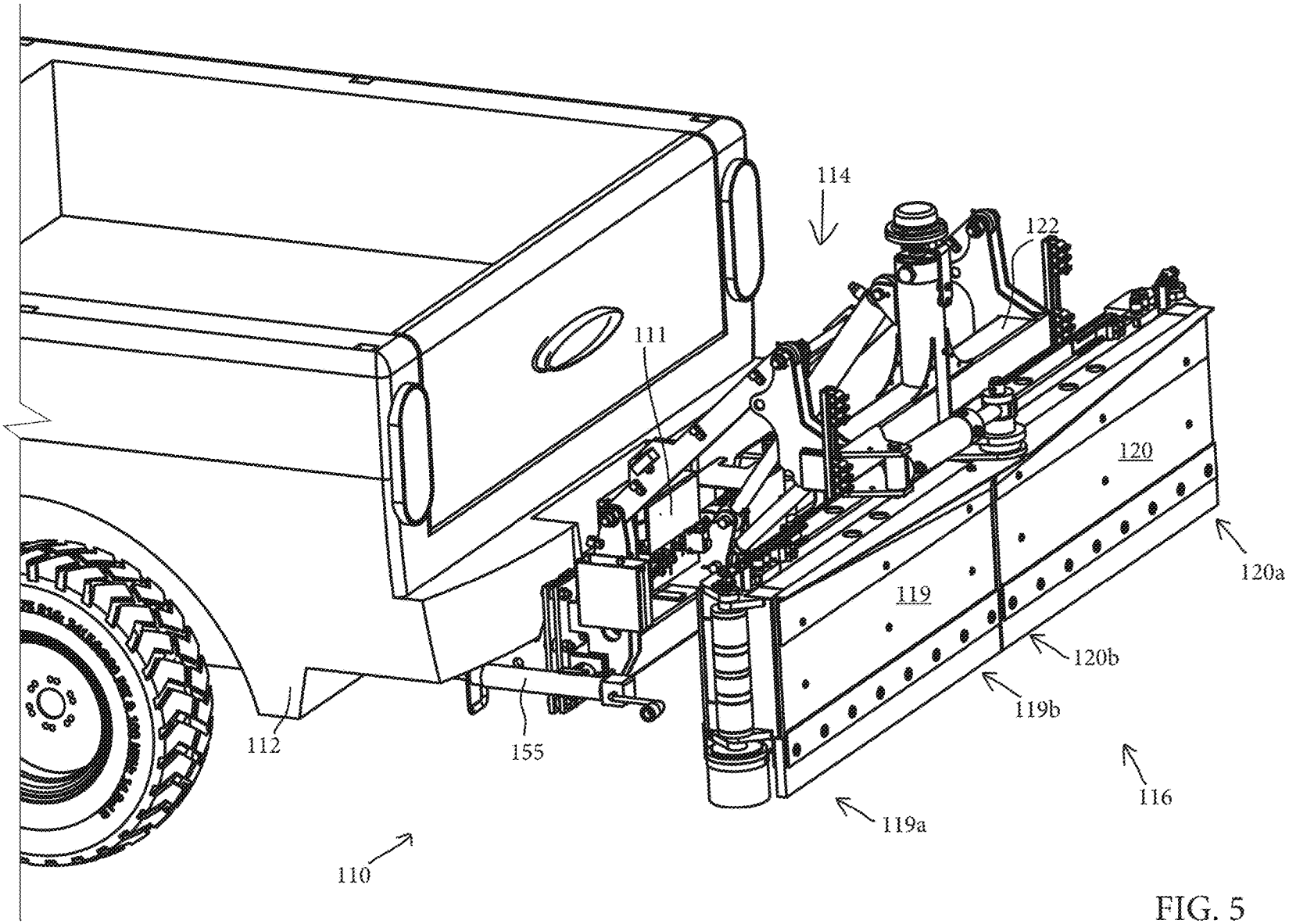
FIG. 5 is another rear-side perspective view of the articulating snow plow apparatus of FIG. 1, depicted in a raised or lifted position with the plow wings in the stowed configuration and the entirety of the plow blade assembly in the neutral position.
Figure 7:
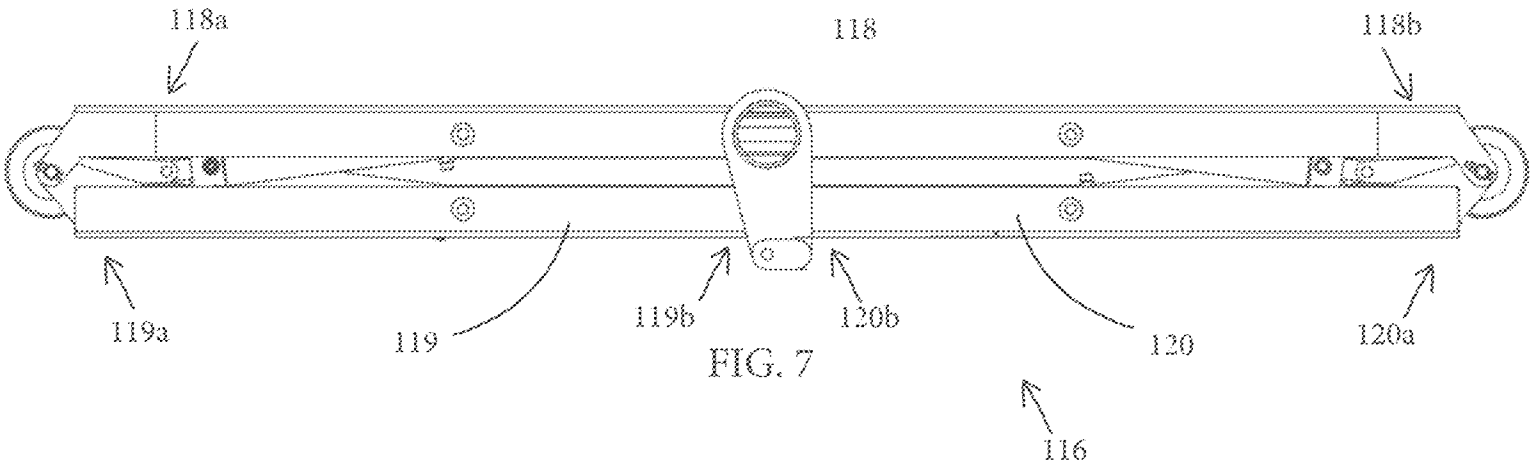
FIG. 7 is a top plan view of the blade assembly of FIG. 1, depicted in the stowed configuration.
Figure 8:
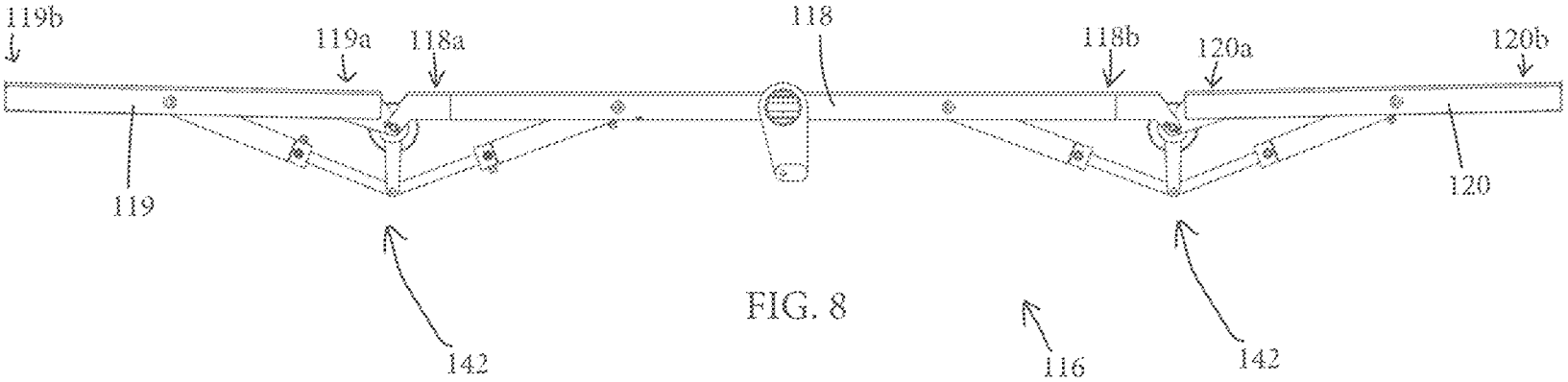
FIG. 8 is another top plan view of the blade assembly of FIG. 1, depicted in the linear extended configuration.
Figure 17:
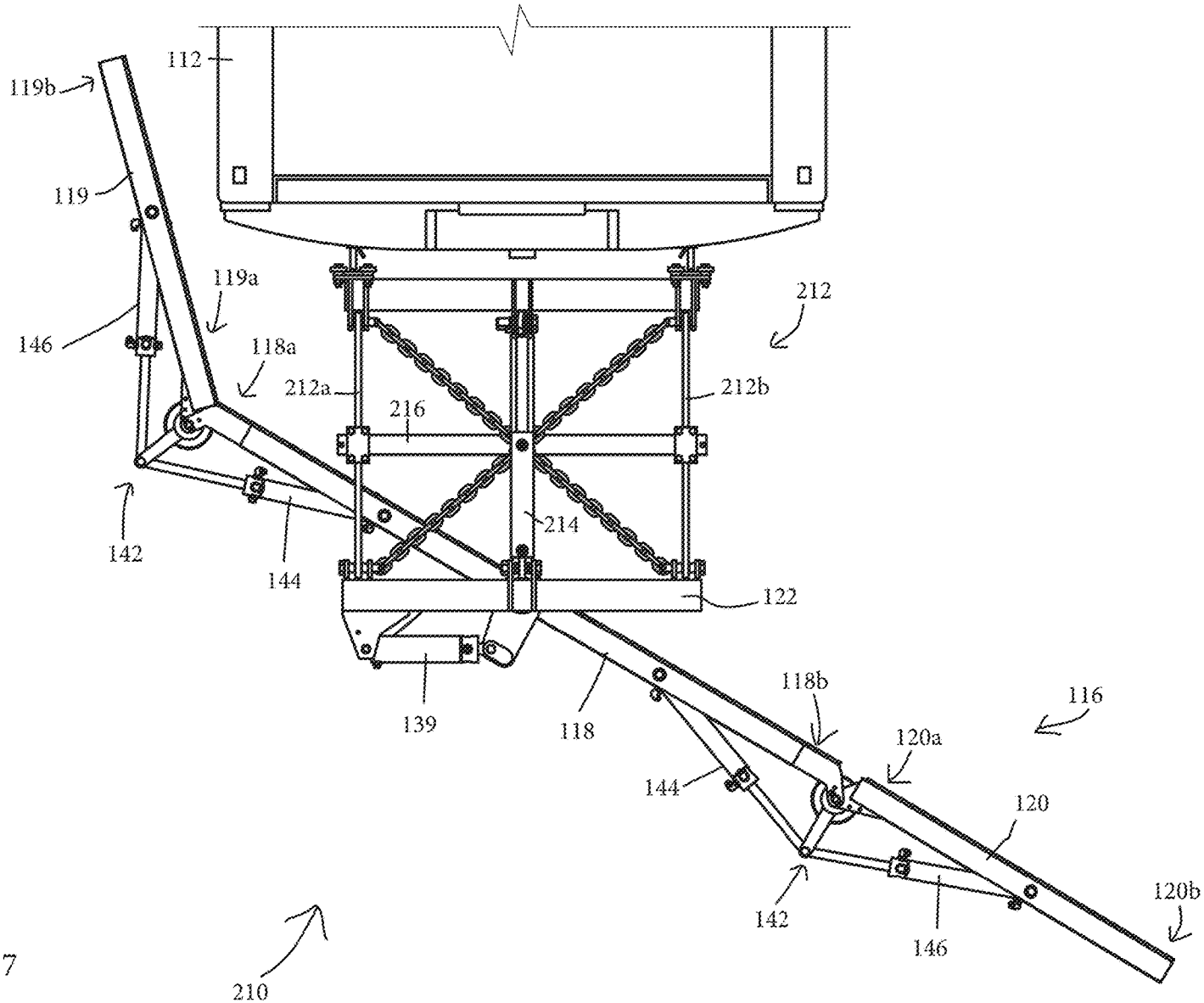
FIG. 17 is another top plan view of the articulating snow plow apparatus of FIG. 16, depicted with the left side plow wing in a forward-swept position.
Figure 18:
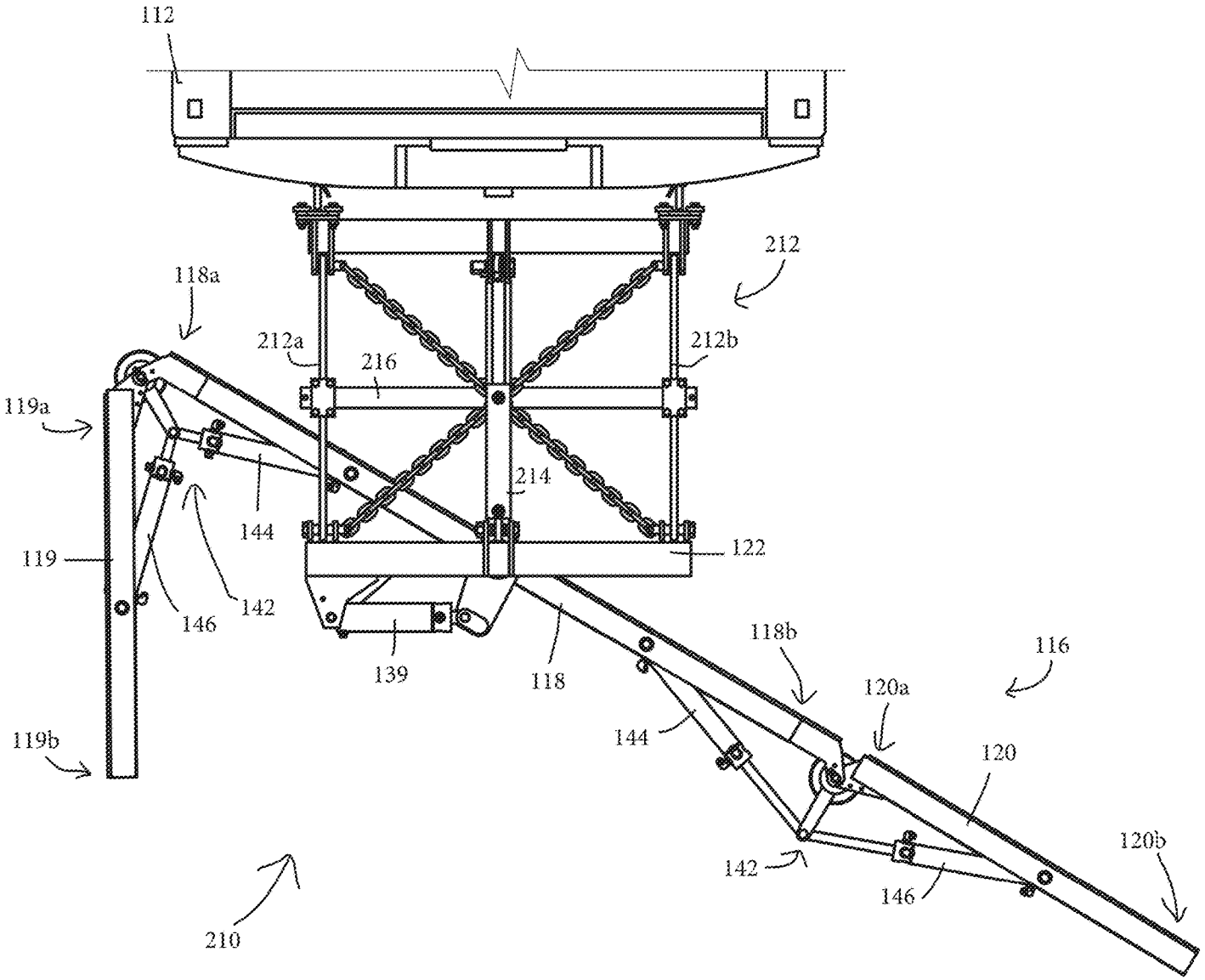
FIG. 18 is another top plan view of the articulating snow plow apparatus of FIG. 16, depicted with the left side plow wing in a rearward-swept position.

The plow blade assembly 116 is collapsible and extendable between a stowed configuration (FIGS. 4, 5, and 7) and a linearly extended configuration (FIGS. 1, 2, 6, and 8), as well as various incrementally extended configurations, in which the wings 119, 120 are in rearwardly swept positions and/or forwardly swept positions (e.g., FIGS. 3 and 9) relative to the center blade 118 and/or the forward travel direction of the vehicle 112. In the stowed configuration as shown in FIG. 5, the extendable plow wings 119, 120 are positioned parallel to and stowed alongside the center blade 118 to reduce the lateral footprint of the blade assembly 116, which is particularly advantageous when driving the vehicle 112 on roadways. In the linearly extended configuration, as shown in FIG. 1, the extendable plow wings 119, 120 are outboard of respective ends of the center plate 118 and substantially parallel to the center plate 118, which corresponds to the widest reach of the blade assembly 116 to allow the apparatus 110 to clear the widest possible path along the ground surface. The extendable plow wings 119, 120 may be positioned at various intervals between a fully forward-swept position and the stowed position, allowing the apparatus 110 to be configured to clear any width that is between the width of the center blade 118 and the total width of the blade assembly 116 in the linearly extended position. However, it will be appreciated that it is possible to achieve a clearing width that is even less than the overall stowed width of the blade assembly 116, by rotating the blade assembly 116 such as in the manner shown in FIG. 2, but with the blade assembly 116 in its stowed width. Each plow wing 119 and 120 is operable independent of the other, permitting various wing sweep configurations (see example of differently swept wings 119 and 120 of FIGS. 15, 17, and 18 of later described plow apparatus 210). The apparatus 110 may include a tilt or swing function to allow the blade assembly 116 to tilt or reach from a typical upright position rearwardly away from the vehicle 112 (see example of tilted blade assembly of apparatus 210 in later described FIG. 14), which is particularly useful when taking care around fragile structures, such as garage doors for example. The apparatus may permit the blade assembly 116 to slant relative to the vehicle's longitudinal axis so that the blade assembly 116 automatically adjusts to uneven or slanted ground surfaces (FIG. 6). Additional features may include plate angle or position sensors, excluders to fill gaps between the extendable wings and the center blade, and trip or release mechanisms to protect the apparatus from impact damage.

Referring to the illustrated embodiments of FIGS. 1-13, the articulating snow plow apparatus 110 includes the support frame 114 that is coupled to the vehicle 112 and is operable to raise and lower a plow blade or snow pushing plate assembly 116 relative to the ground surface adjacent to the vehicle 112. The blade assembly 116 is pivotably coupled to a rear frame 122 that is pivotably coupled to a rear portion of the support frame 114. The rear frame 122 is pivotable or tiltable relative to the frame 114 about a lateral tilt axis 124 that is substantially parallel to the lateral axis of the vehicle 112 (FIG. 1). The center blade or snow pushing plate 118 is pivotably coupled at an upper, center portion of the blade 118 to a lower, center portion of the rear frame 122, and the center blade 118 is pivotable relative to the support frame 114 about an assembly rotation or twist axis 126 that is parallel to the vertical axis of the vehicle when the blade assembly is the upright position (FIG. 1). The blade assembly 116 may be rotated about the twist axis 126 between a neutral position in which at least the center plate 118 is generally perpendicular to the forward travel direction of the vehicle 112 (FIGS. 1, 3-6, and 11-13), and an oblique position in which at least the center plate 118 is oblique to the neutral position (either clockwise or counterclockwise; FIG. 2). Thus, for example, the apparatus 110 can be configured to the oblique position to windrow debris/snow away from the forward/rearward travel direction of the vehicle (i.e. direct debris/snow to one side of the vehicle). The center blade 118 includes a left outboard end 118*a* and a right outboard end 118*b* (FIGS. 1-2, 6), when viewed from behind the vehicle 112 and apparatus 110, as best shown in FIG. 6.

Figure 15:
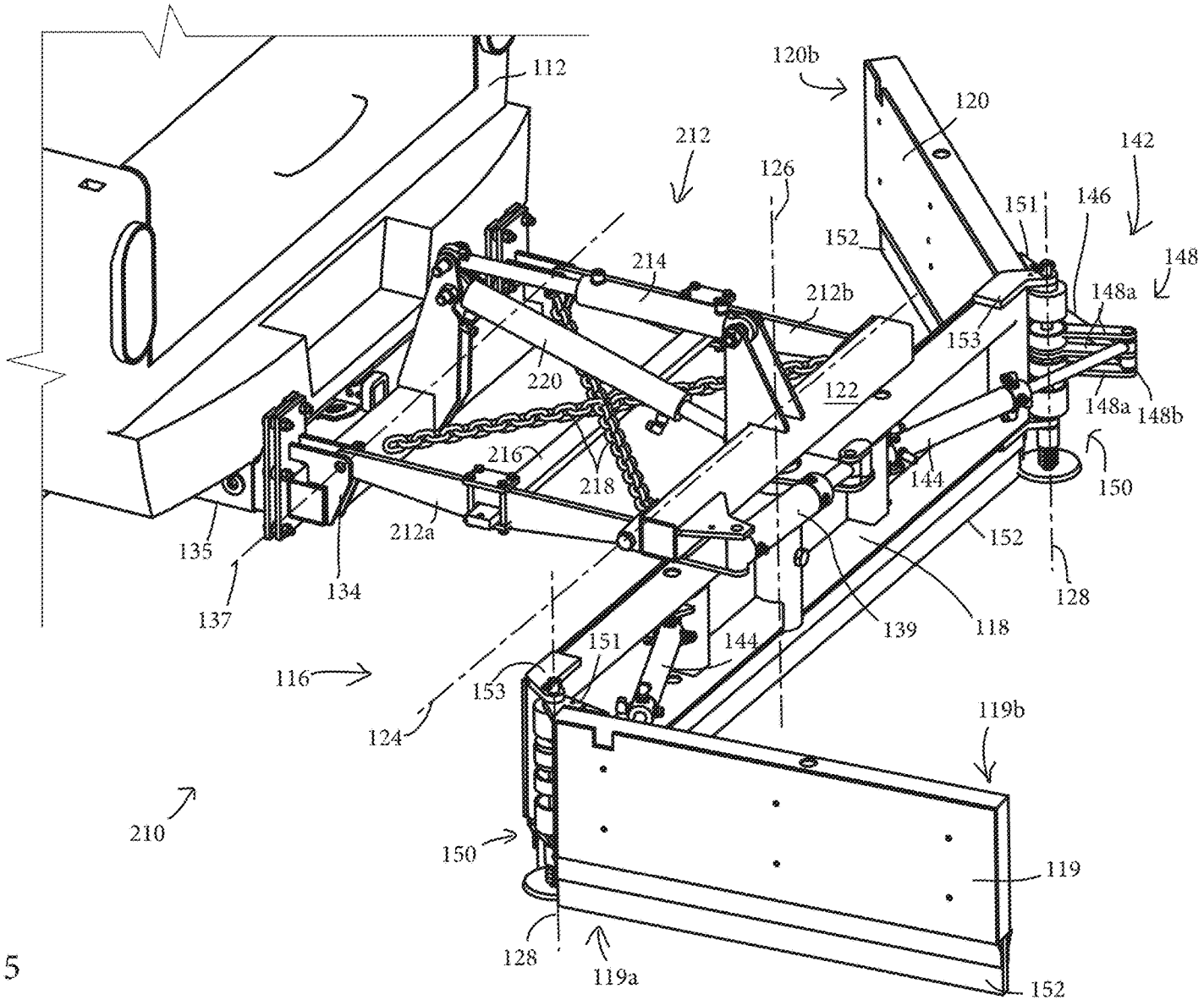
FIG. 15 is another rear-side perspective view of the articulating snow plow apparatus of FIG. 14, depicted in the lowered position with the left side plow wing in a rearward-swept position and the right side plow wing in a forward-swept position.
Figure 16:
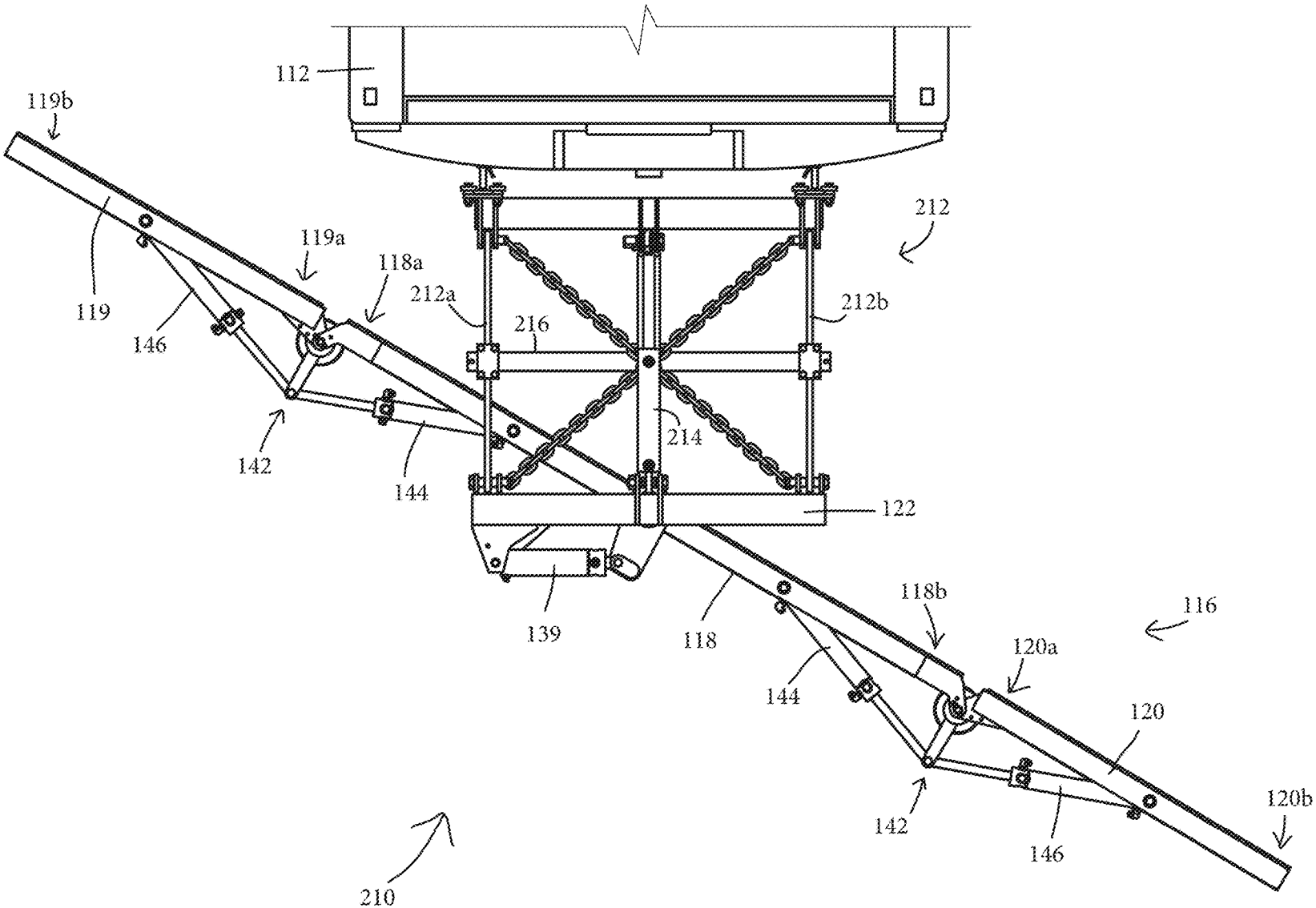
FIG. 16 is a top plan view of the articulating snow plow apparatus of FIG. 14, depicted with the plow blade assembly in a linear extended configuration and twisted at an oblique angle relative to the forward travel direction.

Each of the extendable plow blades, wings, or snow pushing plates 119, 120 is pivotably coupled at a first end 119*a*, 120*a* to a respective outboard end 118*a*, 118*b* of the center blade 118. Each wing 119, 120 is pivotable relative to the center blade 118 about a respective wing sweep axis 128 that is parallel to twist axis 126 (FIG. 1). The second end 119*b*, 120*b* of each plow wing is moveable through an arc of greater than about one-hundred eighty degrees (180°), and preferably about two-hundred seventy degrees (270°) or more, in a generally horizontal plane (i.e. perpendicular to the sweep axis) when the blade assembly 116 is in the upright position. Each wing 119, 120 is selectively extendable and retractable between a stowed configuration in which the extendable plate is positioned parallel to and alongside the center plate 118 (FIG. 4), and a linearly extended configuration in which the extendable plate is positioned parallel to and outboard of the center plate 118 (FIG. 1). Each wing 119, 120 is independently positionable at any desired angle (relative to the center blade 118) between the stowed position (FIG. 4) and a fully forward-swept position (such as about 270° from the stowed position). Regardless of the positioning of the extendable wings 119, 120 relative to the center blade 118, the blade assembly 116 is operable to clear snow or debris when the apparatus 110 is in the lowered position. Blade position or angle sensors, such as contactless sensors 121, are provided to communicate the relative position of the extendable wings 119, 120 to an operator, such as when the operator is inside the passenger cabin of the vehicle 112. The wings 119, 120 and the center plate 118 of the illustrated embodiment of FIGS. 1-13 are shown as having fixed and mostly flat profiles or moldboard shapes on the snow/debris pushing surface, with contoured snow-deflecting upper portions 123 on upper portions of the wings 119, 120. However it will be appreciated that different profiles or fixed moldboard shapes may be used, such as flat moldboards as illustrated in FIGS. 14-15 or moldboards with curved/contoured upper and lower portions as illustrated in FIGS. 20-26, for example. Optionally, a deformable moldboard or snow deflecting apparatus may be provided at an upper portion and/or lower portion of the wings 119, 120, and center blade 118, such as a deformable moldboard 610 of FIGS. 45 and 46 as described in more detail below.

Figure 1A:
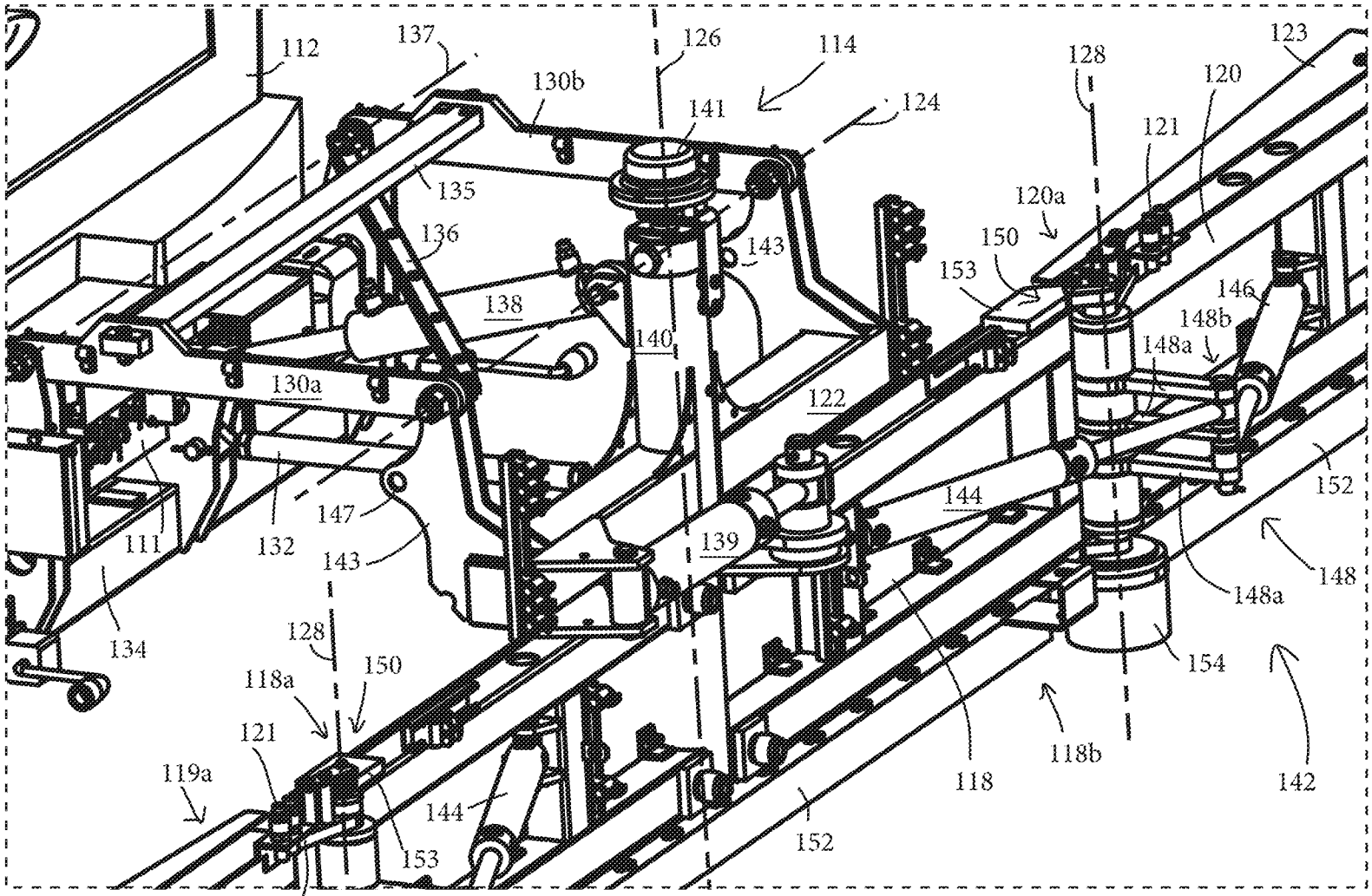
FIG. 1A is an enlarged view of the region designated 1A in FIG. 1.
Figure 11:
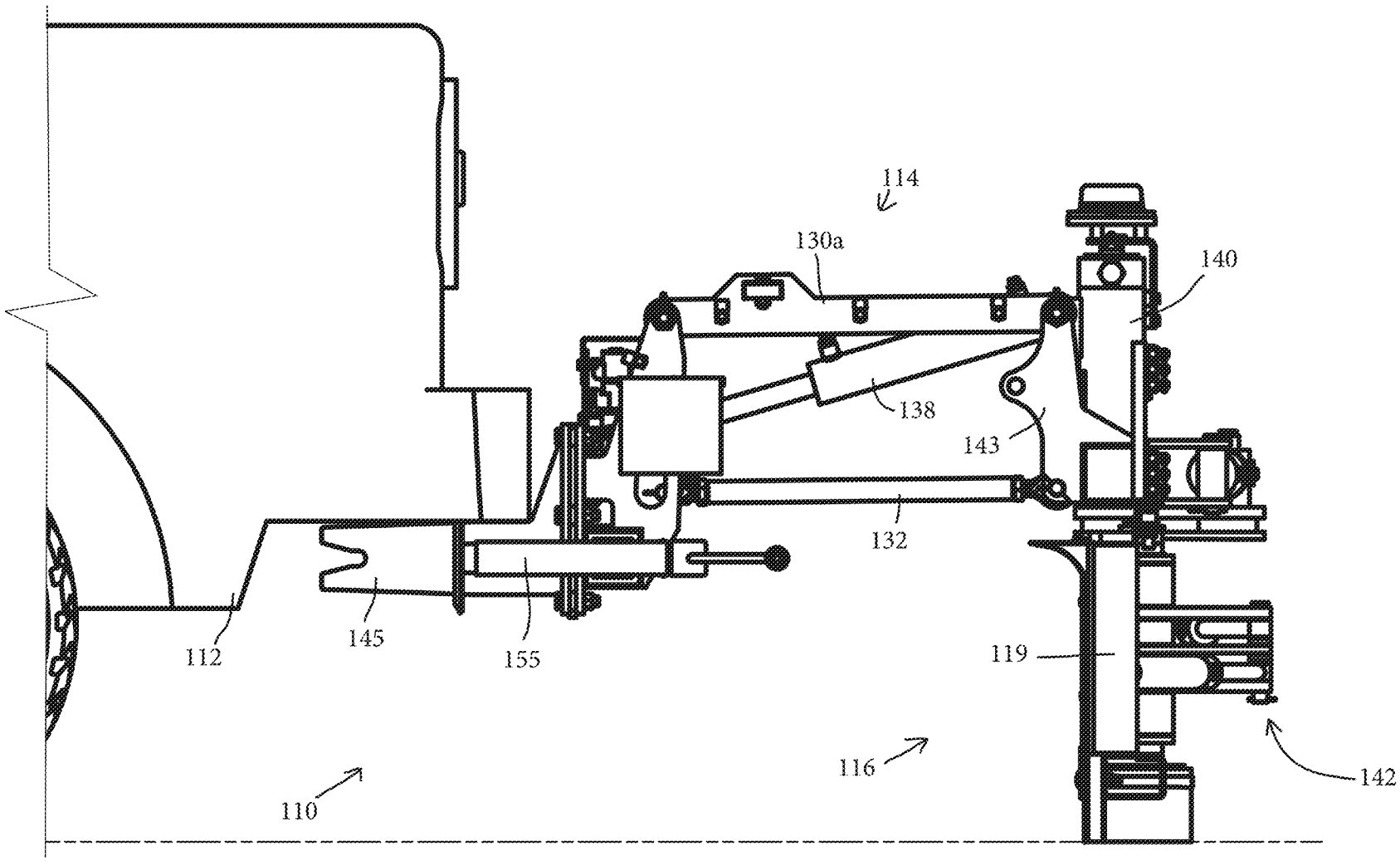
FIG. 11 is a side elevation view of the articulating snow plow apparatus of FIG. 1.
Figure 13:
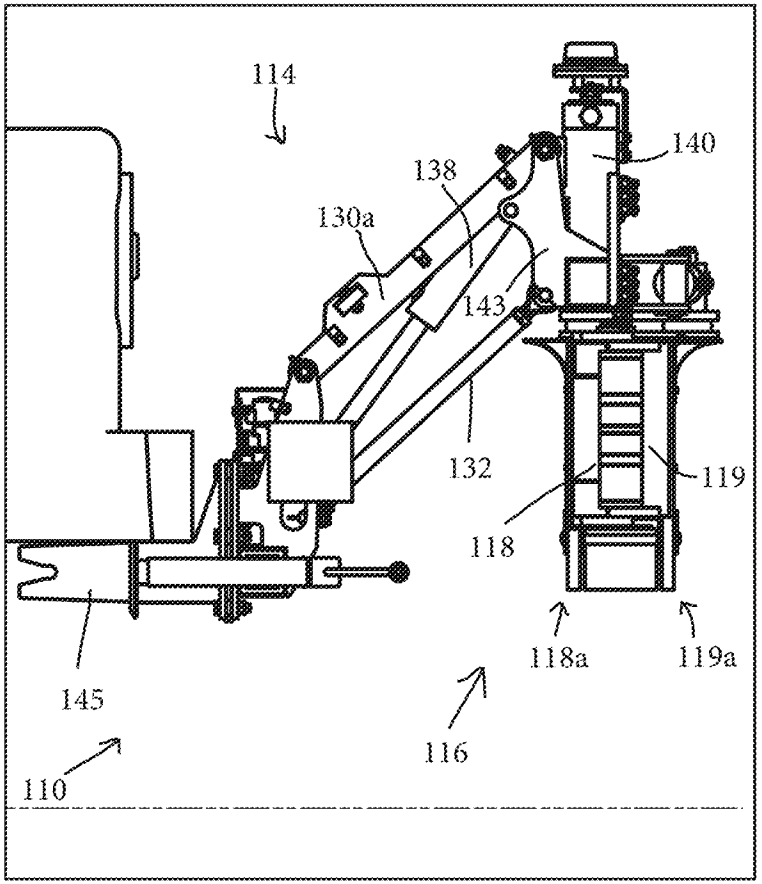
FIG. 13 is a side elevation view of the articulating snow plow apparatus of FIG. 5.
Figure 12:
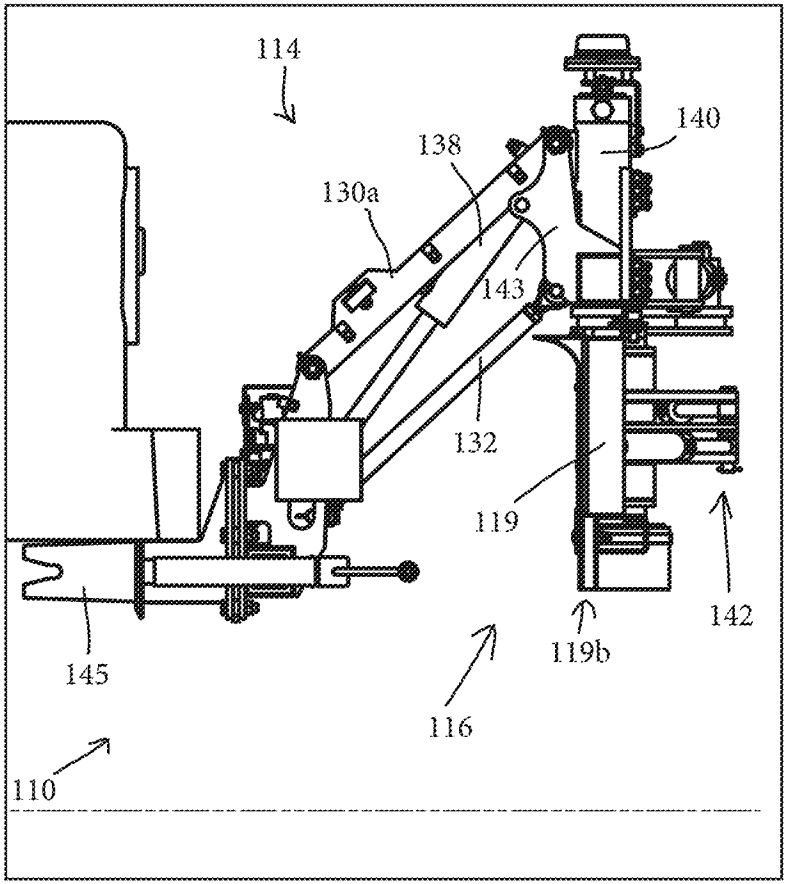
FIG. 12 is another side elevation view of the articulating snow plow apparatus of FIG. 11, depicted in the raised position.

The support frame 114 includes a four-bar linkage having a pair of upper bars 130*a*, 130*b* and a lower bar, in the form of an extendable link 132, all pivotably coupled at respective forward ends to a vehicle attachment frame 134 and the respective rearward ends of the bars 130*a*, 130*b*, and 132 all pivotably coupled to the rear frame 122 (FIGS. 1, 1A, and 11). A torsion bar 135 and a cross-brace 136 are disposed between the upper bars 130*a* and 130*b*, with the torsion bar 135 counteracting skewing or warping of the support frame 114 such as shown in FIG. 6. A lift actuator, in the form of a hydraulic lifting cylinder 138, is operably coupled between attachment frame 134 and rear frame 122 to raise and lower the four-bar linkage and rear frame 122 relative to the vehicle 112, with the four-bar linkage pivoting about a support frame lift axis 137 that is parallel to the lateral axis of the vehicle 112.

The extendable link 132 may be a gas spring or hydraulic shock, a spring, a telescoping shaft, or the like, to provide a "trip" function that allows the blade assembly 116 to trip or break away upon impact with heavy or immovable objects. This is accomplished by extension of the link 132 to permit the lower ends of the blades to pivot rearwardly so that he overall blade assembly is pivoting counterclockwise as viewed in FIG. 11. This pivoting of the blade assembly 116, by extension of the link 132, allows the blade assembly 116 to more easily ride up and over the obstruction in response to the rearwardly-directed force of the impact, and to thereby reduce or eliminate damage to the apparatus 210 or vehicle. If the extendable link 132 were provided as a hydraulic cylinder, it could include a relief valve or otherwise be hydraulically linked to fluid system in a manner such that upon an impact event at the blade assembly 116 would increase the hydraulic pressure in the link 132 from the impact at the blade assembly 116, and direct high pressure fluid to the lift actuator 138 to force the entire blade assembly 116 upwardly to further reduce or eliminate damage to the apparatus 210 or vehicle 112.

An upright stanchion or cylinder 140 is disposed at a center portion of the rear frame 122 and provides an attachment point for the rearward end of the actuator 138 (FIG. 1). The upright cylinder 140 rotatably supports an axle coupled to the center plate 118 so that the center plate 118 is pivotably coupled to the rear frame 122 about the twist axis 126. A blade assembly rotation or twist actuator, in the form of a hydraulic cylinder 139, is coupled between a portion of the rear frame 122 and a portion of the center blade 118 to rotate the center blade 118, and therefore the entire blade assembly 116, relative to the rear frame 122 about the twist axis 126 (FIG. 1). A position or angle sensor, such as contactless sensors 141, is provided to communicate the relative rotation position of at least the center blade 118 of the blade assembly 116 to an operator, such as when the operator is inside the passenger cabin of the vehicle 112.

The rear frame 122 includes pin brackets 143 disposed proximate the upper bars 130*a*, 130*b* and include a pin 147 disposed in respective openings in each of the brackets 143 (FIG. 1A). The pin is positioned such that the uppers bars 130*a*, 130*b* contact the pins when the apparatus is in the fully lifted position (FIGS. 5, 12 and 13) to reduce or eliminate movement of the blade assembly 116 and rear frame 122 when the apparatus 110 is stowed and the vehicle is moving.

The vehicle attachment frame 134 includes vehicle frame mounts or attachment brackets 145 configured to removably couple to a portion of the vehicle frame to secure the snow plow apparatus 110 to the vehicle 112 (FIG. 1). Optionally, the support frame 114 includes a vehicle hitch receiver mount configured to removably couple the snow plow apparatus 110 to the vehicle 112. The vehicle hitch receiver mount may be utilized individually or in cooperation with the vehicle frame mounts 145 to secure the snow plow apparatus 110 to the vehicle 112. A pair of hand operated jacks 155 are provided with the attachment frame 134 for selectively supporting the forward portion of the apparatus 110 against a ground surface when the apparatus 110 is detached or stored separate from the vehicle. Optionally, the jacks 155 may be powered, such as electrically or hydraulically, to automatically extend and retract the jacks, as opposed to manually hand operating them.

The blade assembly 116 includes an actuation mechanism 142 in the form of a pair of actuators, such as hydraulic cylinders 144, 146, and an articulating linkage assembly 148 disposed between each of the extendable wings 119, 120 and the center plate 118 (FIGS. 1-1A). Each linkage assembly 148 includes a plurality of linkage rods 148*a* that are rotatably coupled at one end around a shaft passing through a hinge 150 that is disposed between the wing 119 or 120 and center plate 118. Wing coupling gussets or hinge plates 151 are provided at upper and lower portions of the first end 119*a*, 120*a* of each of the wings 119, 120 and center blade coupling gussets or plates 153 are provided at upper and lower portions of each of the outboard ends of the center blade 118 (FIG. 1A). The gussets 151, 153 are fixed to the respective wings 119, 120 and ends of the center blade 118 and are pivotably coupled to the shaft of the hinge 150. The hinge shaft is disposed substantially co-axially with the wing sweep axis 128 and the linkage rods 148*a* are substantially freely rotatable about the wing sweep axis 128 relative to the wing 119 or 120 and center blade 118, as permitted by the hydraulic cylinders 144, 146. The linkage rods 148*a* may be freely rotatable around the hinge shaft such that the linkage rods 148*a* and hinge shaft may rotate independent of one another, or the linkage rods 148*a* may be fixed to the hinge shaft such that linkage rods 148*a* rotate in unison with the hinge shaft. The distal end 148*b* of the linkage rods 148*a* are interconnected by linkage shaft 149, a lower end of which is visible in FIGS. 1A, 19, and 19A. The first actuator 144 is operably coupled between the shaft at the distal end 148*b* of the linkage rods and a portion of the center plate 118. The second actuator 146 is operably coupled between the shaft 149 at the distal end 148*b* of the linkage rods and a portion of the extendable wing 119 or 120. As the actuators 144 and 146 extend, they push on the shaft 149 at the distal end 148*b* of the linkage assembly 148 which causes the extendable wing 119 or 120 to pivot about the wing sweep axis 128 in an opening direction (i.e. the right wing 120 moves away from the stowed position in a counterclockwise direction when viewed from above, and the left wing 119 moves away from the stowed position in a clockwise direction when viewed from above). As the actuators 144 and 146 retract, they pull on the shaft 149 at the distal end 148*b* of the linkage assembly 148 which causes the extendable wing 119 or 120 to pivot about the wing sweep axis 128 in a closing direction (i.e. the wings 119, 120 move toward the stowed position).

Surface-scraping wear or contact plates 152 are mounted along the bottom portion of each wing 119, 120 and the center blade 118. The wear plates 152 may optionally be mounted in such a manner that allows them to pivotably release or trip upon impact with heavy and immovable objects to protect the apparatus 110 from major damage. Torsion springs may be coupled between the respective blades and the contact plate 152 to automatically reset the contact plate 152 after an impact event or to absorb the impact and automatically return the plate 152 to the proper position relative to the respective blade.

Figure 1B:
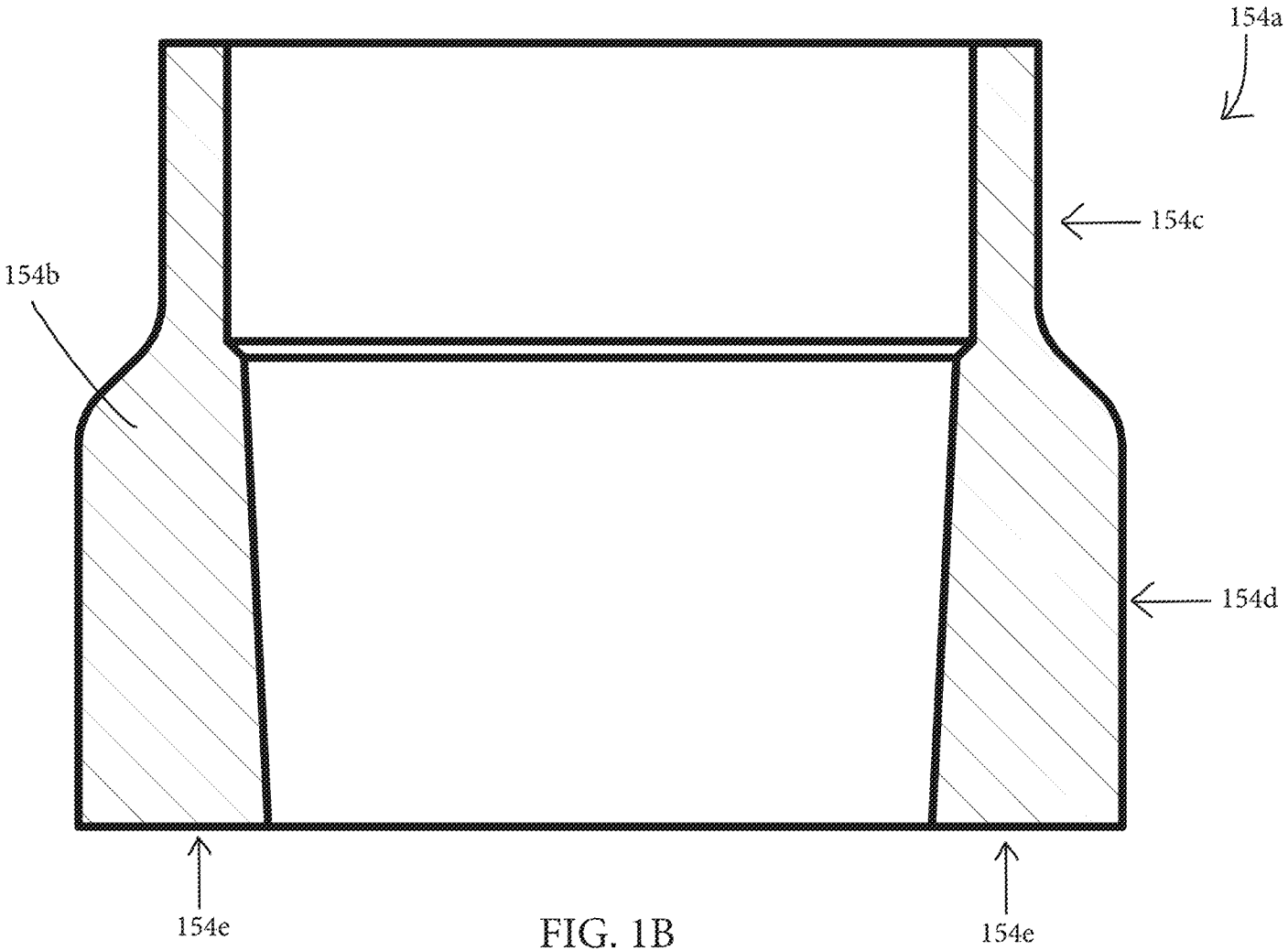
FIG. 1B is a sectional side view of an exemplary excluder for the articulating snow plow apparatus of FIG. 1.

The blade assembly 116 further includes a gap filling cylinder or excluder 154 disposed at a lower portion of the hinge 150 (FIGS. 1, 1A, and 1B). Preferably, excluder 154 includes a hollow cylindrical body (FIG. 1B). The excluder 154 substantially fills or covers a gap that is formed between the lower portion of the first end 119*a* or 120*a* of the respective wing and the lower portion of the outboard end of the center plate 118 to contact the ground surface simultaneously with the wear plates 152 of the blade assembly 116 when the blade assembly is in the lowered position. The gap formed between the lower portions of the wing 119 or 120 and the center plate 118 could otherwise allow snow or other debris to be left behind the apparatus. The excluder 154 fills the gap to ensure that little or no snow passes through the gap, and may provide another wear surface that slides along the surface being cleared of snow or debris, and can be replaced at the same time that wear plates 152 are replaced. The excluder 154 is shaped and dimensioned to deform, at least partially, upon impact with heavy or immovable objects and to subsequently, elastically return to its initial form or thereabouts. The excluder 154 is formed of a resilient material, such as rubber, polyethylene plastic, or polyurethane plastic, to resist wear caused by contact with the ground surface. For example, the excluder 154 may be formed of black urethane having a shore A hardness of 85-93. For another example, the excluder may be formed of ultra-high molecular weight plastic (UHMW).

An exemplary embodiment of an excluder 154*a* is illustrated in FIG. 1B. The excluder 154*a* includes a hollow cylindrical body 154*b* having differing thicknesses and diameters. The hollow cylindrical body 154*b* and differing dimensions of the excluder 154*a* permit the excluder to elastically flex or deform to absorb impact forces and therefore reduce damage to the excluder 154*a*, blade assembly 116, and vehicle 112. The excluder 154*a* is thinner at an upper region 154*c* compared to a thicker lower region 154*d*. The upper region 154*c* is dimensioned to be received in a mount or coupled around a mount, such as a mount at a lower portion of the hinge 150 of blade assembly 116. The thinner cross section of the upper region 154*c* may permit the excluder 154*a* to flex or deform relative to its mount in order to absorb impact forces. The lower region 154*d* increases in thickness as it extends away from the thinner upper region 154*c* toward its wearing surface 154*e*, which contacts and slides along the ground surface. The lower region 154*d* of excluder 154*a* is dimensioned to provide a long-lasting wear surface 154*e*, i.e. a larger wear surface provides increased wear-resistance.

While the center blade 118 and plate wings 119 and 120 are shown in FIGS. 1-6 as having only front snow/debris pushing surfaces or plates (i.e. the surface opposite actuation mechanism 142) mounted to front portions of rectangular frames and are particularly well suited for moving snow or debris with their respective snow pushing surfaces, it will be appreciated that the center blade 118 and wings 119 and 120 are also operable to move snow/debris in reverse with their respective opposite surface (i.e. the surface corresponding to actuation mechanism 142). Optionally, snow/debris pushing surfaces or plates may be provided on the reverse sides of center blade 118 and wings 119 and 120 to facilitate movement of snow/debris when the vehicle 112 and blade assembly 116 travel backward.

Referring to FIGS. 14-18, another articulating snow plow apparatus 210 is similar to apparatus 110 in many respects and includes much of the same structure and function, including: a blade assembly 116 that includes a center blade 118; a pair of extendable wings 119, 120; a pair of actuators 144, 146; a linkage assembly 148 associated with each extendable wing 119, 120; a hinge 150; a blade assembly rotation actuator 139; a rear frame 122 pivotable about a lateral tilt axis 124; and a hydraulic system similar to hydraulic system 111 of apparatus 110. The blade assembly 116 of apparatus 210 is pivotable about an assembly rotation twist axis 126, and the wings 119, 120 are pivotable about a respective wing sweep axis 128. Significant differences between apparatus 210 and apparatus 110 are discussed further below.

Apparatus 210 has a support frame 212 that includes a four-bar linkage as shown in FIGS. 14-18 that is generally similar to that of apparatus 110, however the upper and lower linkage bar positions are reversed. As best shown in FIGS. 14-15, the four-bar linkage of apparatus 210 includes two lower bars 212*a*, 212*b*, an upper tilting cylinder 214 which is extendable and retractable, a torsion bar 216, and a pair of cross-bracing chains 218 held in tension and disposed between the two lower bars 212*a*, 212*b* (as opposed to the single rigid cross-brace 136 of apparatus 110). The rear frame 122 is directly pivotably coupled to the rearward ends of the lower bars 212*a*, 212*b*, and it will be appreciated that apparatus 210 does not include pin brackets 143 as provided with apparatus 110 described earlier. An apparatus raising and lowering or lift actuator, in the form of a hydraulic cylinder 220, is provided to raise and lower the four-bar linkage and rear frame 122 relative to the vehicle 112. The actuator 220 is operably coupled between a forward upright frame or stanchion 222 that is fixed to a center portion of the attachment frame 134, and a rear upright frame or stanchion 225 that is fixed to a center portion of rear frame 122. The four-bar linkage is pivotable about a support frame lift axis 137 that is generally parallel to the lateral axis of the vehicle 112. The support frame 212 is pivotable (by way of the apparatus raising and lowering actuator 220) relative to attachment frame 134 about the support frame lift axis 137. The upper bar hydraulic cylinder 214 is provided for tilting the blade assembly 116 relative to the lateral tilt axis 124, as best shown in FIG. 14. In the tilted position, the lower portion of the blade assembly 116 is rearward of its corresponding position in the normal upright orientation. This allows the lower end of the blade assembly 116 to reach further rearwardly in response to retraction of the upper hydraulic cylinder 214, thus allowing an operator to clear snow or debris in closer proximity to walls, garage doors, or other upright objects, without increasing the risk of impacting the upright objects with the full force of the vehicle's movement.

The hydraulic cylinder 214 and/or actuator 220 may also provide a "trip" function to allow the blade assembly 116 to trip or break away upon impact with heavy or immovable objects to reduce or eliminate damage to the apparatus 210 or vehicle 112. The hydraulic cylinder 214 may include a relief valve or otherwise be hydraulically linked to the actuator 220 in a manner such that upon an impact event at the blade assembly 116, the hydraulic pressure increase in the hydraulic cylinder 214 from the impact at the blade assembly 116 directs high pressure fluid to the actuator 220 to force the entire blade assembly 116 upwardly to further reduce or eliminate damage to the apparatus 210 or vehicle 112. Optionally, the positions of the raising and lowering actuator 220 and the tilting cylinder 214 may be reversed, with the tilting cylinder 214 positioned below the lowering actuator 220, similar to the arrangement of the extendable link 132 and lifting cylinder 138, described above.

The wings 119, 120 and center plate 118 of the illustrated embodiment of FIGS. 14-15 are shown as having fixed flat profiles or moldboard shapes on their respective snow/debris pushing surface. However, it will be appreciated that different profiles or moldboard shapes may be used, such as mostly flat moldboards with a curved/contoured upper portion as illustrated in FIGS. 1-5, 11-13, and 30-44 or moldboards with curved/contoured upper and lower portions as illustrated in FIGS. 20-26, for example.

Figure 19:
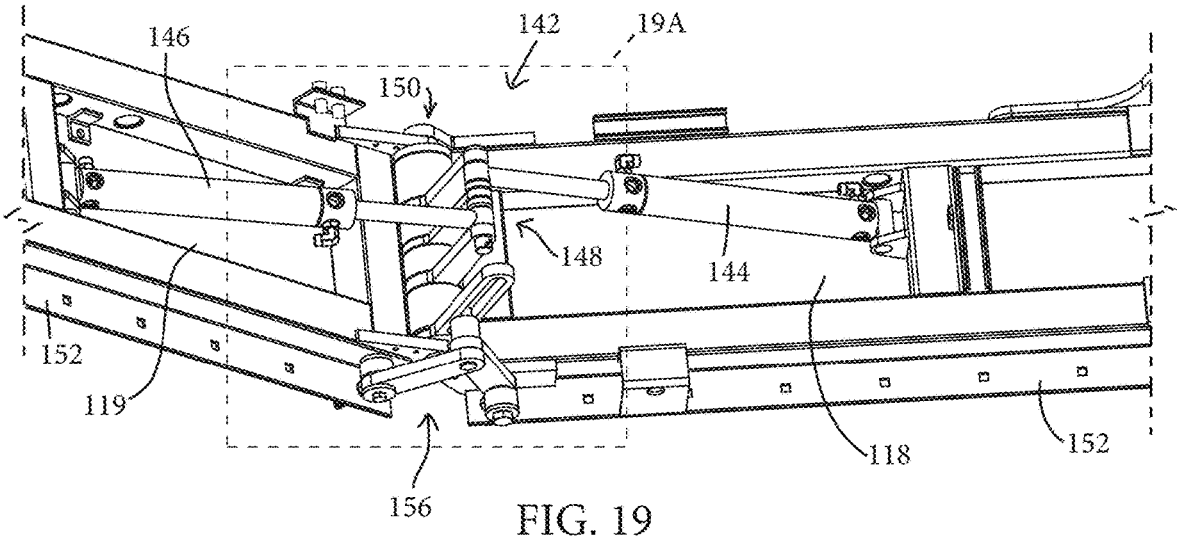
FIG. 19 is a bottom rear-side perspective view of a mechanical actuator synchronizing mechanism for a vehicle mounted articulating snow plow apparatus, in accordance with the present invention.
Figure 19A:
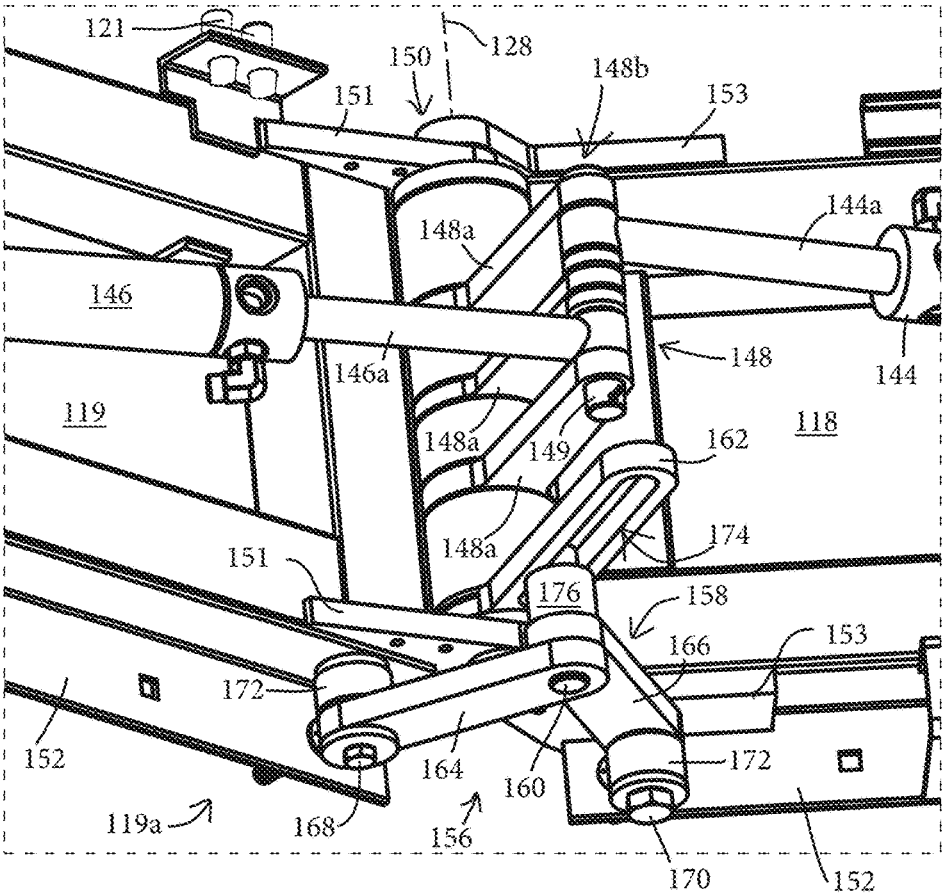
FIG. 19A is an enlarged view of the region designated 19A in FIG. 19.

Referring to the illustrative embodiments of FIGS. 19 and 19A, a wing actuator synchronizing mechanism or synchronizer 156 is provided to synchronize the actuation of the hydraulic cylinders 144, 146 of the actuation mechanism 142. The synchronizer 156 is mechanically driven by the movement of the wing 119 or 120 relative to the center blade 118. The synchronizer 156 may be provided with either of apparatus 110 (FIGS. 1-13), apparatus 210 (FIGS. 14-18), or apparatus 510 described in detail below (FIGS. 30-44), to synchronize the actuation mechanisms 142 of the blade assembly 116 or the actuation mechanisms 542 of the blade assembly 516. The synchronizer 156 mechanically coordinates hydraulic cylinder 144 and hydraulic cylinder 146 such that the piston rods 144*a* and 146*a* are always extended uniformly which substantially equalizes the loads on the cylinders 144, 146 throughout their stroke lengths. Equalized loads between the cylinders 144, 146 yields favorable loading characteristics for retaining the plow wing 119 or 120 in the desired position while under a workload (e.g. while pushing or pulling snow). The synchronizer 156 includes a linkage assembly 158 having two linkage arms, a tracking pin 160 at a central joint of the linkage assembly 158, and a pin guide bracket 162 (FIG. 19A).

The linkage assembly 158 includes a plow wing linkage arm 164 and a center blade linkage arm 166 (FIG. 19A). The distal ends of the wing linkage arm 164 and the blade linkage arm 166 are pivotably coupled together at the tracking pin 160. The tracking pin 160 has an axis that is generally parallel to the respective wing sweep axis 128. The proximal end of the wing linkage arm 164 is pivotably coupled or jointed to the wing 119 or 120 at a wing linkage pin 168. The proximal end of the blade linkage arm 166 is pivotably coupled or jointed to the center blade 118 at a blade linkage pin 170. Spacers 172 are provided to offset the linkage arms 164, 166 from the respective wing 119, 120 or blade 118 to properly align the linkage arms with one another. The linkage assembly 158, wing 119 or 120, and center blade 118 coordinate to define the path traveled by the tracking pin 160 relative to the hinge 150, in a linear manner.

The pin guide bracket 162 defines a pin guide channel or slot 174 that is provided for guiding the tracking pin 160 extending above a spacer 176 (FIG. 19A) as the plow wing 119 or 120 is moved relative to the center blade 118. The guide bracket 162 is fixed to the shaft of hinge 150 and is rotatable along with the hinge shaft relative to the wing 119 or 120 and center blade 118. When utilizing the synchronizer 156 with either apparatus 110 or 210, the linkage rods 148*a* are also fixed to the shaft of hinge 150 such that the linkage rods 148*a* and guide bracket 162 are connected together via the linkage shaft 149 and rotate in unison with one another (and the shaft 149) about the wing sweep axis 128. The guide bracket 162 extends perpendicularly from the hinge 150 and substantially parallel to the linkage rods 148*a*. The guide channel 174 is aligned substantially parallel to a line extending between the linkage shaft 149 and the hinge 150 such that the linkage shaft 149 is generally aligned with the guide channel 174.

The tracking pin 160 extends into the guide channel 174 and as the wing 119 or 120 pivots relative to the center blade 118 the tracking pin 160 tracks (moves) within the guide channel 174. The lengths of the linkage arms 164, 166 are chosen as a function of their relative positions on the wing 119 or 120 and center blade 118 such that the respective angles between the guide channel 174 and each of the wings 119, 120 and center blade 118 are approximately equal to one another, regardless of the position of the respective wing 119 or 120 relative to the center blade 118. As such, the respective angles between the linkage shaft 149 (and the respective ends of the piston rods 144*a*, 146*a*) and the corresponding wing 119 or 120 and center blade 118 remain approximately equal to one another as the wing 119 or 120 extends and retracts. Thus, the piston rods 144*a* and 146*a* are maintained at generally equivalent extension lengths regardless of the position of the wing 119 or 120 relative to the center blade 118. The installation of the synchronizer 156 allows the hydraulic cylinders 144 and 146 to be hydraulically connected to one another in parallel without risk of one cylinder 144 or 146 extending or retracting by a significantly different amount than the other.

Alternative to the wing actuator synchronizer 156, the plow blade assembly 116 may include a wing actuator synchronizer that includes a hydraulic flow divider/combiner 157 (see FIGS. 47, 47B, 47E, 48, 48B, and 48E for exemplary hydraulic control schematics) to coordinate and synchronize the hydraulic cylinders 144 and 146 such that the strokes of the cylinders 144 and 146 remain substantially equal regardless of the position of the wing 119 or 120 relative to the center blade 118. Alternatively or in addition to the synchronizer 156 and/or flow divider/combiner 157 described above, the blade assembly 116 may include a wing actuator synchronizer that includes an electronic controller, electronic position sensors, and proportional hydraulic valves in communication with the cylinders 144 and 146 to operate the cylinders in a master/slave configuration wherein the slave cylinder stroke matches the master cylinder stroke.

Figure 20:
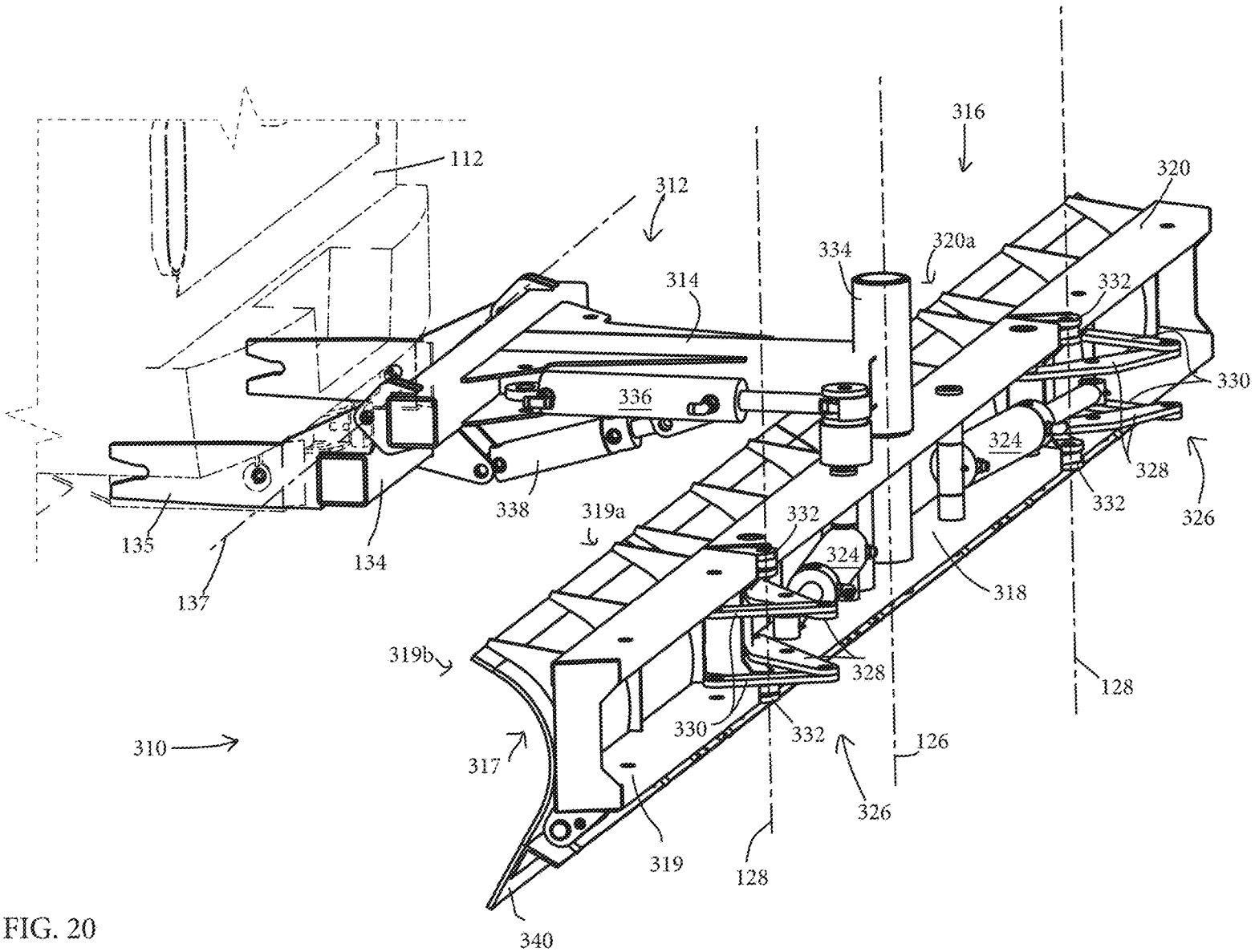
FIG. 20 is a rear-side perspective view of another vehicle mounted articulating snow plow apparatus in accordance with the present invention, depicted in a lowered position with an extendable plow blade assembly in a linear extended configuration, and the entirety of the plow blade assembly positioned in a neutral position relative to the forward travel direction of the vehicle.
Figure 21:
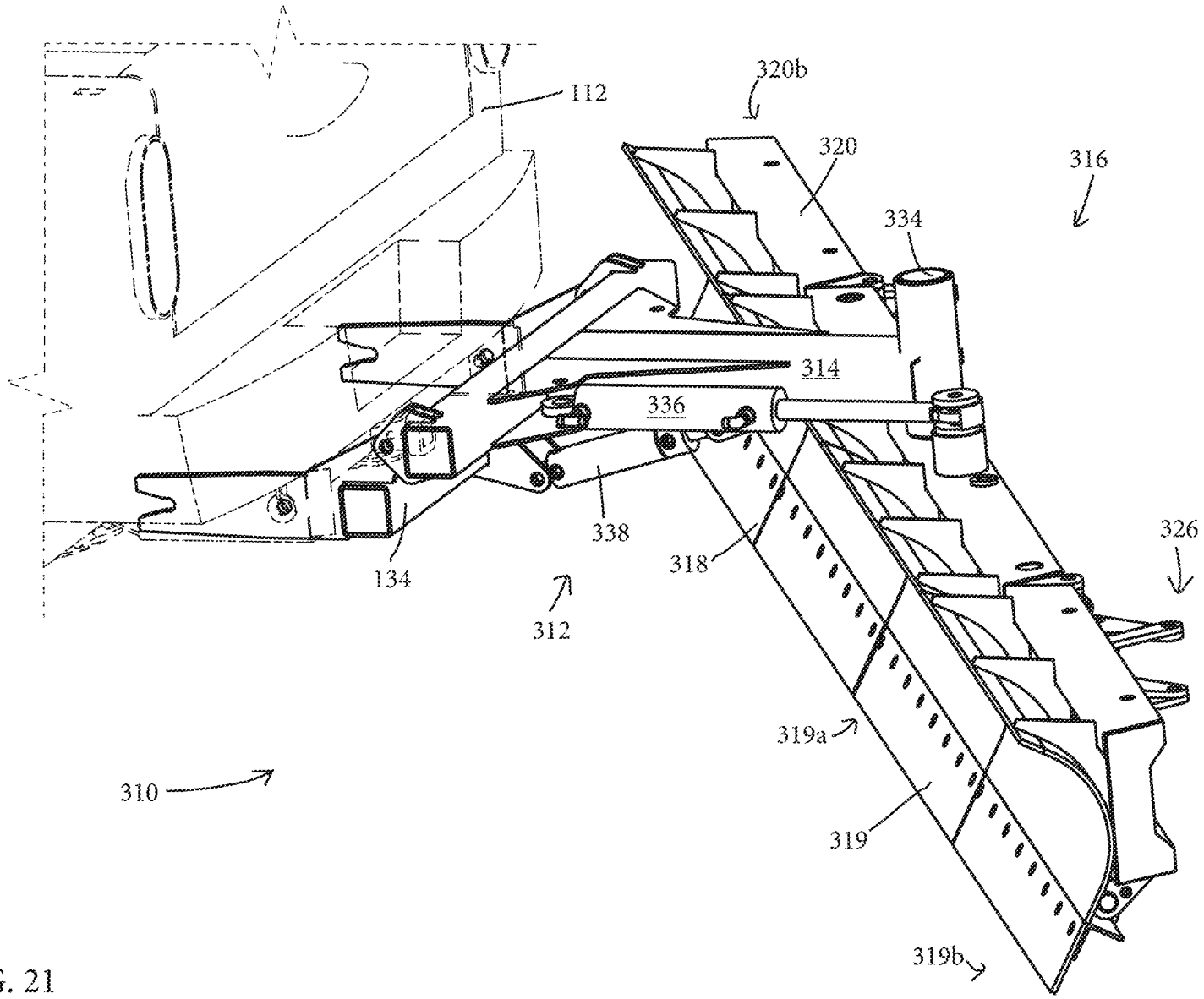
FIG. 21 is another rear-side perspective view of the articulating snow plow apparatus of FIG. 20, depicted in the lowered position with the plow blade assembly in the linear extended configuration and twisted at an oblique angle.

Referring to FIGS. 20-26, another articulating snow plow apparatus 310 is similar to apparatus 110 in many respects and includes many similar structures to perform substantially similar functions. Instead of a four-bar linkage, however, apparatus 310 includes a support frame 312 that includes a rigid pivoting frame 314 that supports an articulating plow blade assembly 316 at a rearward end of the frame 314 (FIG. 20). The rigid frame 314 is pivotably coupled to a vehicle attachment frame 134 and is pivotable relative to frame 134 about a support frame lift axis 137 that is parallel to the lateral axis of the vehicle 112. Snow plow apparatus 310 includes a center blade 318 and extendable plow wings 319, 320 that function substantially the same as center blade 118 and wings 119, 120 of apparatus 110, but are provided with a curved/contoured profile or moldboard 317 on the snow pushing surfaces. While the wings 319, 320 and center plate 318 of the illustrated embodiment of FIGS. 20-26 are shown as having fixed curved/contoured profiles or moldboard shapes 317 on the upper and lower portion of the snow/debris pushing surface, it will be appreciated that different profiles or moldboard shapes may be used, such as mostly flat moldboards with a curved/contoured upper portion as illustrated in FIGS. 1-5 and 11-13 or flat moldboards as illustrated in FIGS. 14-15, for example. Optionally, a deformable moldboard or snow deflecting apparatus may be provided at an upper portion and/or lower portion of the wings 319, 320, and center blade 318, such as a deformable moldboard 610 as described in more detail below.

Another difference between apparatus 310 and apparatus 110 is that instead of the dual-actuator arrangement (i.e. dual-actuators 144 and 146 of apparatus 110) of the actuation mechanism 142, apparatus 310 includes an actuation mechanism that includes a single actuator, in the form of a dual-acting hydraulic cylinder 324, and a linkage assembly 326 (FIG. 20). The linkage assembly 326 includes a first linkage 328 coupled to an outboard end of the center blade 318 and a second linkage 330 coupled to a first end 319*a* or 320*a* of the respective wing. Unlike linkage assembly 148 of apparatus 110, the linkage assembly 326 is not coupled to a hinge 332 or associated with a hinge shaft disposed between the center blade 318 and the wing 319 or 320. The actuator 324 and linkage assembly 326 cooperate to pivot the respective wing 319 or 320 relative to the center blade 318 about the wing sweep axis 128. It will be appreciated, however, that a dual-actuator mechanism, such as actuation mechanism 142 of apparatus 110, may be utilized with apparatus 310.

An upright cylinder 334 is disposed at the rearward portion of the rigid frame 314 and provides a support for an axle coupled to the center plate 318, to pivotably couple the center plate 318 to the frame 314 (FIG. 20). A blade assembly rotation or twist actuator, in the form of a hydraulic cylinder 336, is coupled between a portion of the frame 314 and a portion of the center blade 318 to rotate the center blade 318, and therefore the entire blade assembly 316, relative to the frame 314 about twist axis 126 (FIG. 20). Optionally, a position or angle sensor, such as a contactless sensor, may be provided to communicate the relative rotation position of at least the center blade 318 of the blade assembly 316 to an operator, such as when the operator is inside the passenger cabin of the vehicle 112. An actuator in the form of a hydraulic cylinder 338 is operably coupled between attachment frame 134 and the rigid frame 314 to raise and lower (i.e. pivot) the frame 314 relative to the vehicle 112 about the lift axis 137. The apparatus 310 includes surface-engaging wear blades or contact plates 340 along the bottom portion of each wing 319, 320 and the center blade 318, which plates 340 function substantially the same as contact plates 152 of apparatus 110.

Figure 27:
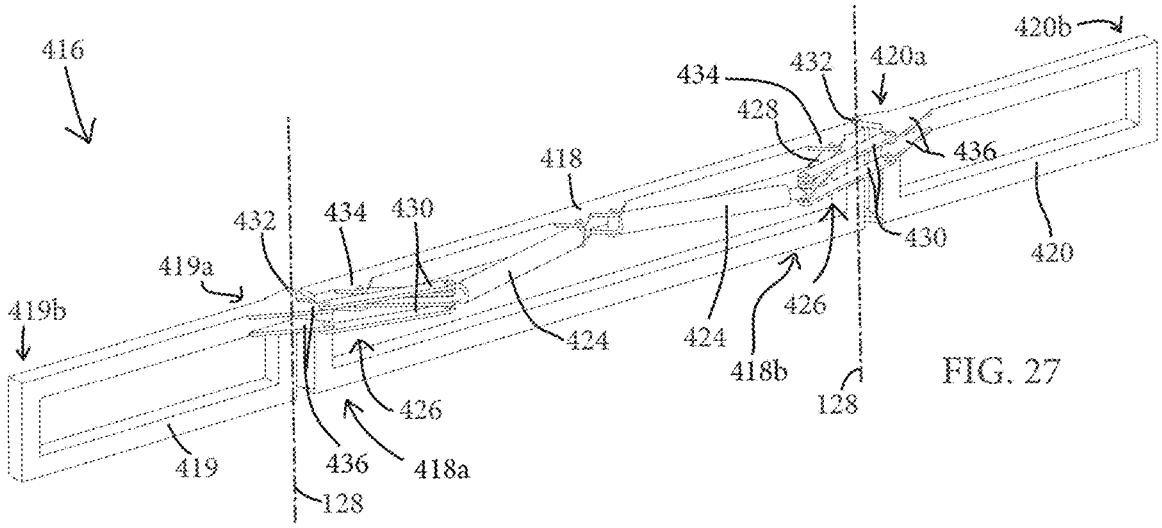
FIG. 27 is a rear-side perspective view of an articulating snow plow blade assembly in accordance with the present invention, depicted in a linear extended configuration.
Figure 28:
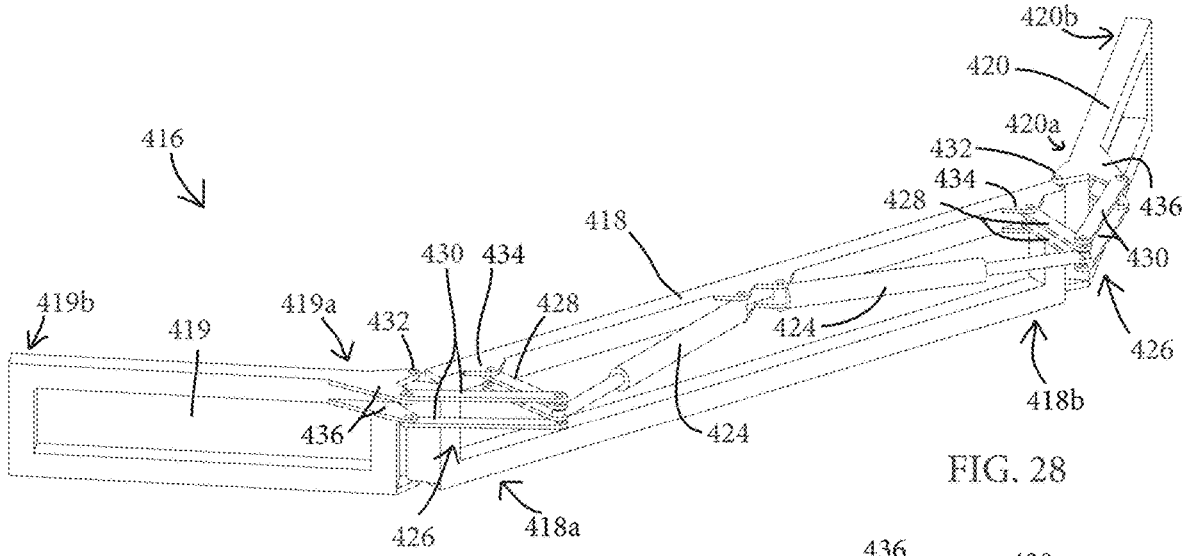
FIG. 28 is another rear-side perspective view of the blade assembly of FIG. 27, depicted with extendable plow wings in a forward-swept position relative to the center blade portion.
Figure 29:
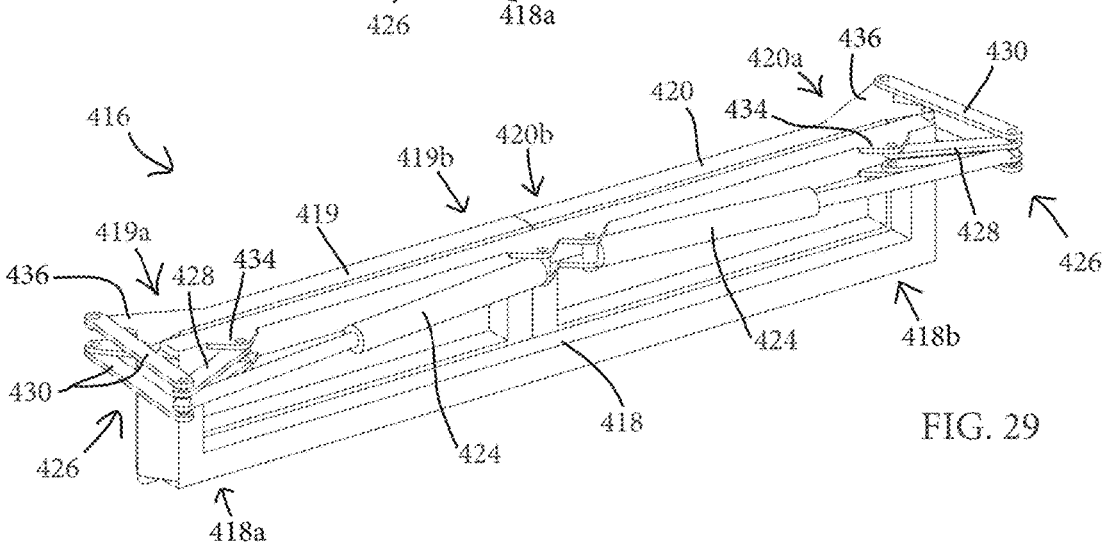
FIG. 29 is another rear-side perspective view of the blade assembly of FIG. 27, depicted in a closed or stowed configuration.

Referring now to the illustrative embodiment of FIGS. 27-29, an articulating snow plow blade assembly 416 is similar to blade assembly 316 in many respects and includes many similar structures to perform substantially similar functions. Blade assembly 416 includes a center blade 418 and extendable plow wings 419, 420 coupled to respective outboard ends of the center blade 418 at respective hinges 432. The center blade 418 and wings 419, 420 function in similar fashion as center blade 318 and wings 319, 320 of apparatus 310, but are provided with a flat-profiled front panel or moldboard for the snow pushing surfaces. The blade assembly 416 includes an actuation mechanism for actuating each wing 419, 420, the actuation mechanism including a single actuator, in the form of a dual-acting hydraulic cylinder 424, and a linkage assembly 426 having a first linkage 428 and a second linkage 430. The hydraulic cylinder 424 and linkage assembly 426 function similar to hydraulic cylinder 324 and linkage assembly 326 of apparatus 310.

The first linkage 428 is coupled to a center blade stanchion 434 at an outboard end of the center blade, 418 and the second linkage 430 is coupled to a plow wing stanchion 436 at a first end 319*a* or 320*a* of the respective wing. The dimensions and positions of first linkage 428, second linkage 430, center blade stanchion 434, and wing stanchion 436 allow the second linkage 430 to extend forward of the center blade 418 and wrap around the hinge 432 and outboard end of the center blade 418 to move the respective wing 419, 420 to the stowed configuration (FIG. 29). It is contemplated that blade assembly 416 will be coupled about a rear portion of the center blade 418 to the front end of vehicle, such as a truck, a tractor, a skid steer, or the like, such that a support frame between the vehicle and the blade assembly 416 does not interfere with the articulation of the plow wings 419, 420. The blade assembly 416 is particularly well suited for pushing snow or debris in front of a vehicle, as opposed to blade assembly 316 which is particularly well suited for pulling snow or debris behind a vehicle.

Figure 22:
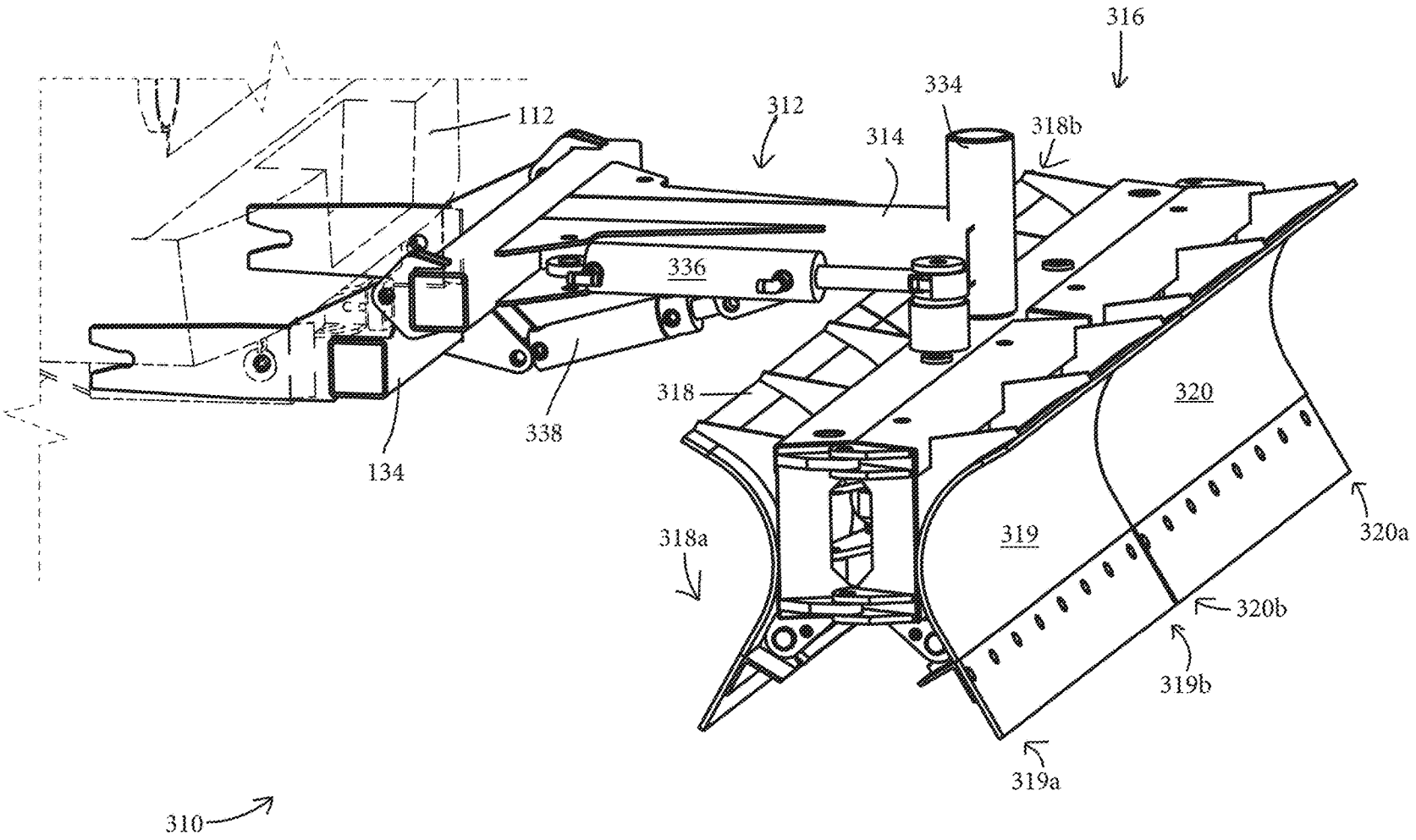
FIG. 22 is another rear-side perspective view of the articulating snow plow apparatus of FIG. 20, depicted in the lowered position with the plow blade assembly in a closed or stowed configuration, and the entirety of the plow blade assembly in the neutral position.
Figure 23:
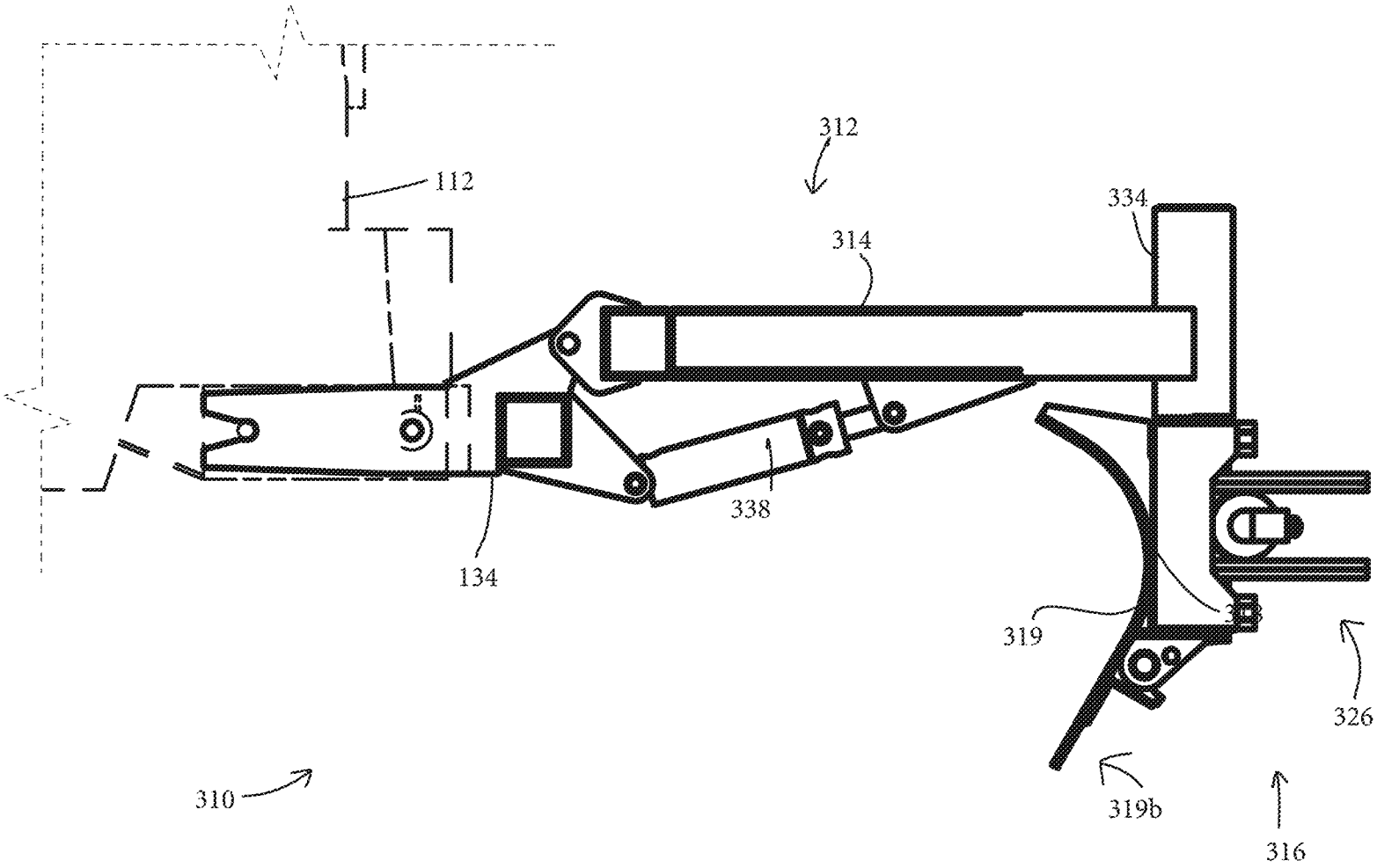
FIG. 23 is a left side elevation view of the articulating snow plow apparatus of FIG. 20.
Figure 24:
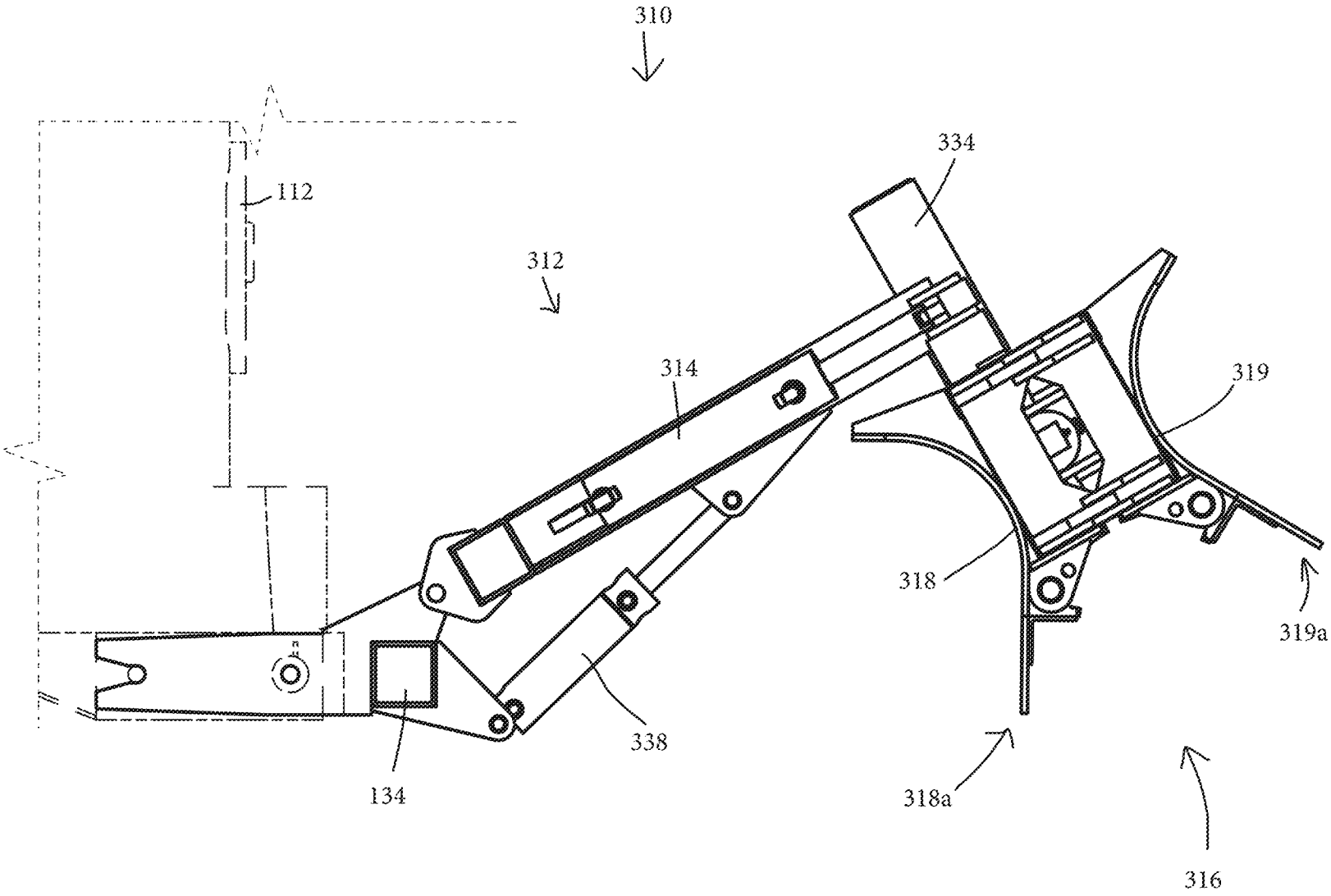
FIG. 24 is a left side elevation view of the articulating snow plow apparatus of FIG. 22, depicted in a lifted position.
Figure 25:
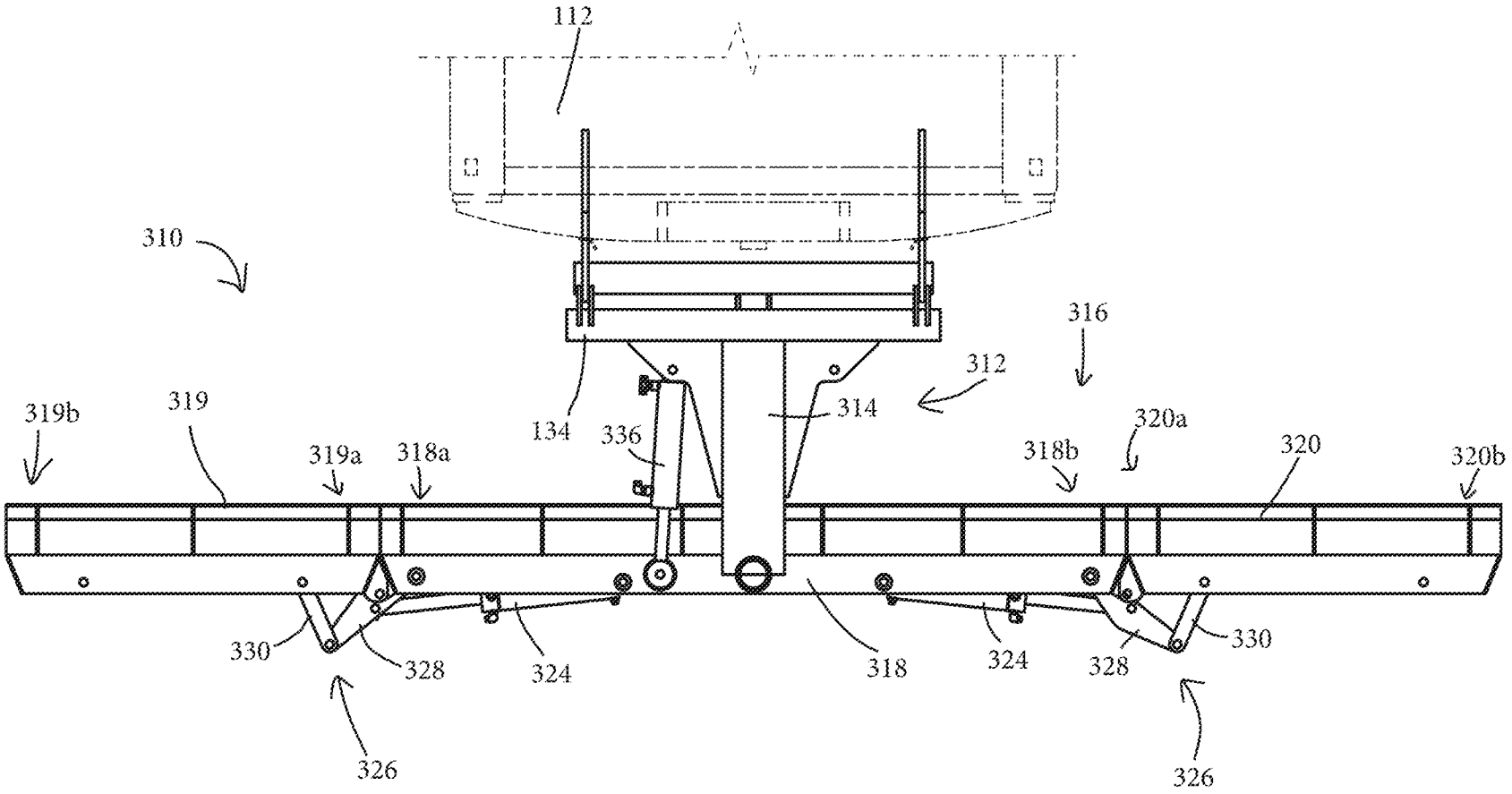
FIG. 25 is a top plan view of the articulating snow plow apparatus of FIG. 20.
Figure 26:
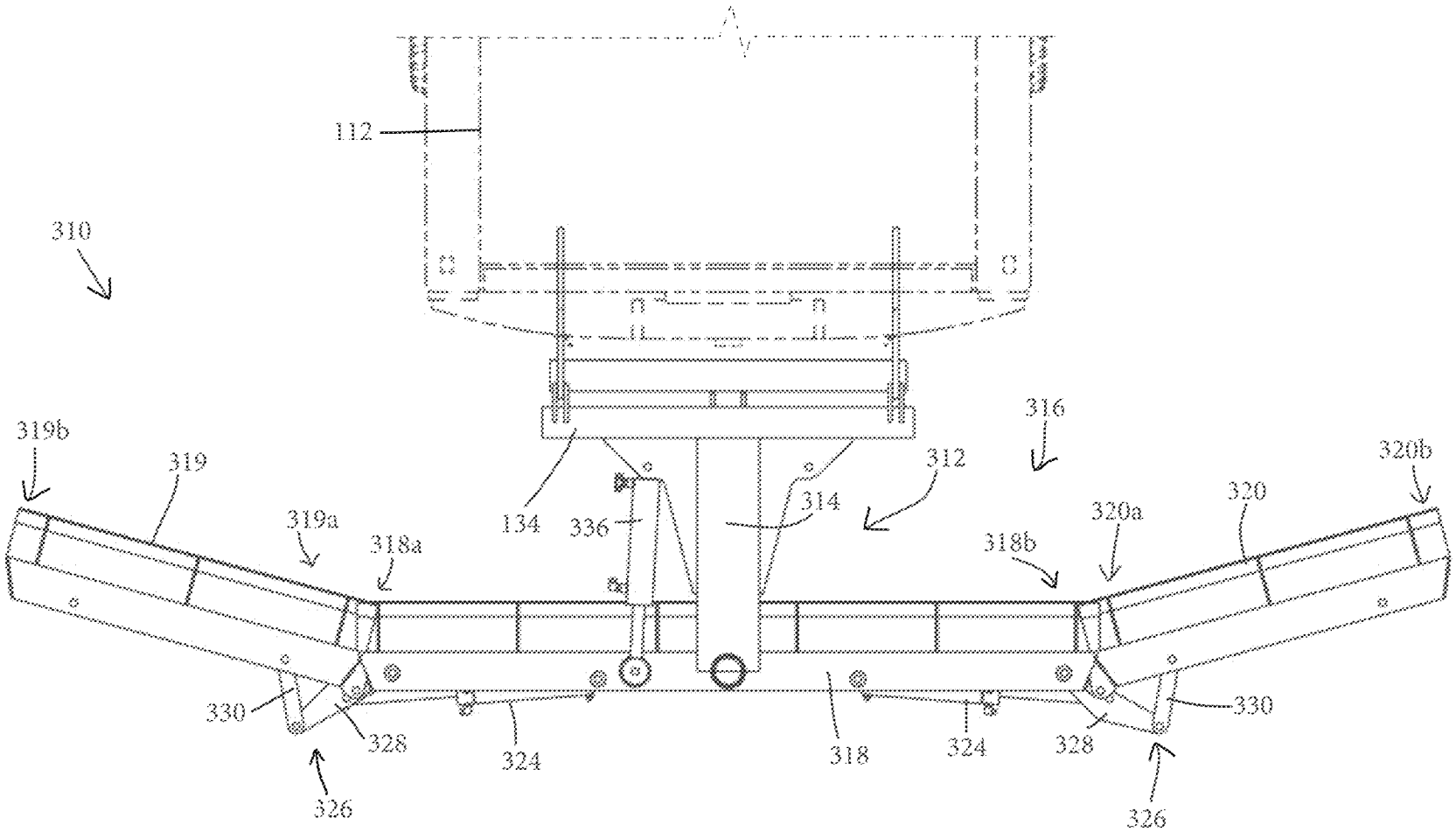
FIG. 26 is another top plan view of the articulating snow plow apparatus of FIG. 20, depicted with the center blade in the neutral position and the extendable plow wings in a slightly forward-swept position.

One difference between blade assembly 416 and blade assembly 316 is that the wings 419, 420 of blade assembly 416 are in a stowed configuration when the hydraulic cylinders 424 are fully extended (FIG. 29), as opposed to the blade assembly 316 in which the wings 319, 320 are in the stowed configuration when the hydraulic cylinders 324 are fully retracted (FIG. 22). As such, the snow pushing surface of the center blade 418 faces the snow-pushing surfaces of the wings 419, 420 when the assembly 416 is in the stowed configuration (FIG. 29), as opposed to that of blade assembly 316, in which the snow pushing surfaces face away from one another when the assembly 316 is in the stowed configuration (FIG. 22). The flat-profiled front panel or moldboard of the assembly 416 allows it to assume a particularly compact or small footprint when the wings are retracted as shown in FIG. 29. Wings 419, 420 are shown in FIGS. 27 and 28 as having only front snow pushing surfaces or plates mounted to rectangular frames. It will be appreciated that rear snow pushing surfaces or plates may be added to the backsides of the wings' rectangular frames. This modification would better suit the wings 419, 420 for clearing snow and debris in a reverse direction, and would facilitate using the backsides of wings 419, 420 (which face forwardly in the compact stowed configuration of FIG. 29) to plow in the forward direction with the blade assembly 416 in the compact stowed configuration of FIG. 29.

Referring to FIGS. 30-44, another articulating snow plow apparatus 510 is provided for use with a vehicle, such as a skid steer vehicle 512, and is similar to apparatuses 110 and 210 in many respects and includes much of the same structure and function, including a blade assembly 516 similar to blade assembly 116 and a hydraulic system 511. Like components of apparatus 510 relative to apparatuses 110 and 210 are designated by like reference numerals throughout the various figures, with prefixes of 100/200 changed to 500, accordingly. The blade assembly 516 includes a center blade 518 similar to center blade 118; a pair of extendable wings 519, 520 similar to wings 119, 120; an actuation mechanism 542 in the form of a pair of actuators 544, 546 and a linkage assembly 548 (similar to actuation mechanism 142, actuators 144, 146, and linkage assembly 148) associated with each extendable wing 519, 520; a hinge 550 similar to hinge 150; and excluders 554 similar to excluders 154. The blade assembly 516 is twistable about an assembly rotation or twist axis 526 (FIGS. 39 and 40) which is similar to assembly rotation twist axis 126; and the wings 519, 520 are pivotable or sweepable about a respective wing sweep axis 528 similar to the wing sweep axes 128. Various forward-swept and rearward-swept positions of wings 519 and 520 are illustrated in FIGS. 30 and 31-40.

Figure 30:
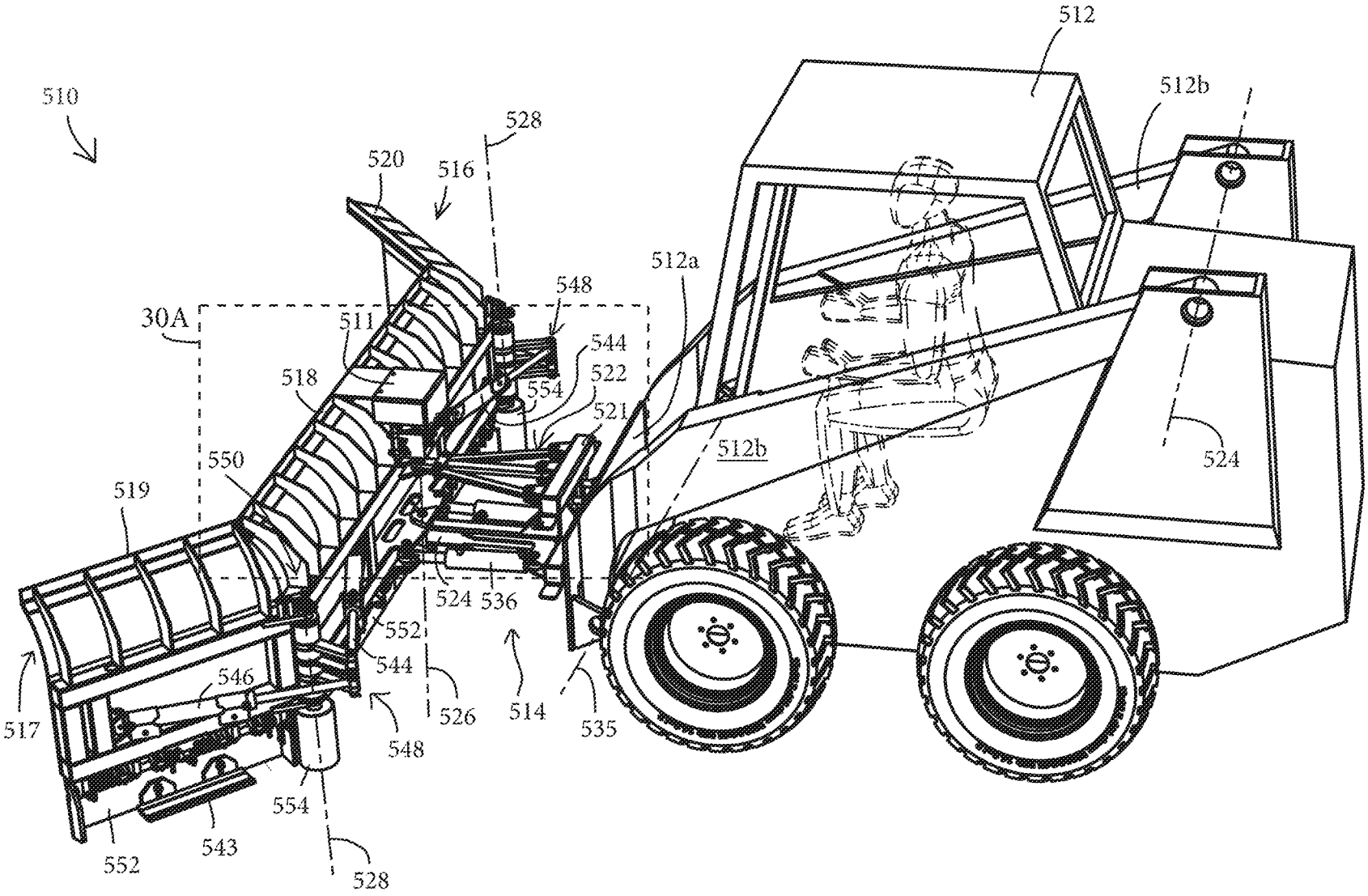
FIG. 30 is a rear-side perspective view of a vehicle mounted articulating snow plow blade assembly in accordance with the present invention, depicted in a lowered position with a center blade in a neutral position and extendable plow wings in a slightly forward-swept position relative to the center blade, the entirety of the plow blade assembly positioned in a neutral position relative to the forward travel direction of the vehicle.

Significant differences between apparatus 510 and apparatuses 110, 210, 310, and 410 are discussed further below. In the illustrated embodiment of FIGS. 30-40, the skid steer vehicle 512 includes an attachment block 512*a* that is coupled to the distal end of each lift arm 512*b* of the vehicle 512. The attachment block 512*a* provides an interface for attaching various commonly known and available attachments or implements to the vehicle 512. The apparatus 510 is coupled to the vehicle 512 at the attachment block 512*a*. Accordingly, apparatus 510 can be raised and lowered relative to vehicle 512 by lifting or lowering lift arms 512*b* of the vehicle via rotation about a lateral lift arm axis 537 (FIG. 30). The apparatus 510 may also be tilted relative to the vehicle 512 by tilting the attachment block 512*a* relative to the lift arms 512*b* about a lateral tilt axis 535 (FIG. 30).

Figure 36:
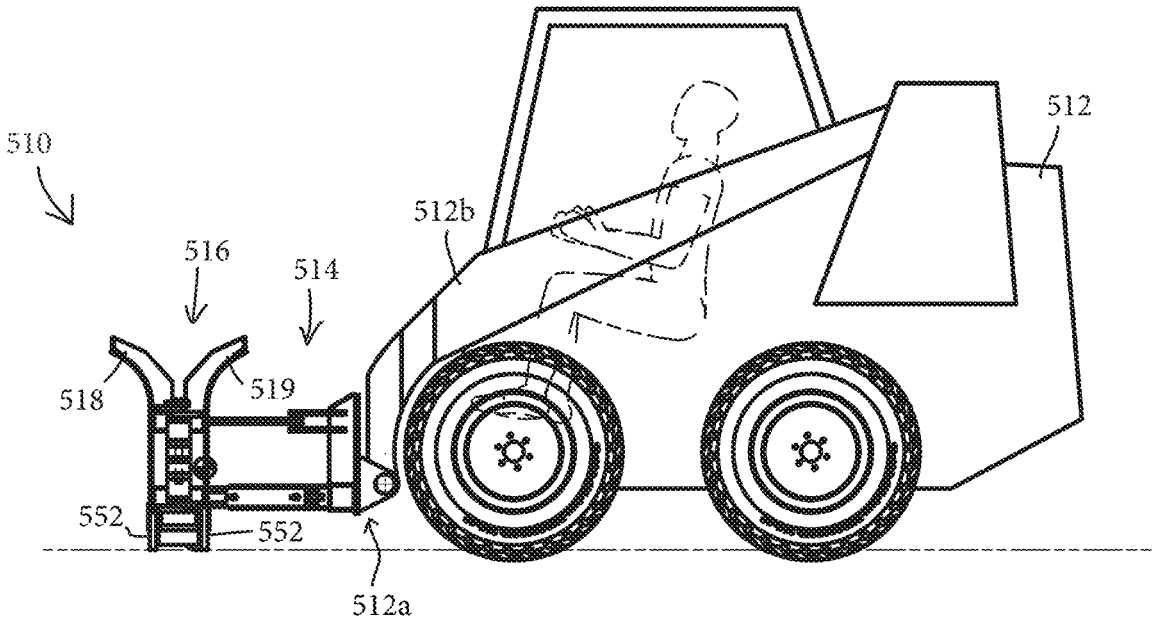
FIG. 36 is a side elevation view of the articulating snow plow apparatus of FIG. 35.
Figure 37:
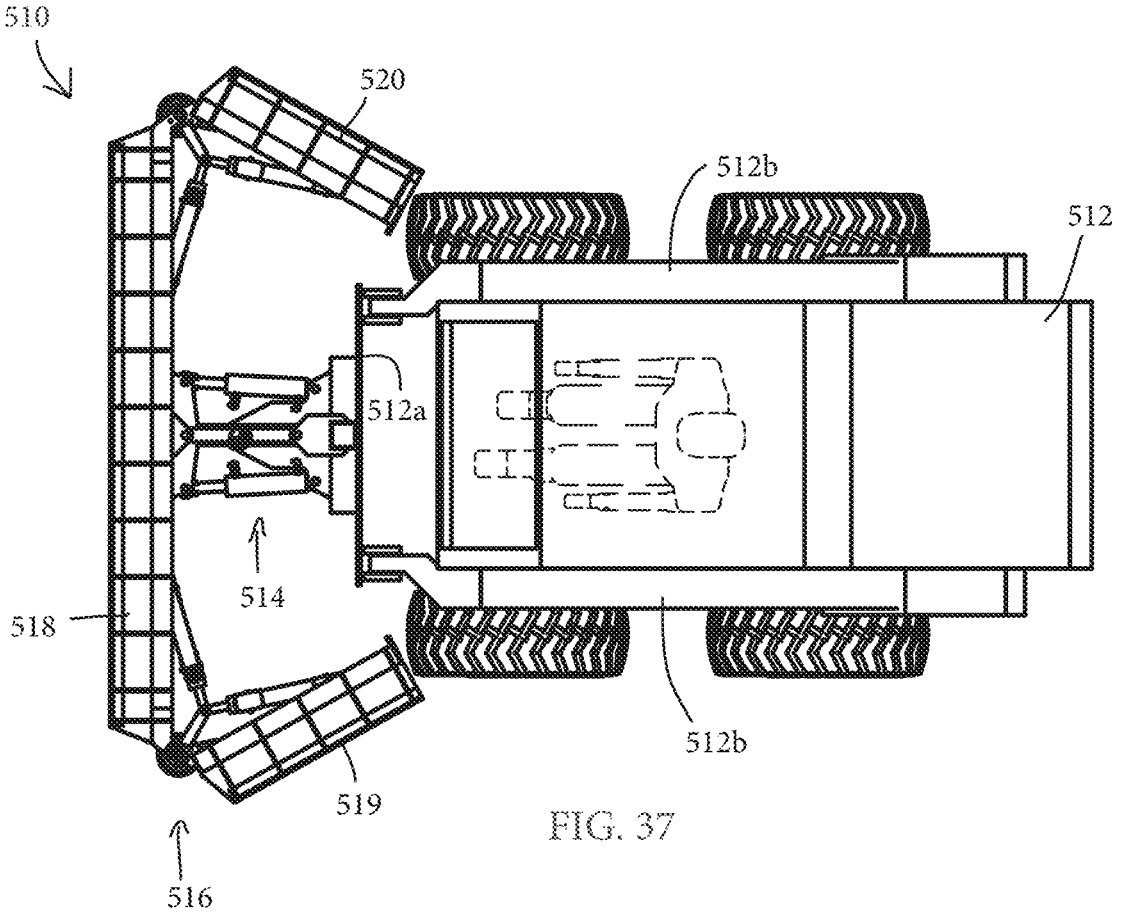
FIG. 37 is a top plan view of the articulating snow plow apparatus of FIG. 30, depicted with the extendable plow wings in a rearward-swept position relative to the center blade and center blade in the neutral position.
Figure 38:
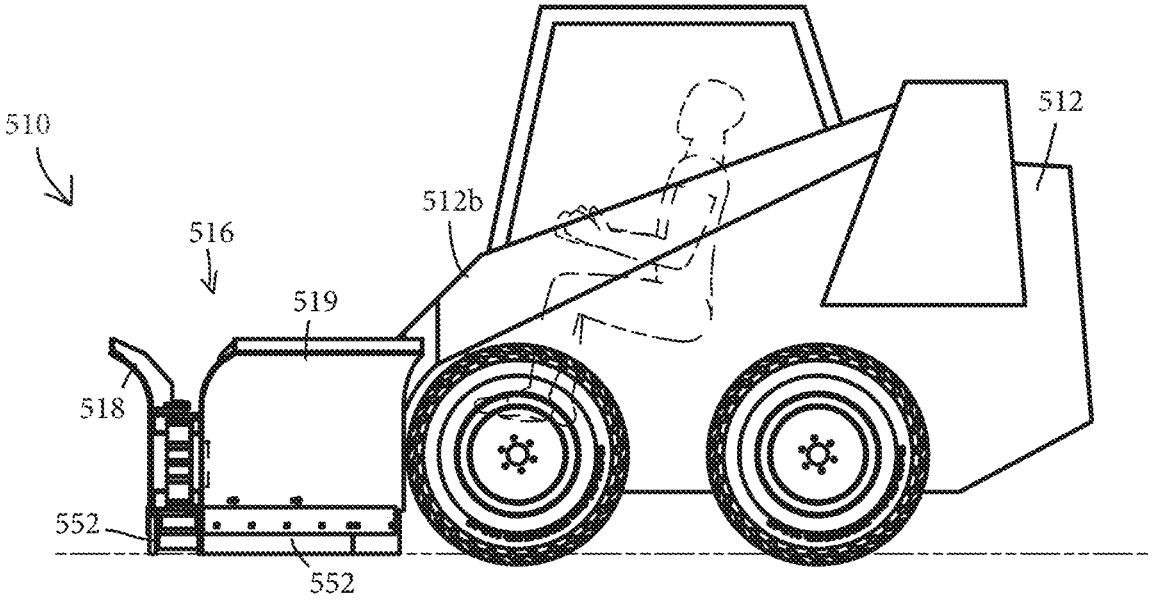
FIG. 38 is a side elevation view of the articulating snow plow apparatus of FIG. 37.
Figure 39:
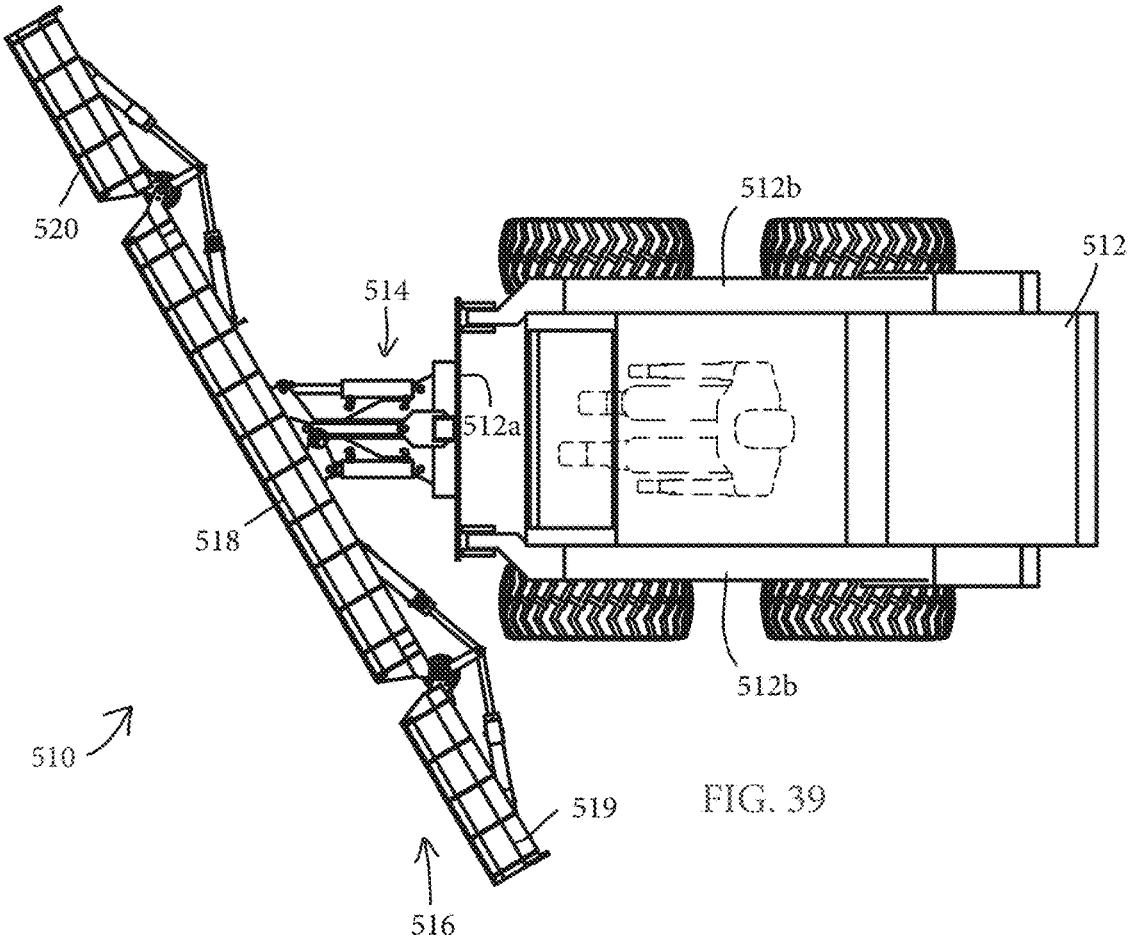
FIG. 39 is a top plan view of the articulating snow plow apparatus of FIG. 30, depicted with the plow blade assembly in a linear extended configuration and twisted at an oblique angle relative to the forward travel direction.
Figure 40:
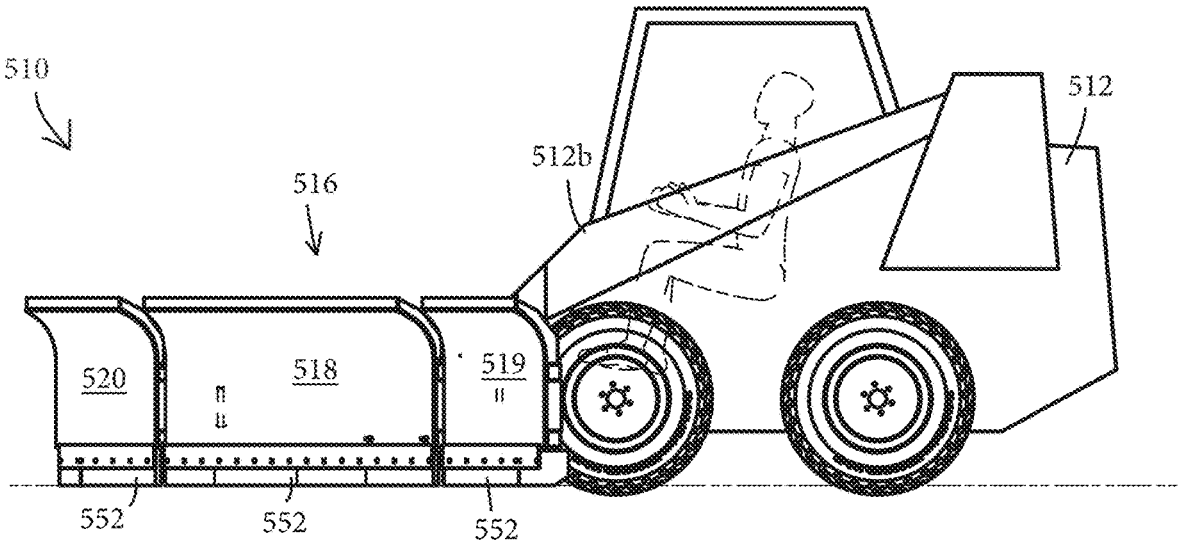
FIG. 40 is a side elevation view of the articulating snow plow apparatus of FIG. 39.

Apparatus 510 includes a support frame, in the form of a coupling linkage assembly 514, for removably coupling the apparatus 510 to the attachment block 512*a* of the vehicle 512 (FIGS. 30-37 and 39). As best shown in FIG. 30, the coupling linkage assembly 514 of apparatus 510 is formed by a coupling frame 521 that mates with the attachment block 512*a*, an upper stabilizing assembly 522 coupled between an upper/middle portion of the center blade 518 and the coupling frame 521, and a lower, main or primary support arm 524 coupled between a lower portion of the center blade 518 and the coupling frame 521 (FIGS. 30, 30A, 32, 34, and 36). The center blade 518 of blade assembly 516 is pivotably connected at its lateral centerline to each of the upper assembly 522 and the support arm 524 and these pivotable connections (i.e. connections 523 and 527 as described in further detail below) define the twist axis 526 about which blade assembly 516 is operable to twist relative to the coupling assembly 514, as depicted in FIG. 39. One difference between blade assembly 516 and blade assemblies 116, 316, and 416 is that the combined length of wings 519, 520 of blade assembly 516 is considerably less than the overall length of center blade 518 in order to accommodate the coupling linkage 514 (FIG. 36).

Figure 30A:
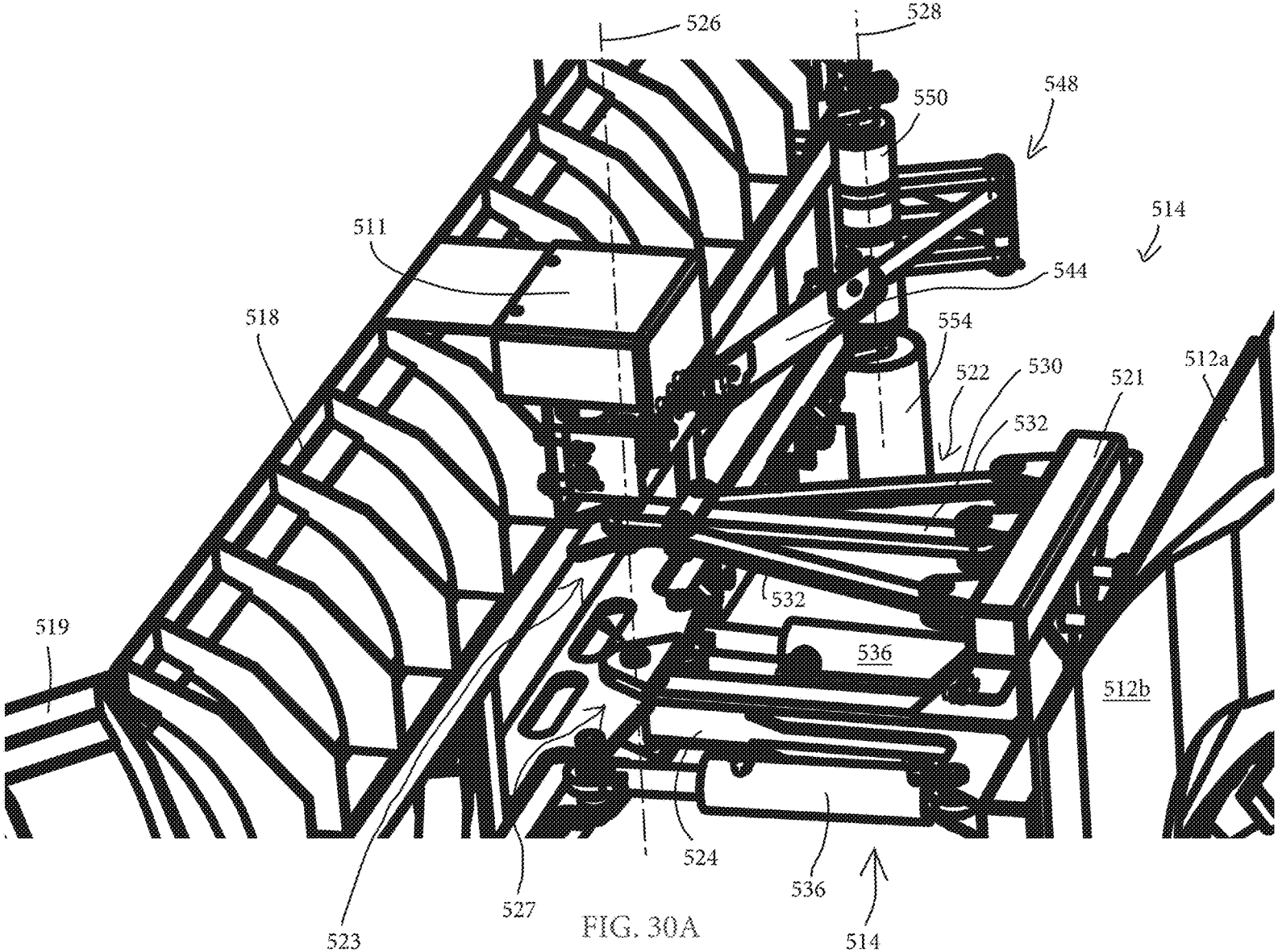
FIG. 30A is an enlarged view of the region designated 30A in FIG. 30.
Figure 31:
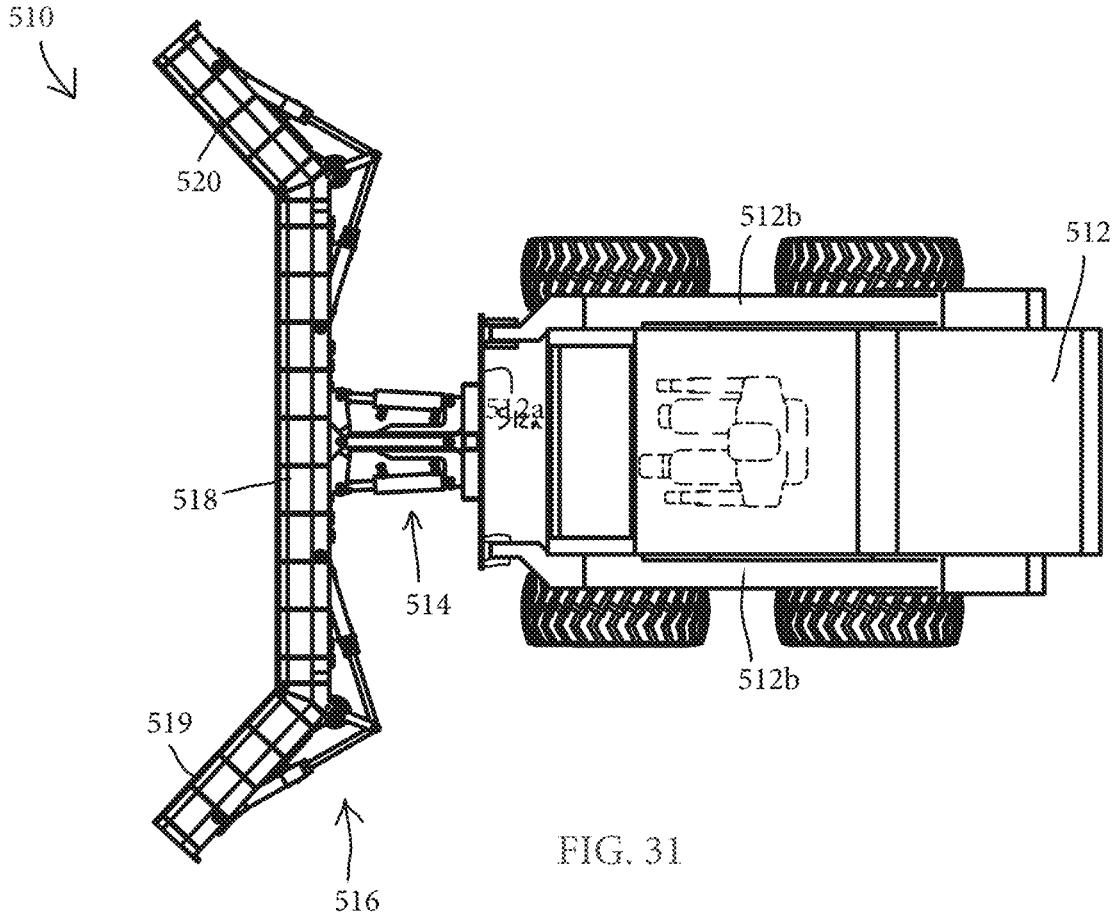
FIG. 31 is a top plan view of the articulating snow plow apparatus of FIG. 30.
Figure 32:
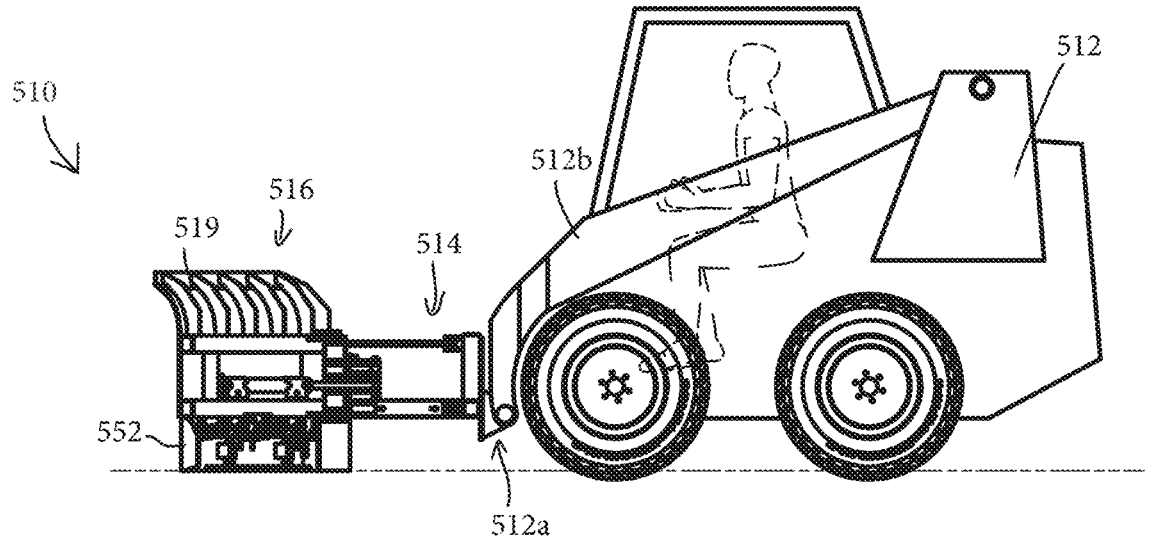
FIG. 32 is a side elevation view of the articulating snow plow apparatus of FIG. 30.
Figure 33:
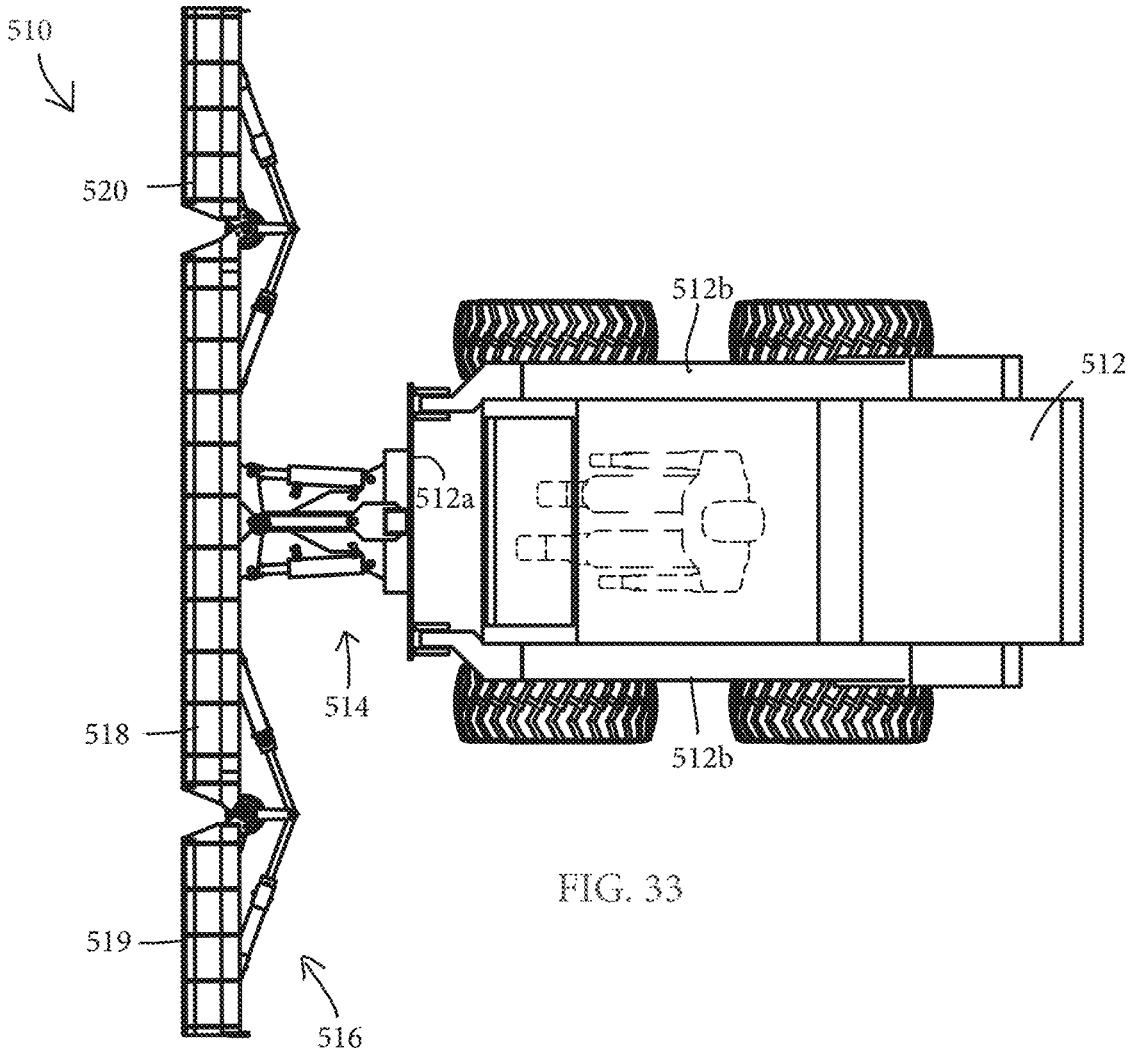
FIG. 33 is a top plan view of the articulating snow plow apparatus of FIG. 30, depicted with the plow blade assembly in a linear extended configuration and a neutral position.
Figure 34:
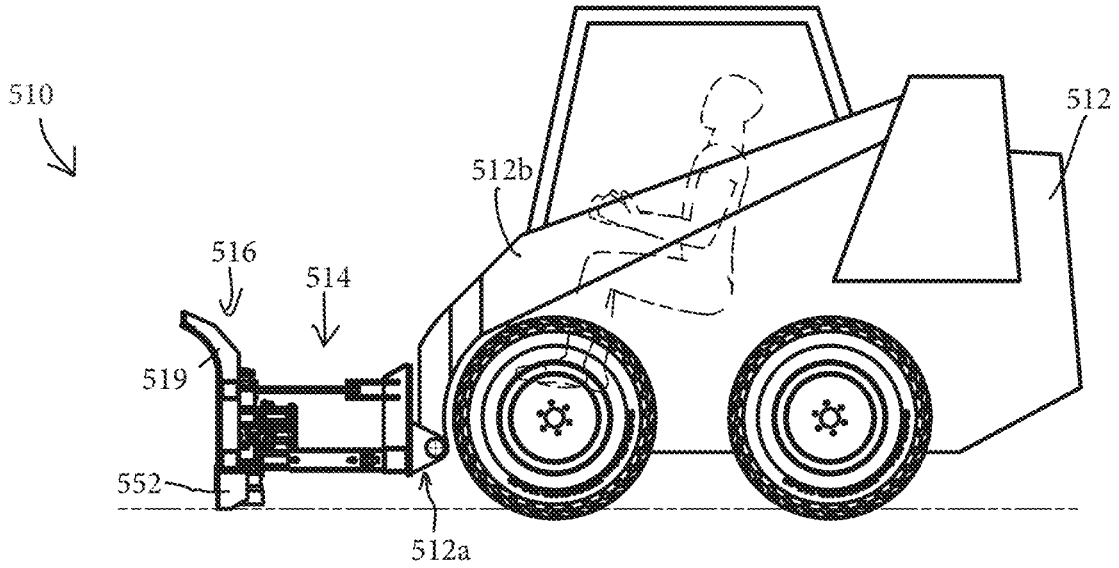
FIG. 34 is a side elevation view of the articulating snow plow apparatus of FIG. 33.
Figure 35:
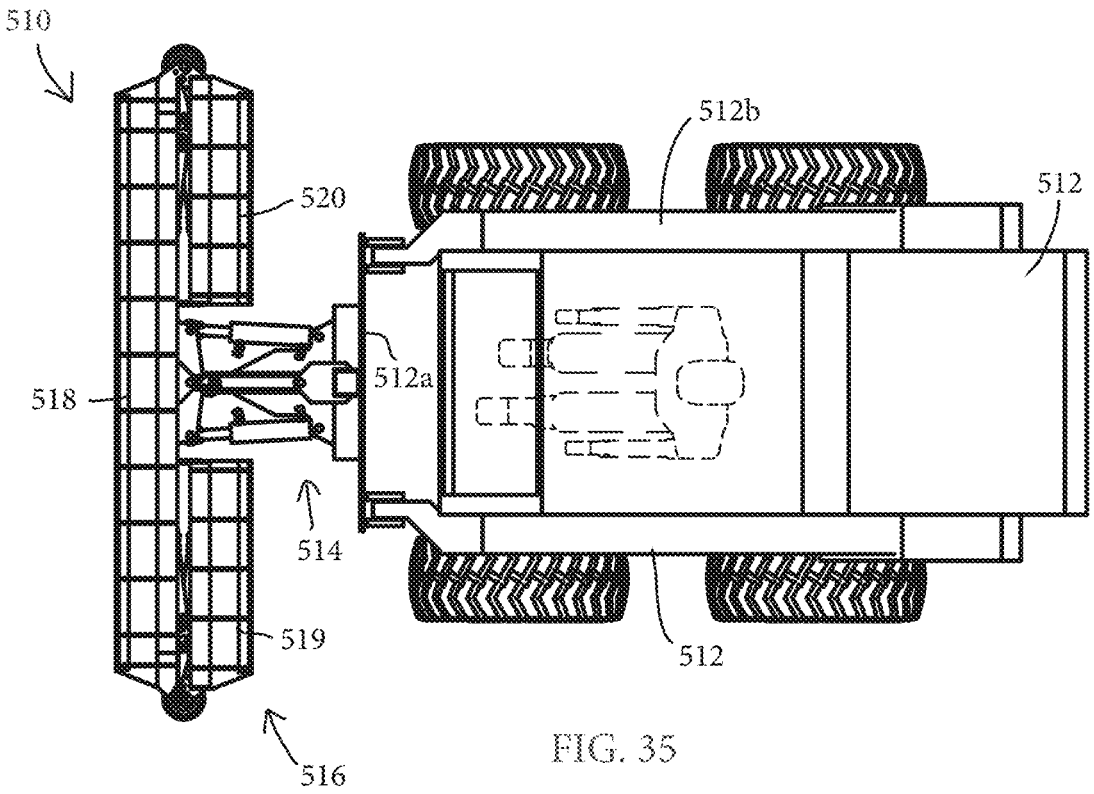
FIG. 35 is a top plan view of the articulating snow plow apparatus of FIG. 30, depicted with the plow blade assembly in a closed or stowed configuration and a neutral position.

Upper stabilizing assembly 522 includes a main stabilizer arm or bar 530 and a pair of lateral stabilizer arms of bars 532. The main stabilizer bar 530 and lateral stabilizer bars 532 are each rotatably coupled at their respective proximal ends to the coupling frame 521 in a uniformly and laterally spaced manner (FIG. 30A). The distal end of main stabilizer bar 530 is coupled with a middle, upper portion of the center blade 518 at a pivot connection point 523 at the twist axis 526 via a shaft 525 passing through the connection point 523 (FIGS. 30A, 33, and 34). Respective distal ends of lateral stabilizer bars 532 are coupled to a portion of main stabilizer bar 530 proximate the distal end of bar 530 at a location spaced apart from connection point 523. The connection between the distal ends of the lateral stabilizer bars 532 and the main stabilizer bar 530 permit some amount of lateral movement of the main stabilizer bar 530. For example, the lateral stabilizer bars 532 may include slotted holes at their distal ends where they couple to the main stabilizer bar 530, and/or a slotted coupler may connect the lateral bars 532 to one another and surround the main stabilizer bar 530 to retain main bar 530 between the lateral bars 532. The lateral stabilizer bars 532 are oriented at an oblique angle relative to main stabilizer bar 530 to provide lateral support to arm 530. The primary functions of stabilizing assembly 522 are (i) to retain the blade assembly 516 at an upright orientation that is generally parallel to the face of attachment block 512*a* such that when the apparatus 510 is positioned for plowing, the blade assembly 516 is in a generally upright position, and (ii) to limit the lateral movement of the upper portion of the center blade 518.

Figure 43:
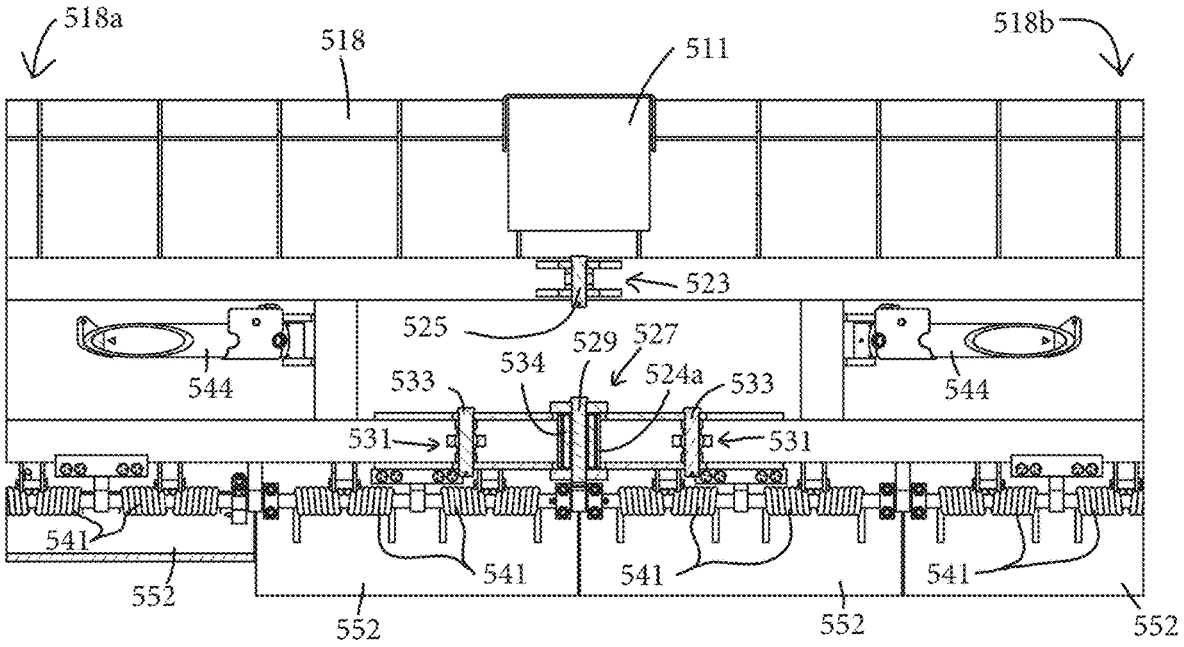
FIG. 43 is a sectional rear elevation view of the center blade portion of the articulating snow plow apparatus of FIG. 30, depicting internal structure of components of a coupling assembly of the apparatus and one of the trippable contact plates in a rearwardly tripped position.
Figure 44:
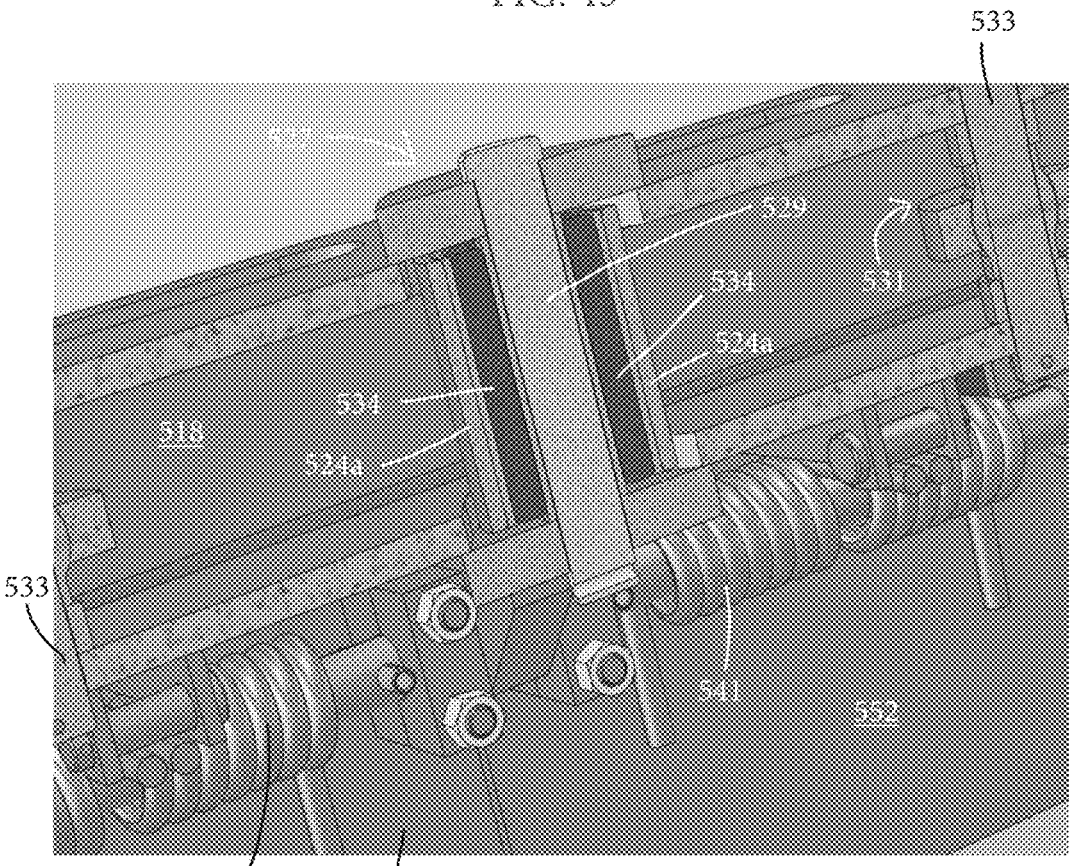
FIG. 44 is a sectional rear perspective view of a portion of the coupling assembly of FIG. 43, depicting internal structure of an oscillation bushing.

Main support arm 524 is fixed at its proximal end to a lower portion of the coupling frame 521 and provides support from the vehicle 512 for a majority of the weight of blade assembly 516. A cylindrical sleeve 524*a* at the distal end of main support arm 524 is coupled to the lower, center portion of center blade 518 at a main pivot connection point 527 at the twist axis 526 via a coupling shaft 529 passing through the connection point 527 (FIGS. 30A, 43, and 44). An oscillation bushing or damper 534 is provided between the shaft 529 and cylindrical sleeve 524*a* at main connection point 527 (FIGS. 43 and 44). The bushing 534 permits the blade assembly 516 to oscillate relative to main support arm 524 so that the blade assembly 516 may slant/float to automatically adjust to uneven or slanted ground surfaces (see slanted blade assembly 516 in FIG. 41). The upper stabilizing assembly 522 cooperates with main support arm 524 and oscillation bushing 534 to permit limited oscillation or slanting of the blade assembly 516, thereby allowing the outboard ends of the blade assembly 516 to raise and lower vertically when the blade assembly 516 encounters uneven or changing elevations of the surface to be plowed. The bushing 534 may further provide some damage protection to the blade assembly 516 in the event of forward, rearward, and/or lateral impacts with heavy or immovable objects.

A blade assembly twist actuator is provided in the form of a pair of hydraulic cylinders 536 coupled between the center blade 518 and the coupling frame 521 on each side of the main support arm 524, as best shown in FIG. 30A. The hydraulic cylinders 536 cooperate with one another to twist the blade assembly 516 relative to vehicle 512 about twist axis 526. Each hydraulic cylinder 536 is pivotably coupled at its proximal end to a lower portion of the coupling frame 521 at a location spaced apart from main support arm 524 (FIGS. 30 and 30A). Each actuator 536 is pivotably coupled at its distal end to a lower portion of the center blade 518 at a pivot connection point 531 with a shaft 533 (FIGS. 30, 30A, and 42-44). Each pivot connection point 531 is spaced laterally apart from main pivot connection point 527.

While the wings 519, 520 and center plate 518 of the illustrated embodiment of FIGS. 30-42 are shown as having fixed curved/contoured profiles or moldboard shapes 517 (see FIG. 30) on the upper portion of the snow/debris pushing surface, it will be appreciated that different profiles or moldboard shapes may be used, such as moldboards with a curved/contoured upper and lower portion as illustrated in FIGS. 20-24 or flat moldboards as illustrated in FIGS. 14-15, for example. Optionally, a deformable moldboard or snow deflecting apparatus may be provided at an upper portion and/or lower portion of the wings 519, 520, and center blade 518, such as a deformable moldboard 610 of FIGS. 45 and 46, as described in more detail below.

Figure 41:
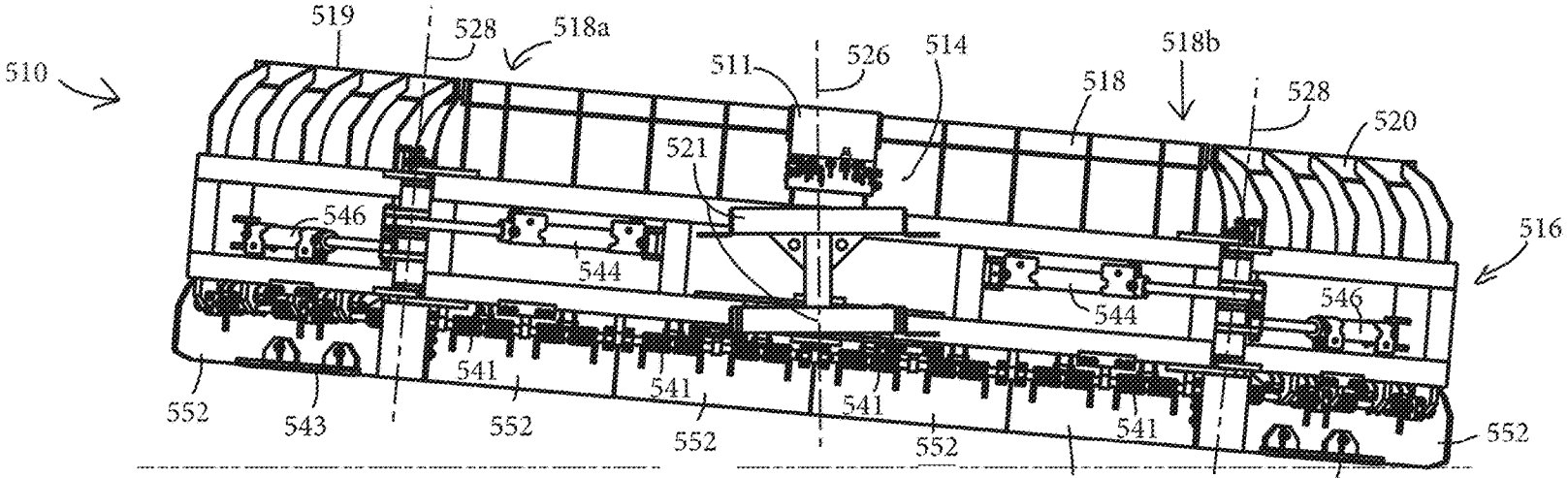
FIG. 41 is a rear elevation view of the articulating snow plow apparatus of FIG. 30, depicted with the plow blade assembly in the linear extended configuration and in a slanted position relative to the lateral axis of the vehicle.
Figure 42:
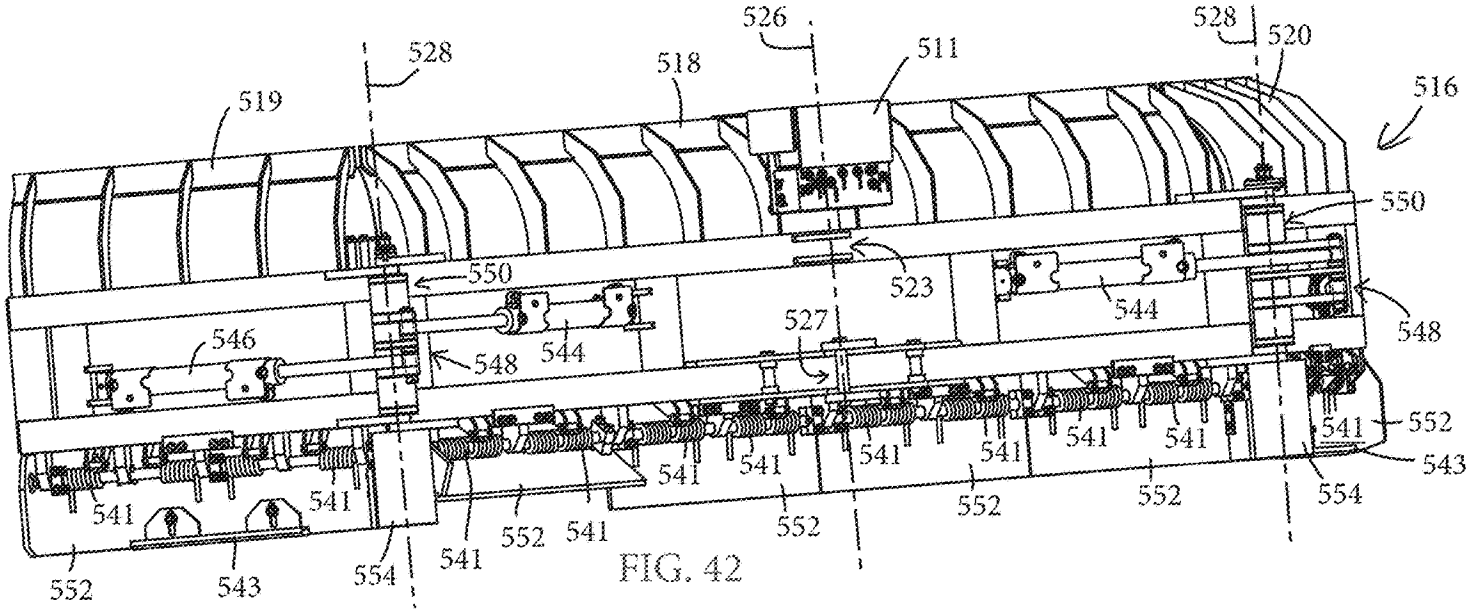
FIG. 42 is a rear perspective view of the plow blade assembly of articulating snow plow apparatus of FIG. 30, depicted with one of a set of trippable contact plates in a rearwardly tripped position.

As best shown in FIGS. 30 and 41-44, center blade 518 includes a set of segmented trippable or pivotably releasable surface-scraping wear or contact plates 552 along the bottom portion of the blade 518, and each wing 519 and 520 includes a single trippable surface-scraping wear or contact plates 552 along the bottom portion of the wing. As best shown in FIGS. 41-44, contact plates 552 are each pivotably mounted to their respective center blade 518 or wing 519, 520 with a shaft and torsion spring assembly 541. As such, contact plates 552 may pivotably release (i.e. trip; see FIGS. 42 and 43) upon impact with heavy and immovable objects to protect the apparatus 510 from major damage. After the contact plates 552 clear or pass the heavy or immovable object, the plates 552 automatically return to their initial scraping/plowing position (see FIGS. 30 and 41). It will be appreciated that segmented trippable contact plates 552 may be provided with any of the center blades 118, 318, 418, or wings 119, 120, 319, 320, 419, 420 of the plow apparatuses 110, 210, 310, 410 described above. Float plates, skid shoes, or slide shoes 543 are coupled to a rear portion of the single trip plate 540 of each of wings 519 and 520 (FIGS. 30, 41, and 42). Each float plate 543 is vertically movable/adjustable relative to its respective trip plate 540.

Figure 45:
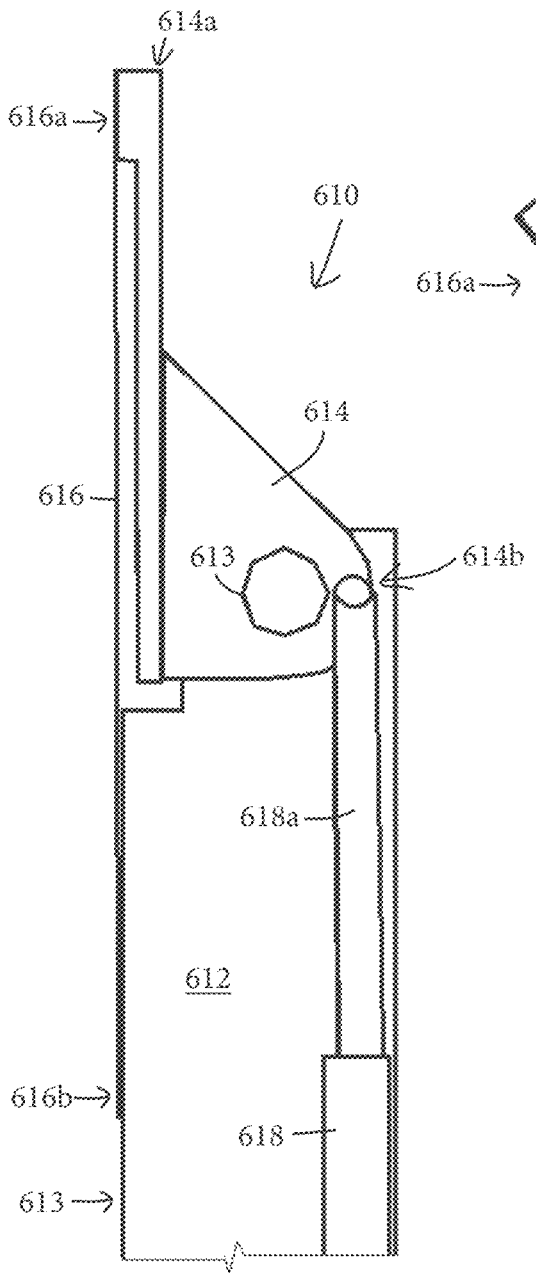
FIG. 45 is a side elevation view of a deformable moldboard in accordance with the present invention, shown mounted to an upper portion of a plow blade and depicted in a stowed or planar position relative to the plow blade.
Figure 46:
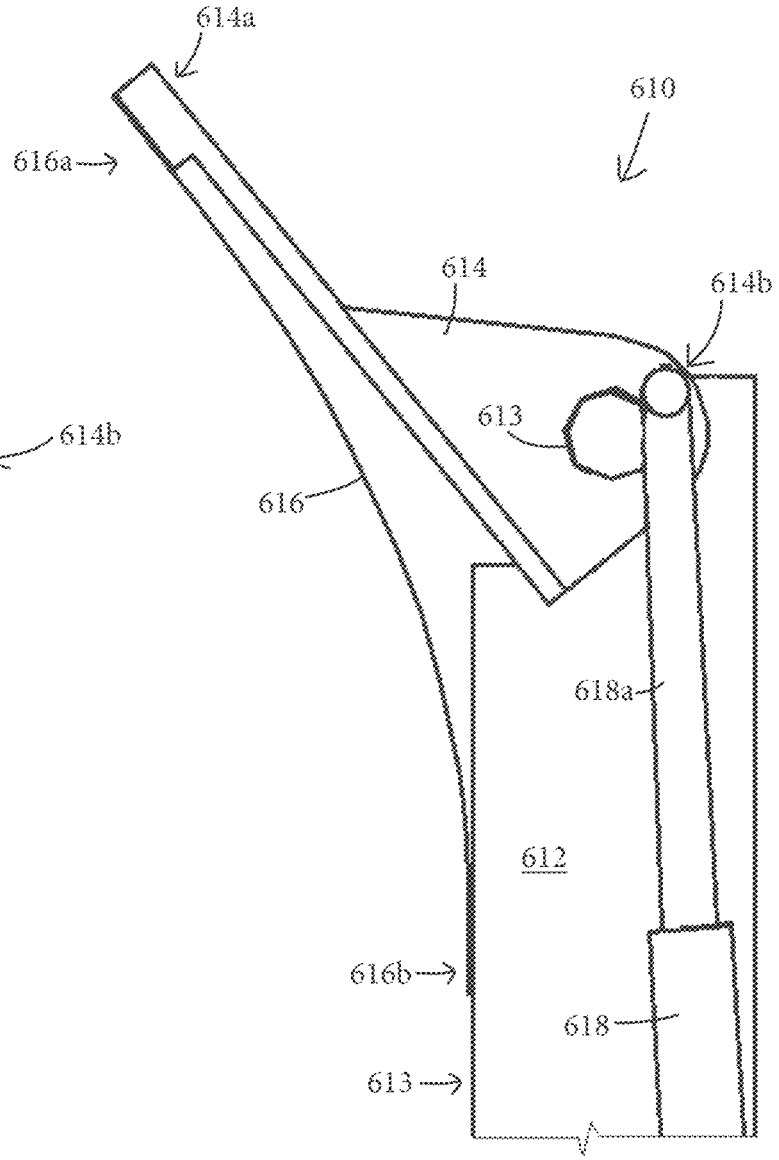
FIG. 46 is another side elevation view of the deformable moldboard of FIG. 45, depicted in a deployed or curved position.
Figure 47:
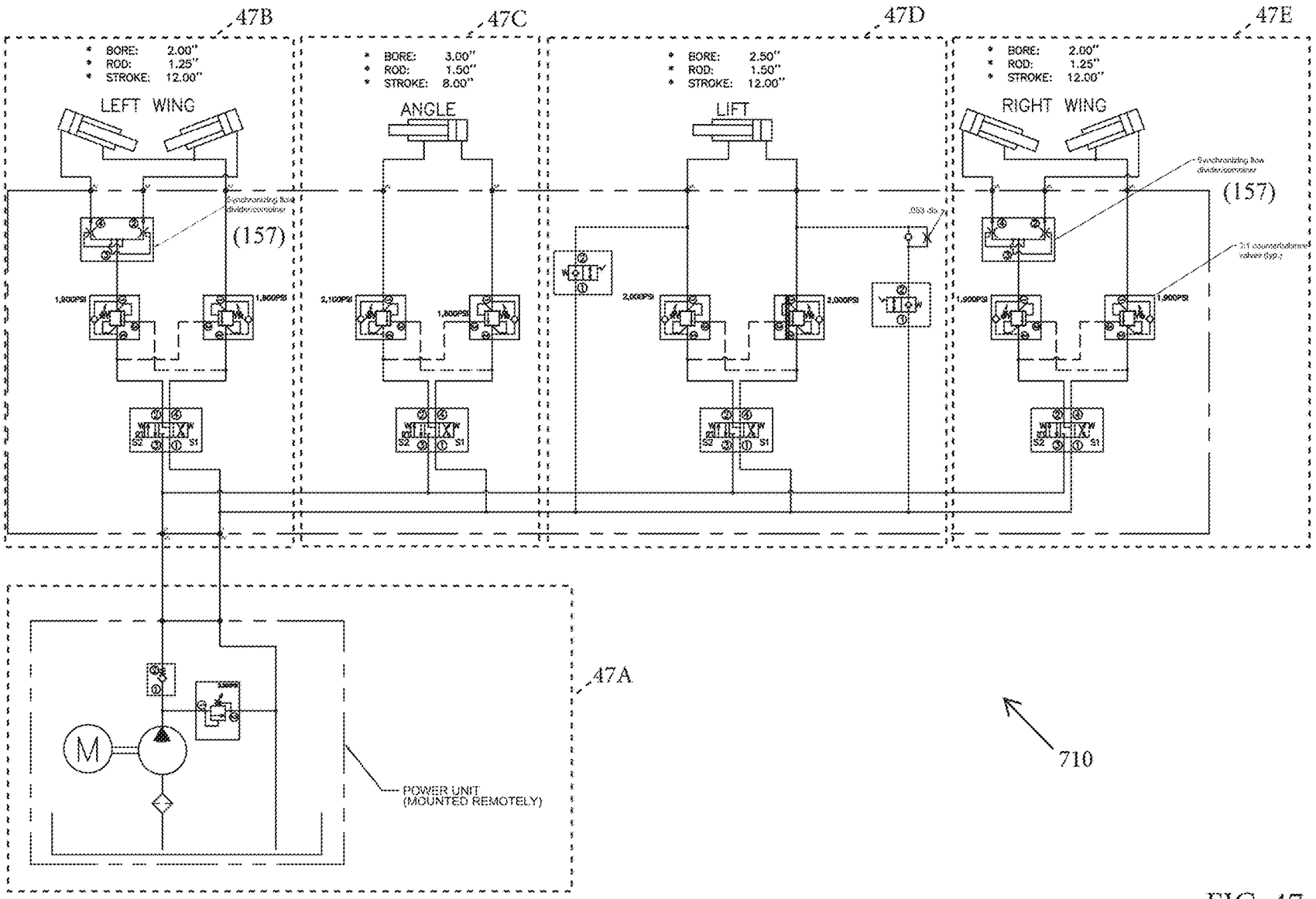
FIG. 47 is a diagrammatic view of an exemplary hydraulic control system for an articulating snow plow apparatus, in accordance with the present invention.
Figure 47A:
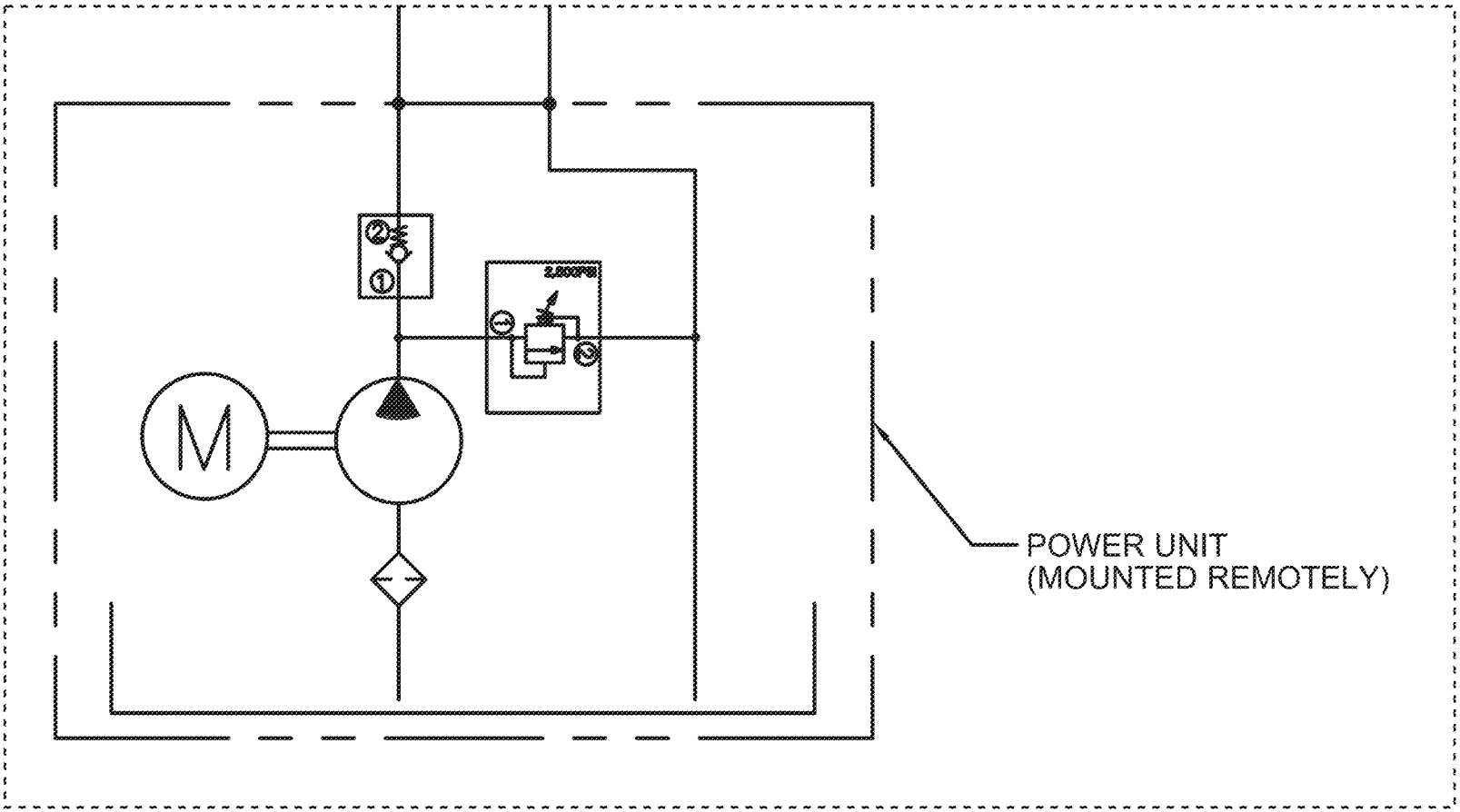
FIGS. 47A-47E are enlarged views of the regions designated 47A-47E in FIG. 47, respectively.
Figure 47B:
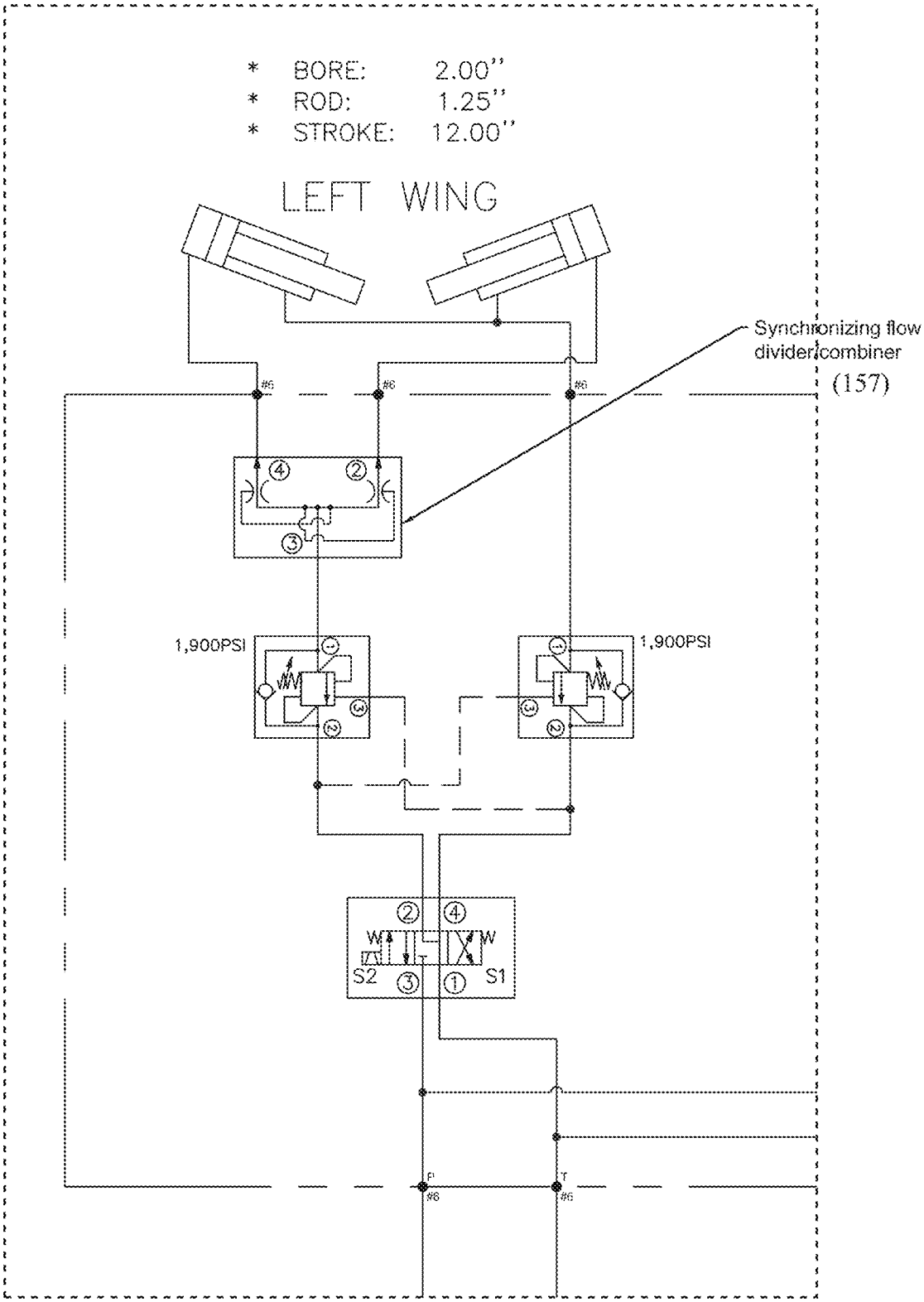
Figure 47C:
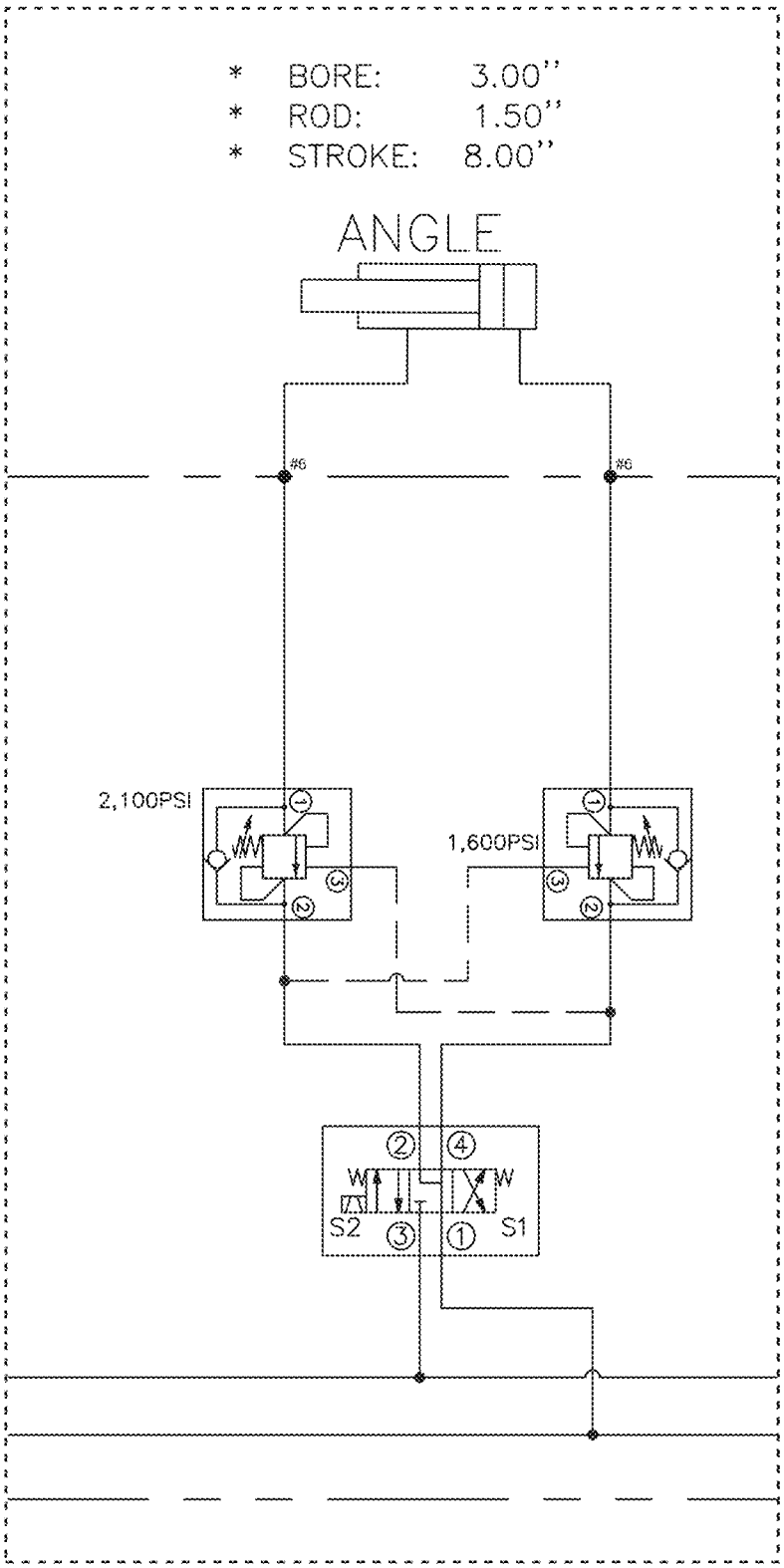
Figure 47D:
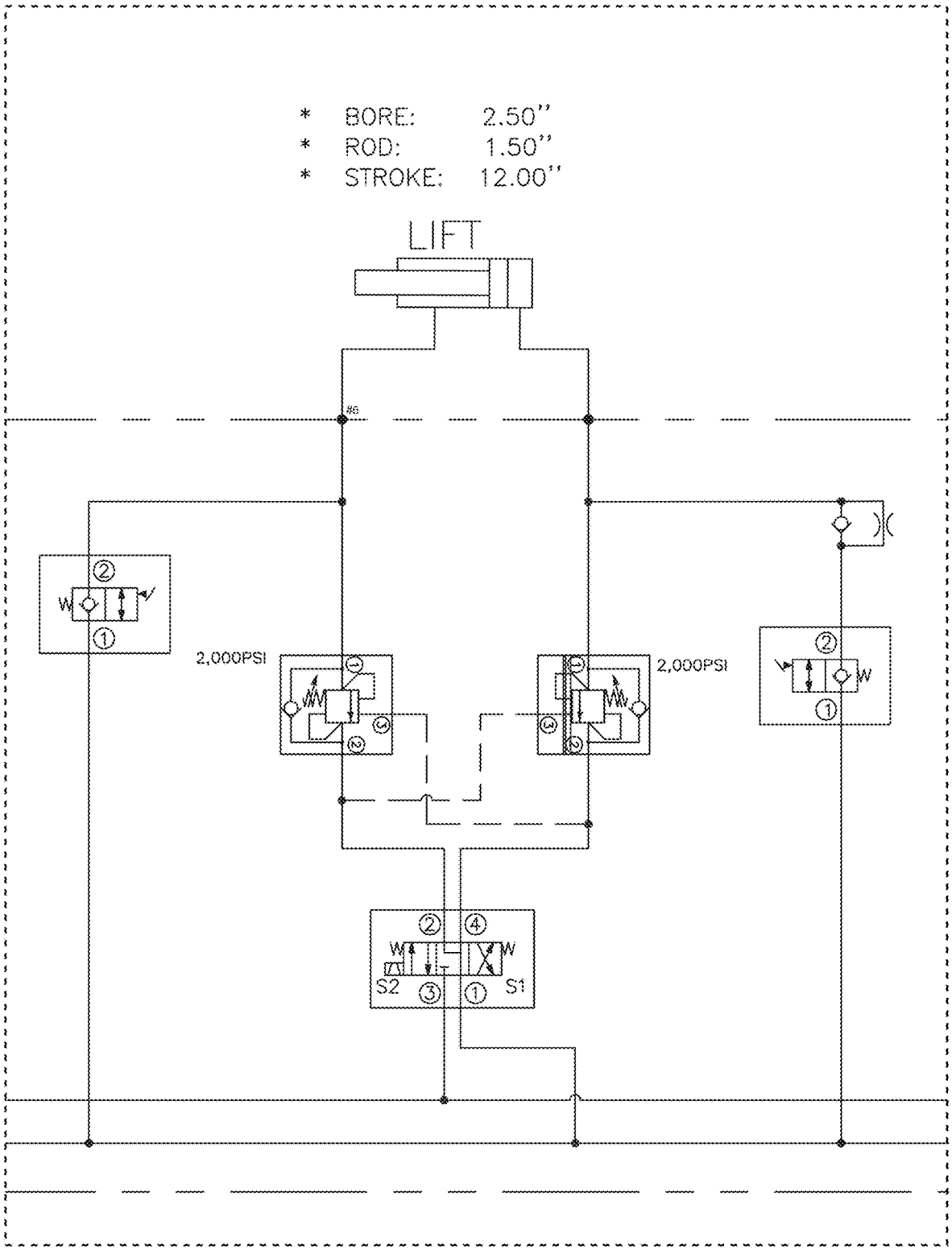
Figure 47E:
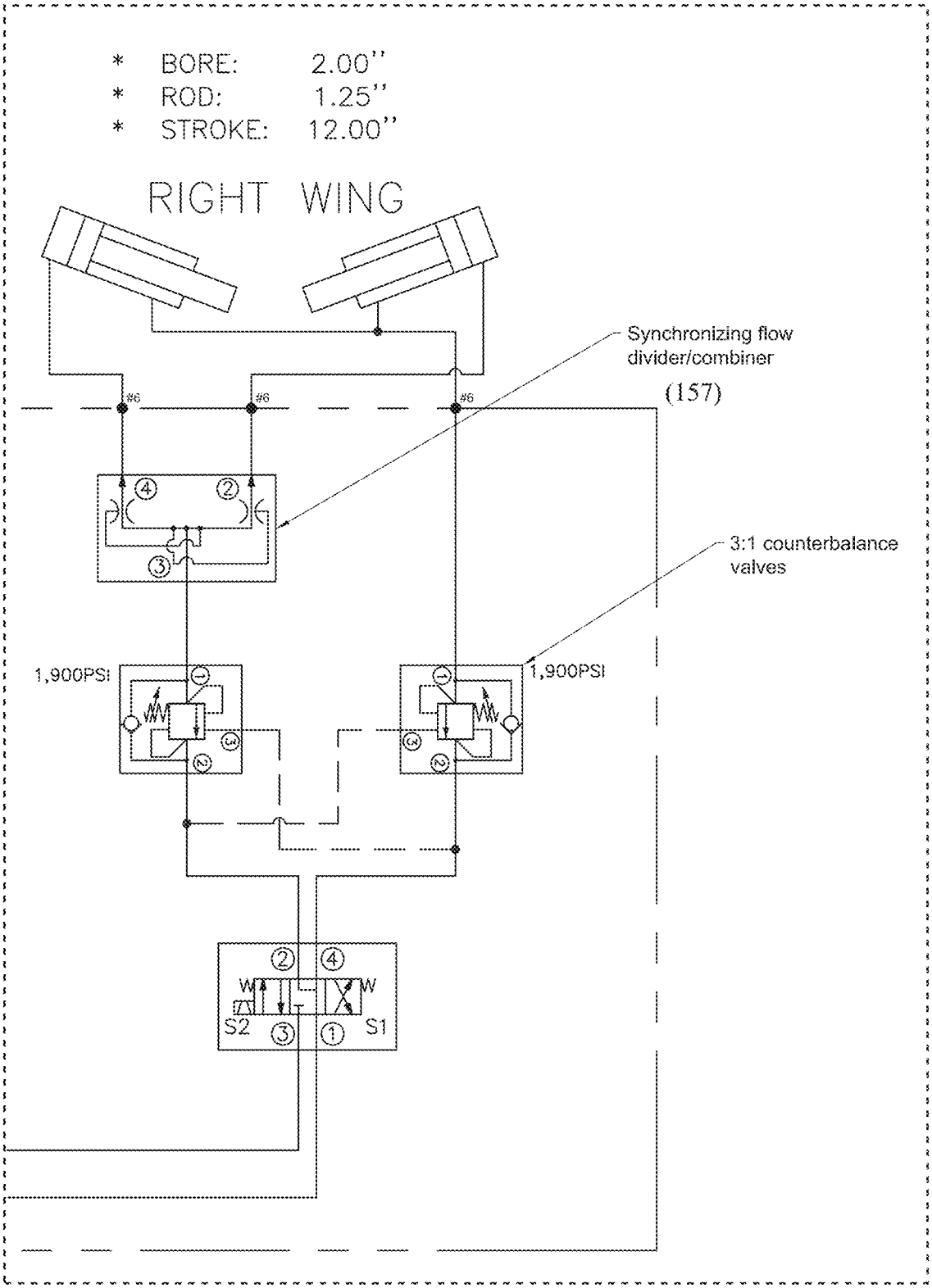

Referring now to the illustrative embodiment of FIGS. 45 and 46, a deformable moldboard assembly 610 is provided for a plow blade 612, and could be adapted for use on the blade assembly 416 described above, or others, to allow for the benefits of curved moldboards for pushing snow, and flat or planar moldboards for a compact non-use configuration. The moldboard assembly 610 includes a moldboard actuation bracket 614 pivotably coupled to an upper portion of the plow blade 612 at a hinge or pin 613, and a deformable plate or moldboard 616 fixed at a first end or upper portion 616*a* to an upper portion 614*a* of the actuation bracket 614 and fixed at the opposite end or lower portion 616*b* to an upper portion of a debris pushing face 613 of the plow blade 612. The moldboard assembly includes an actuator, in the form of a linear hydraulic actuator 618, and is operable to pivot the actuation bracket 614 relative to the plow blade 612. The actuation bracket 614 and the moldboard 616 are movable between a stowed position in which the moldboard 616 is generally planar and parallel to the debris pushing face 613 of the plow blade 612 (FIG. 45) and a deployed position in which the moldboard 616 is deformed in a curvilinear manner such that an upper portion 616*a* of the moldboard 616 contours outward and away from the debris-pushing face 613 of the plow blade 612 (FIG. 46). The linear actuator 618 is coupled between a portion of the plow blade 612 and a rear portion 614*b* of the actuation bracket 614 such that when the piston 618*a* of the linear actuator 618 extends, the actuation bracket 614 pivots toward the deployed position of FIG. 46, and when the piston 618*a* of the linear actuator 618 retracts, the actuation bracket 614 pivots toward the stowed position of FIG. 45. The moldboard 616 is formed of a pliable, elastic, and resilient material capable of deforming as the actuation bracket 614 moves or bends the moldboard 616 and capable of returning to its initial form when the actuation bracket 614 moves toward the stowed position. The moldboard 616 may extend along a portion of the length a plow blade or along the entire length of a blade. The moldboard 616 may be provided along one or more blade segments of a plow blade assembly (e.g. center blade 418 and/or wings 419 and 420).

The deformable moldboard assembly 610 is particularly useful for facilitating low profile face-to-face stowage of extendable plow wings, e.g. wings 419, 420 of apparatus 410 in FIGS. 27-29, along a center or adjacent blade, e.g. center blade 420 of apparatus 410 (see FIG. 29 for an example of low profile face-to-face stowage), while providing a debris-directing curved/contoured moldboard when the wings are deployed. With the deformable moldboard 610 in the stowed position, the wings 419, 420 may rest face-to-face with the center blade 418. Once the wings 419, 420 are deployed, the deformable moldboard assembly 610 can deploy the moldboards 616 to provide a debris-directing surface at an upper portion of the plow wing and/or center blade. It will be appreciated that the deformable moldboard assembly may be utilized with individual plow blades as well as plow blade assemblies, such as those described for the apparatuses 110, 210, 310, 410, and 510 above.

Figure 48:
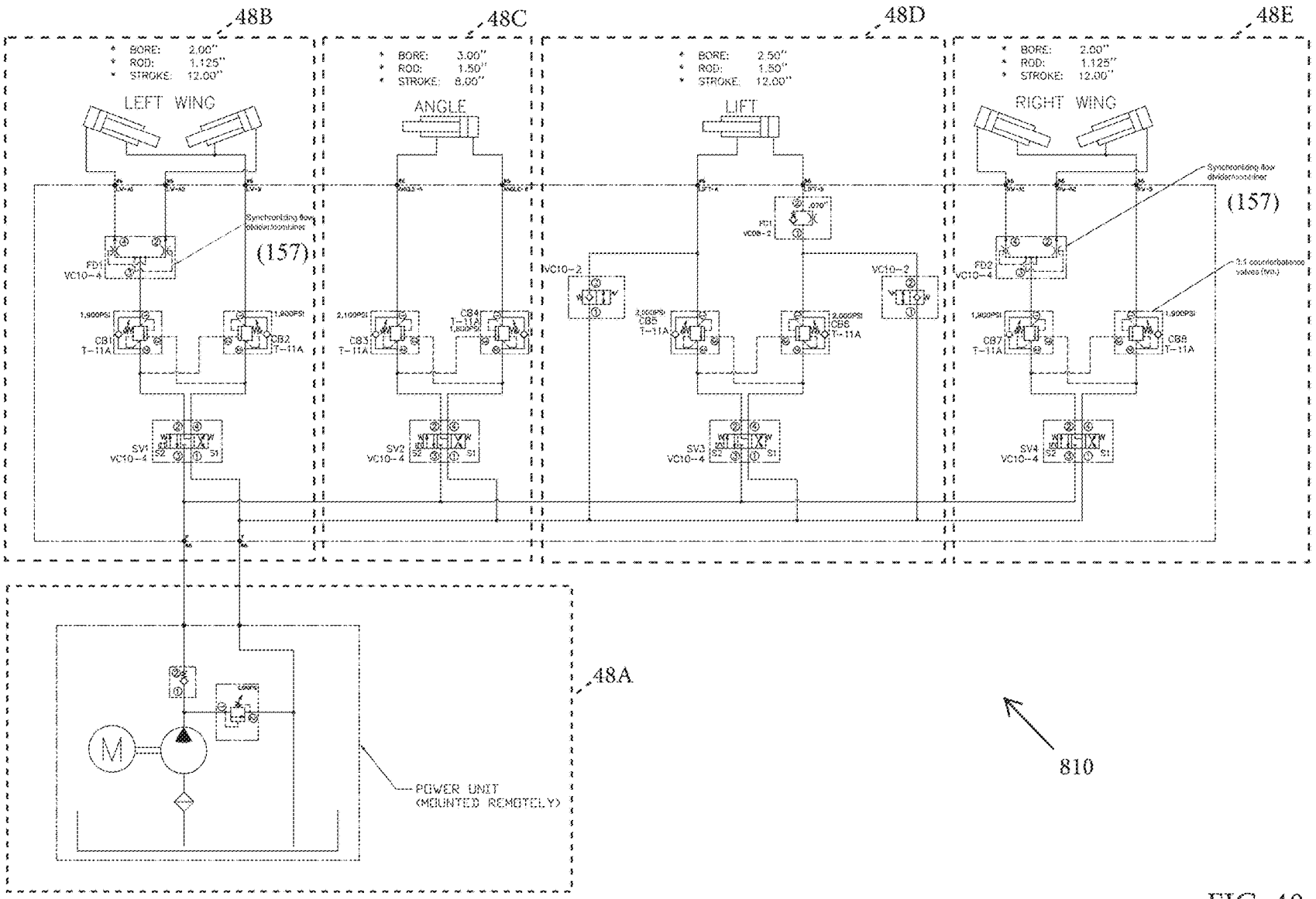
FIG. 48 is a diagrammatic view of another exemplary hydraulic control system for an articulating snow plow apparatus, in accordance with the present invention.
Figure 48A:
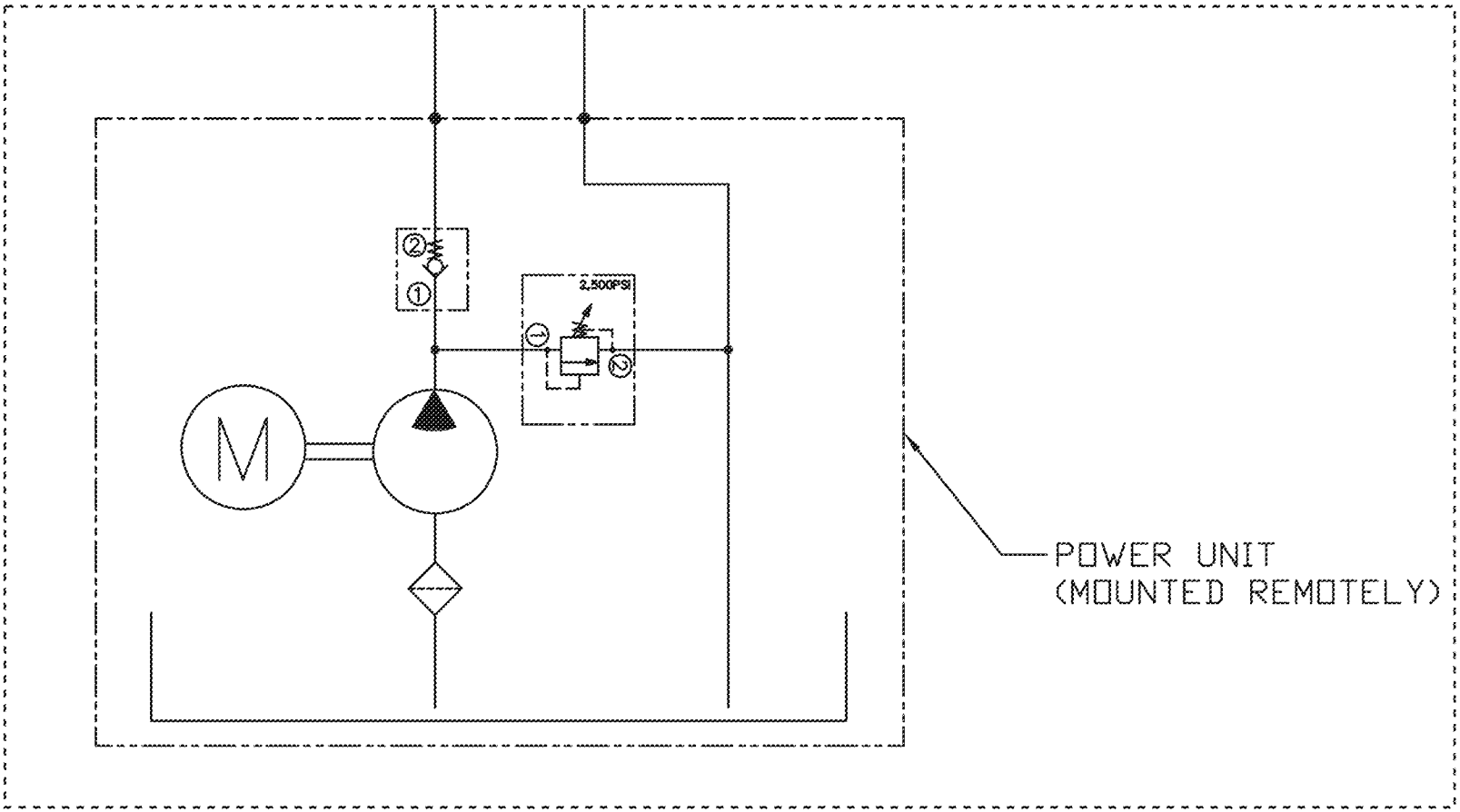
FIGS. 48A-48E are enlarged views of the regions designated 48A-48E in FIG. 48, respectively.
Figure 48B:
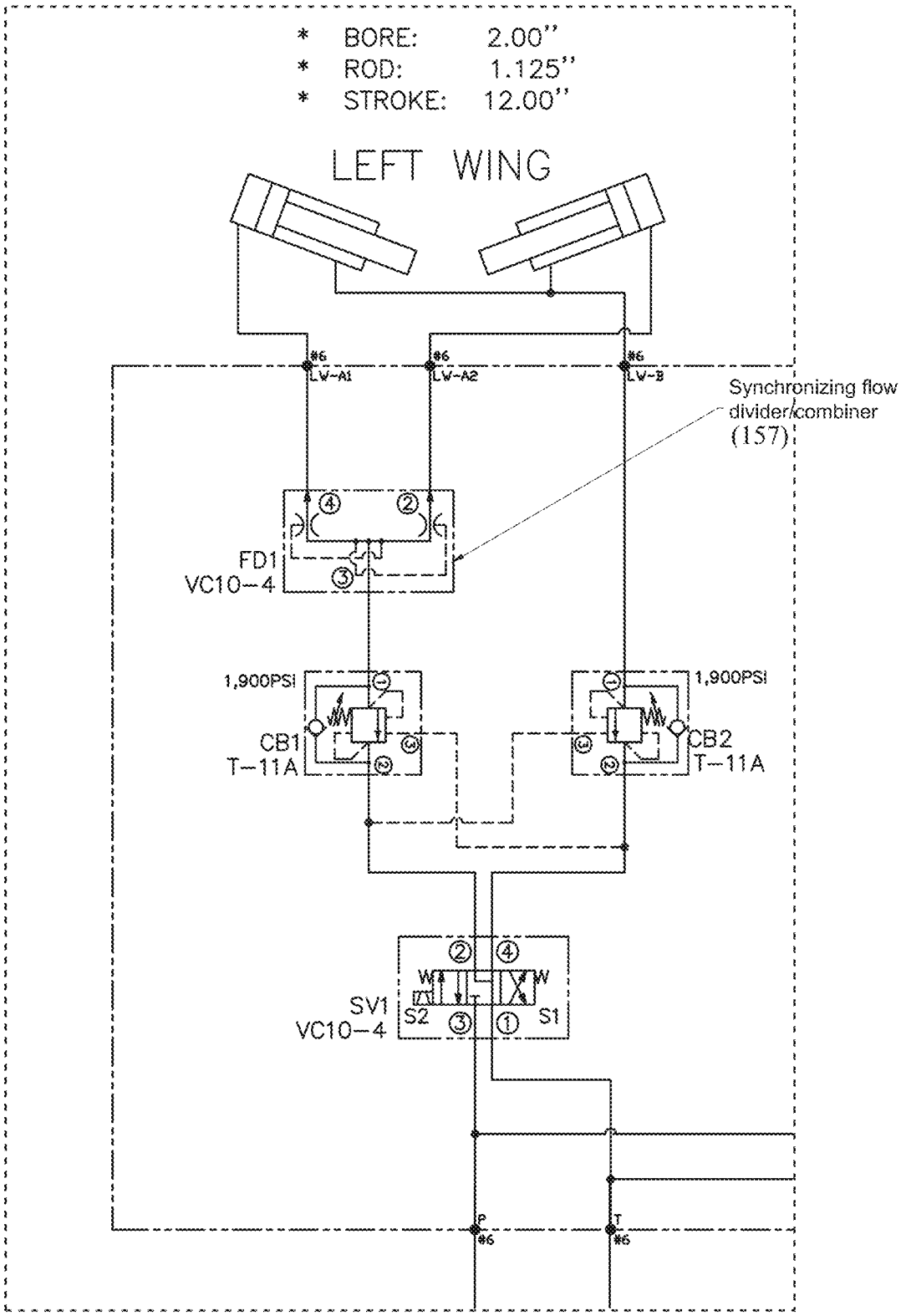
Figure 48C:
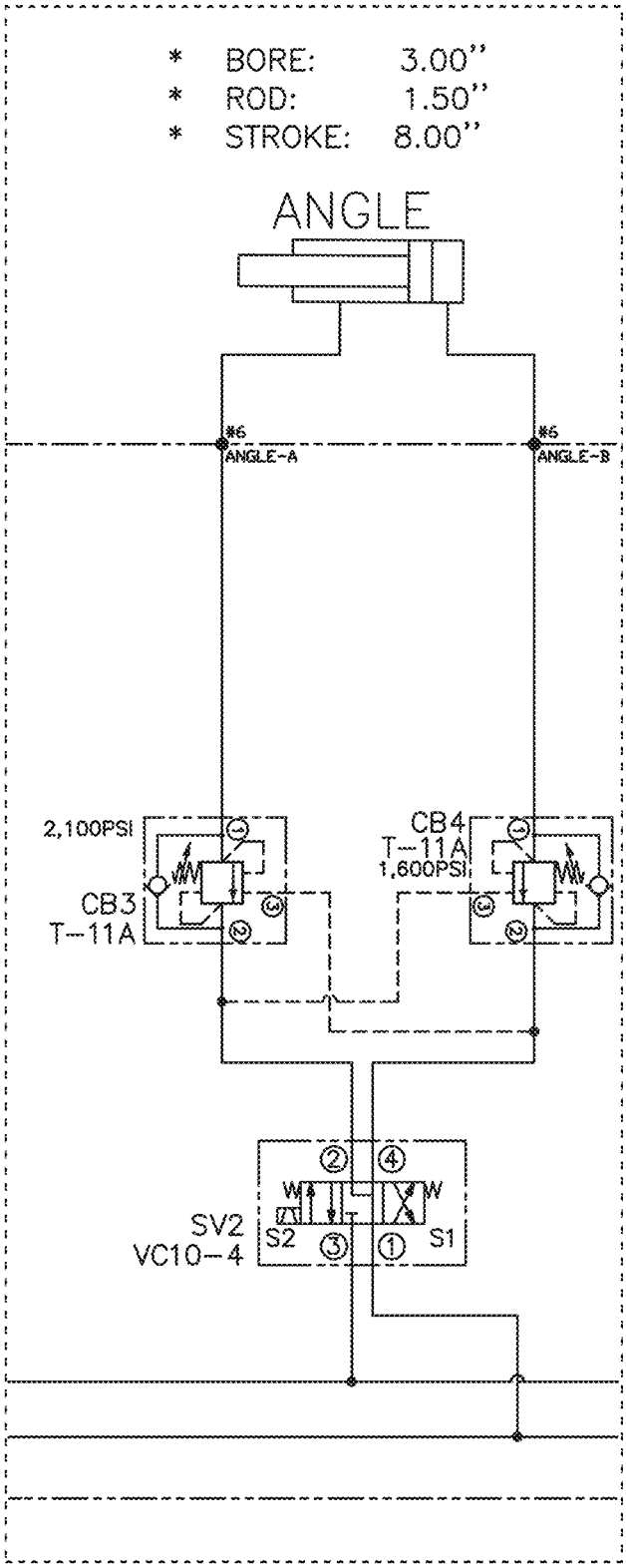
Figure 48D:
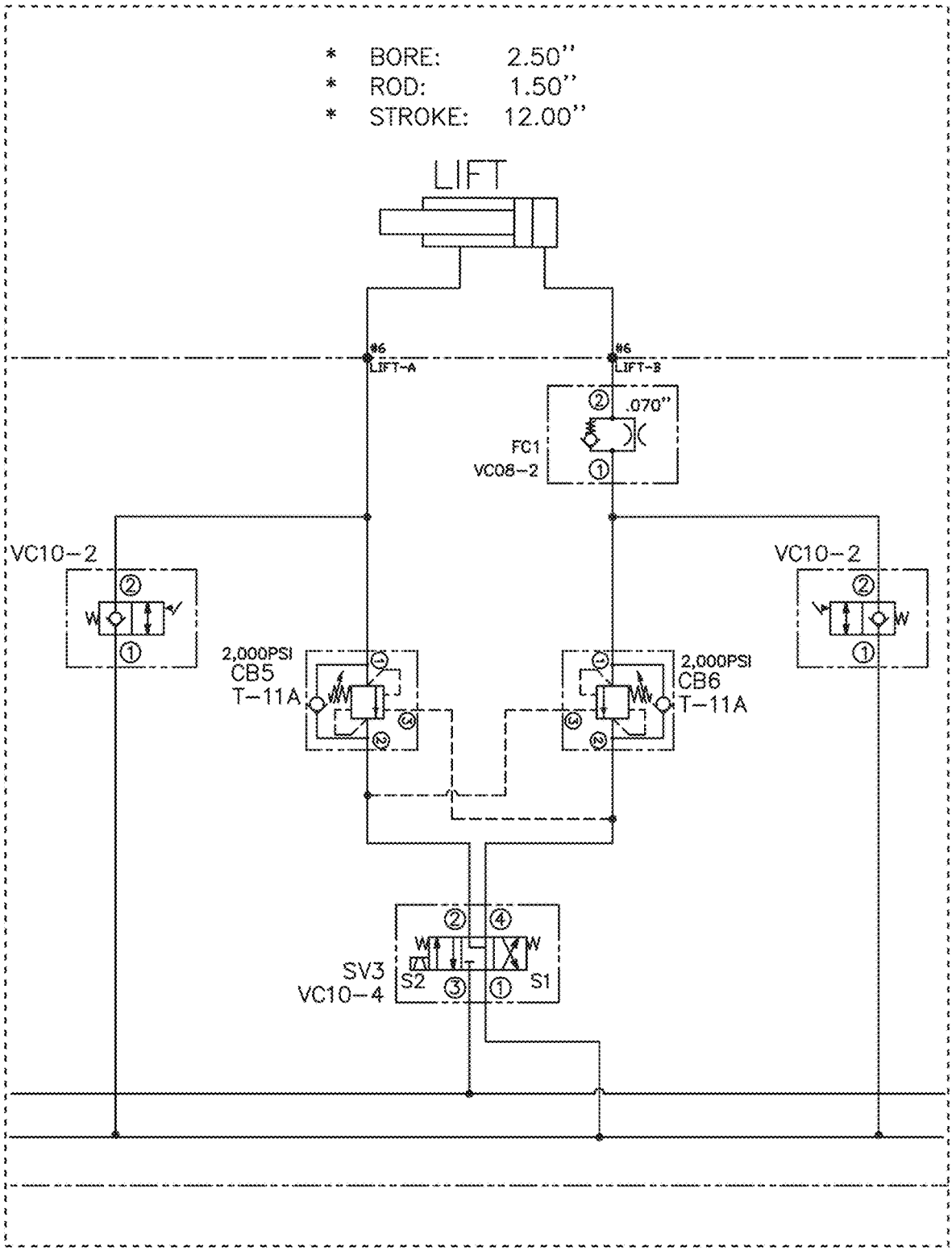
Figure 48E:
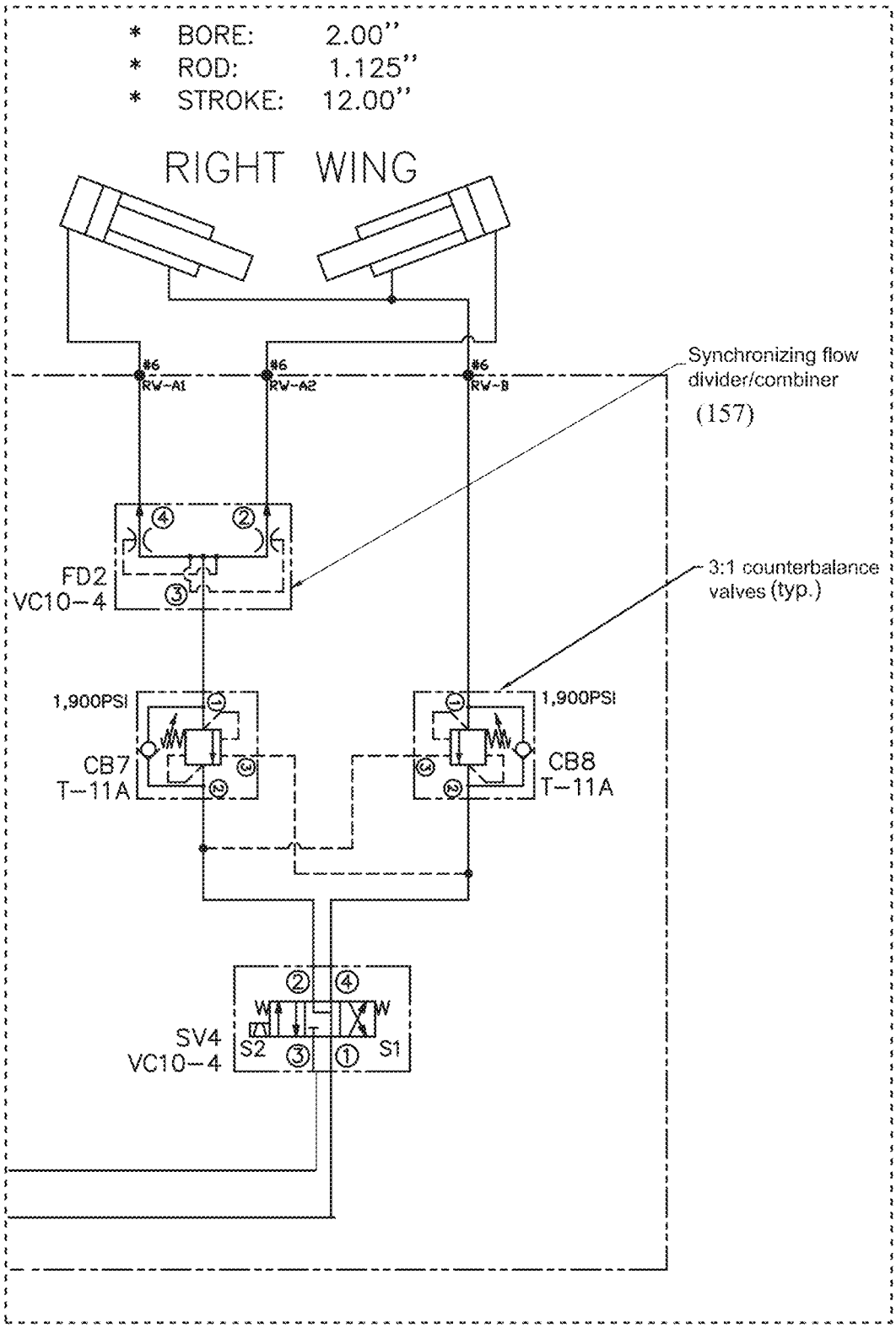
Figure 49:
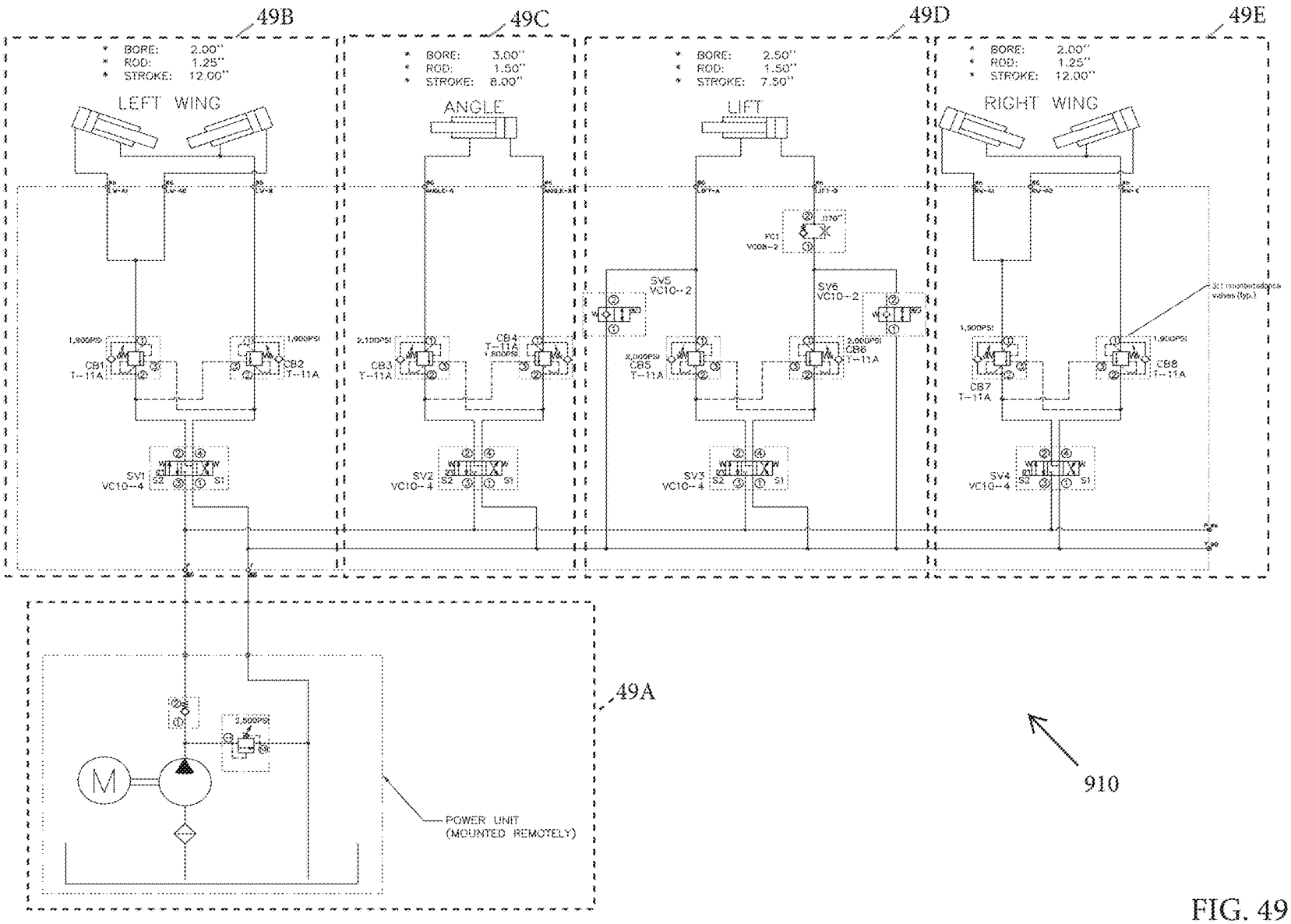
FIG. 49 is a diagrammatic view of another exemplary hydraulic control system for an articulating snow plow apparatus, in accordance with the present invention.
Figure 49A:
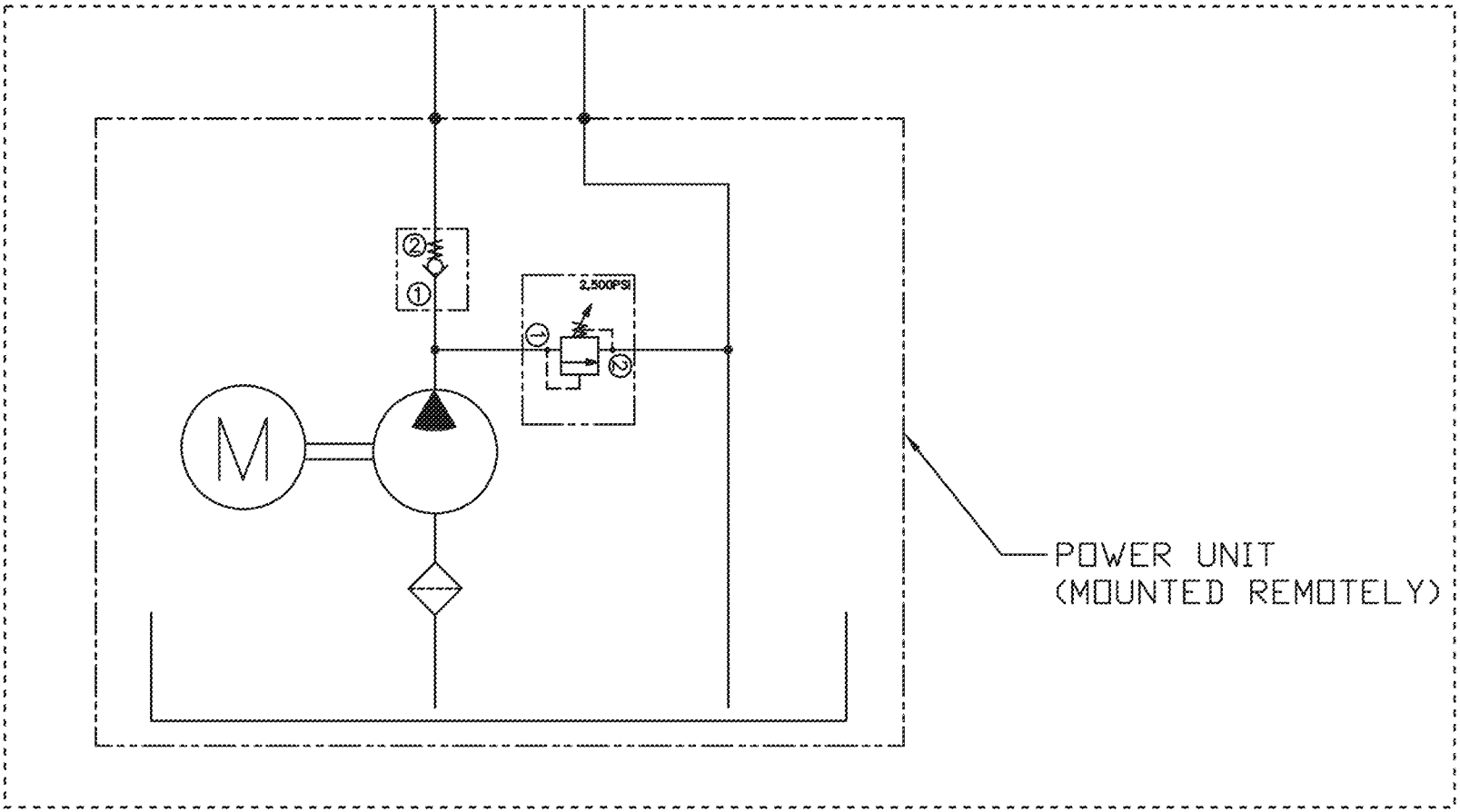
FIGS. 49A-49E are enlarged views of the regions designated 49A-49E in FIG. 49, respectively.
Figure 49B:
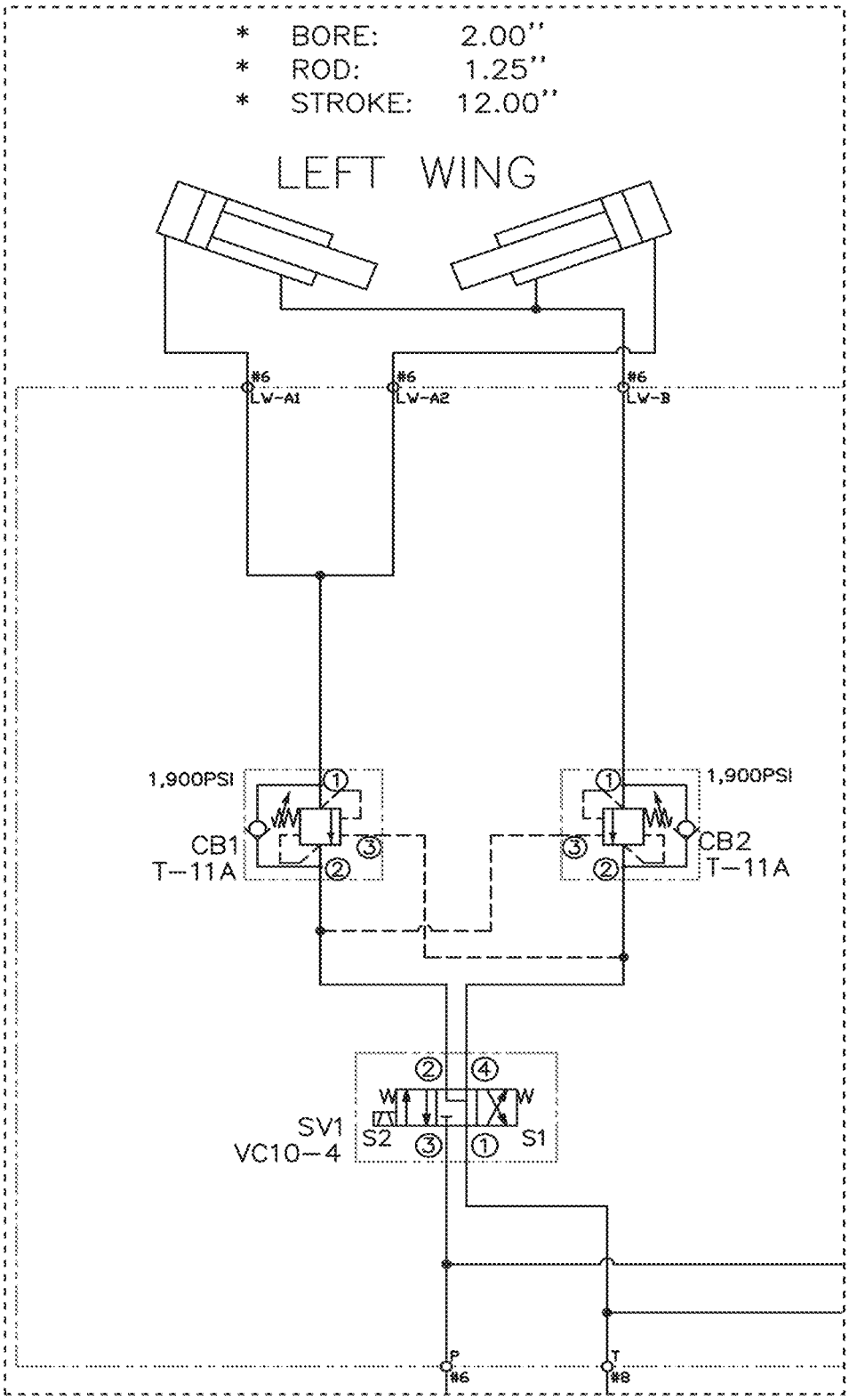
Figure 49C:
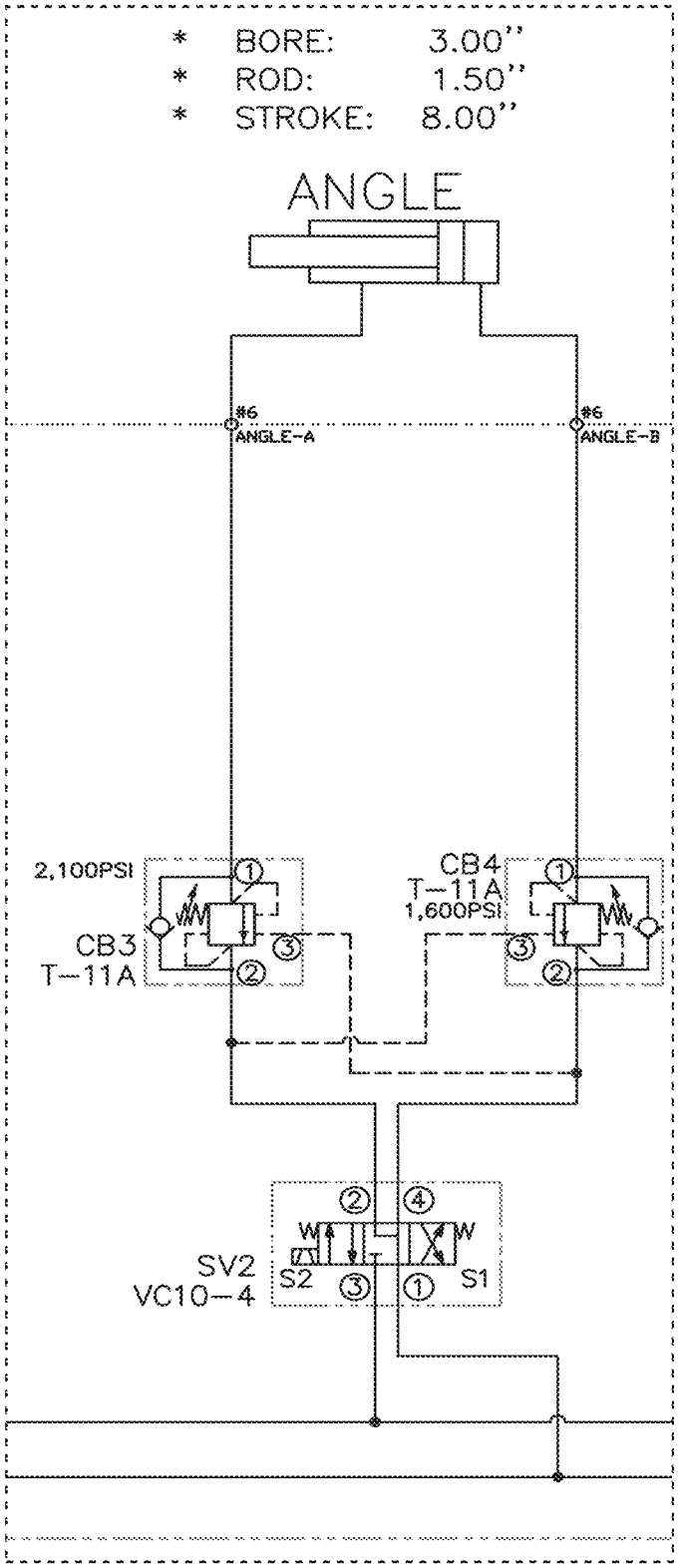
Figure 49D:
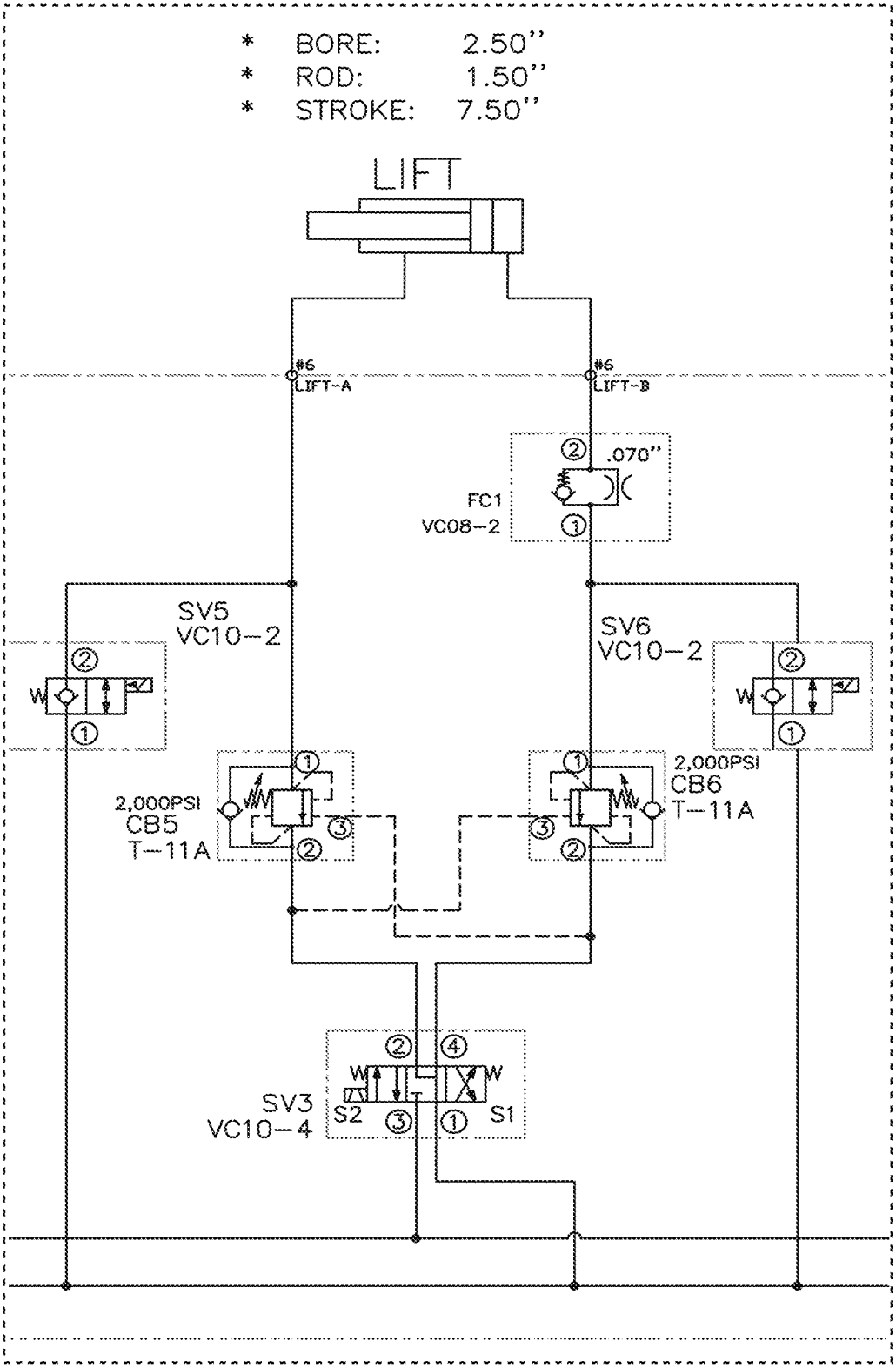
Figure 49E:
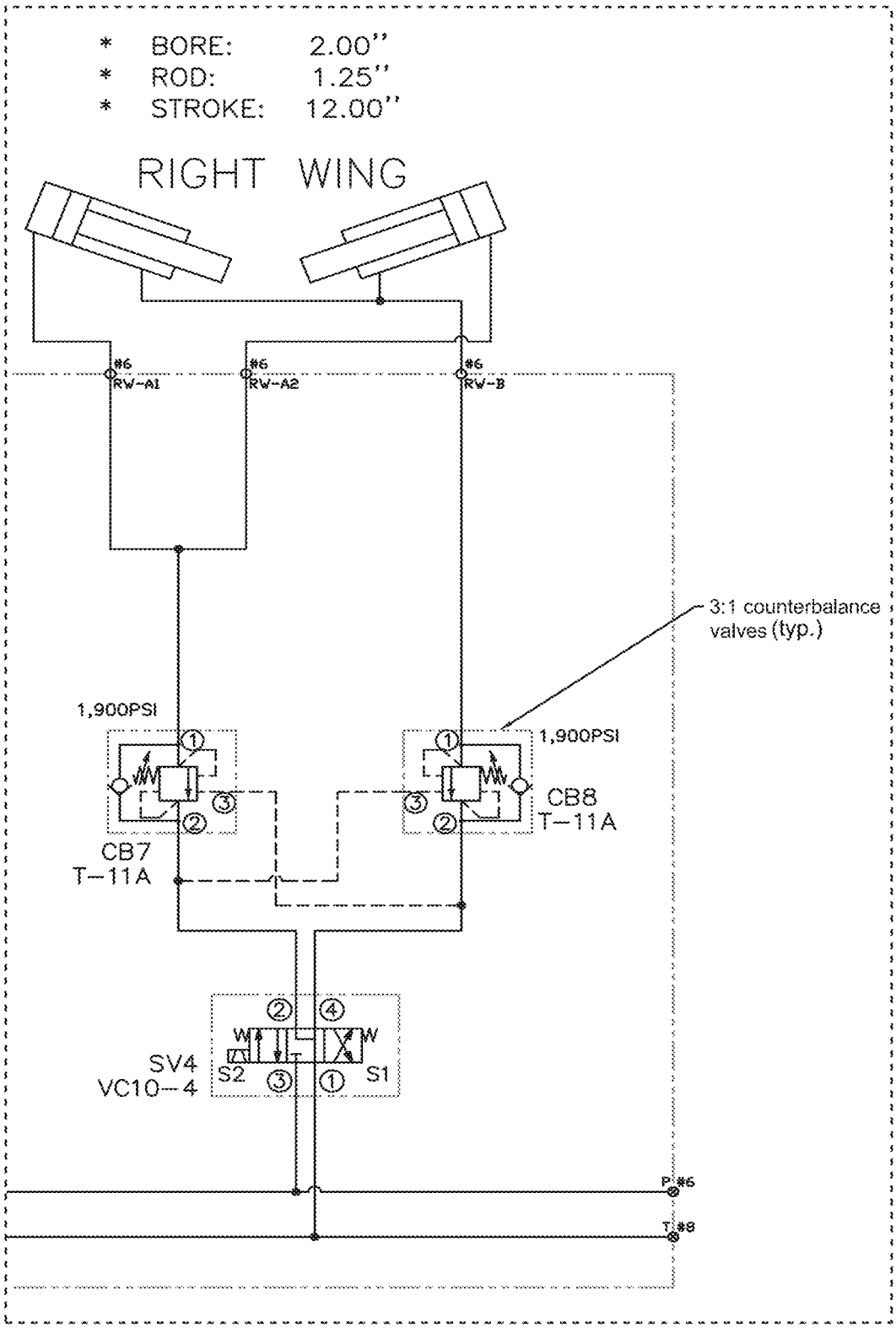
Figure 50:
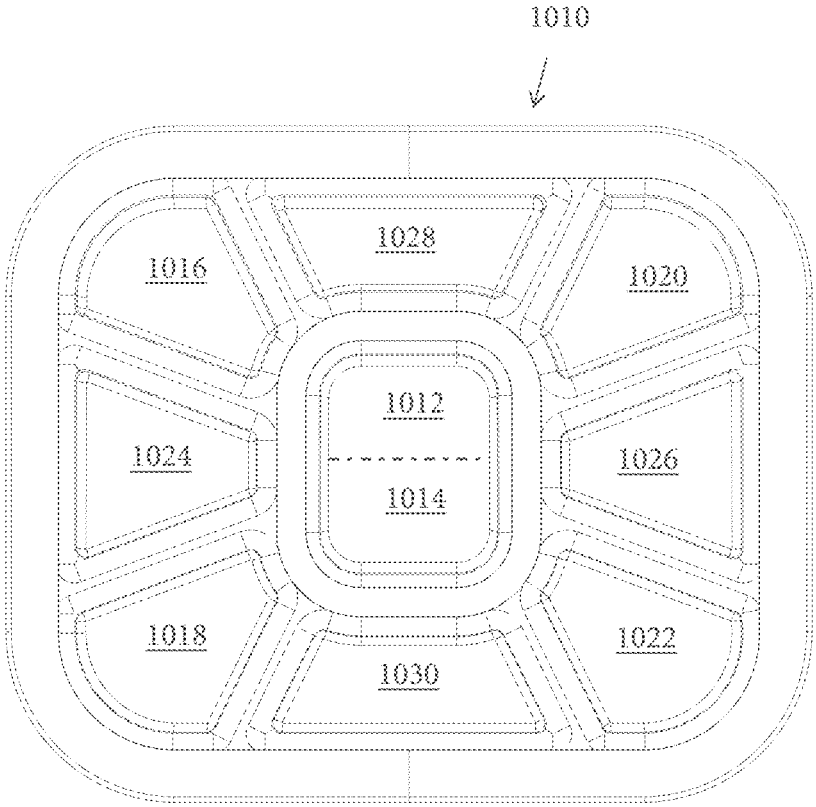
FIG. 50 is a schematic diagram of an exemplary remote control interface for controlling the articulating snow plow apparatuses of any of FIG. 1, FIG. 14, FIG. 20, or FIG. 30.

A hydraulic schematic for an exemplary hydraulic control system 710 is provided as illustrated in FIGS. 47 and 47A-47E. The hydraulic control system 710 may be adapted for use with any of the articulating snow apparatus embodiments discussed above. For example, exemplary hydraulic control system 710 may be adapted for use with hydraulic system 111 of apparatus 110 described above. The hydraulic control system 710 may include multiple circuits to independently control each of the actuators of the articulating snow apparatus, or to control the actuators in a coordinated fashion. The exemplary hydraulic control system 710 may be operated remotely via a remote control, such as the exemplary keypad 1010 (depicted in FIG. 50 and described in further detail below), or similar device, to allow an operator of the vehicle to control the functions of the articulating snow plow apparatus. The hydraulic control system 710 is provided to control the various movements of the snow plow apparatus and the blade assembly including pivoting, rotating, and raising and lowering. A hydraulic schematic for another exemplary hydraulic control system 810 is provided as illustrated in FIGS. 48-48E. The exemplary hydraulic control system 810 of FIG. 48 may be operated remotely via a remote control or similar device to allow an operator of the vehicle to control the functions of the articulating snow plow apparatus. The exemplary hydraulic control systems 710, 810 of the illustrative embodiments of FIGS. 47-48E may be adapted to synchronize the actuation/cylinder strokes of hydraulic cylinders in a dual-cylinder plow wing actuation system, such as that described above for actuation mechanism 142 of apparatuses 110 and 210 or actuation mechanism 542 of apparatus 510. A hydraulic schematic for another exemplary hydraulic control system 910 is provided as illustrated in FIGS. 49-49E. The exemplary hydraulic control system 910 of FIG. 49 may be operated remotely via a remote control or similar device to allow an operator of the vehicle to control the functions of the articulating snow plow apparatus. The main difference between hydraulic control system 910 and hydraulic control systems 710 and 810 is that the actuation/cylinder strokes of the dual hydraulic cylinders for the left and right wings do not utilize flow divider/combiner (see exemplary flow divider/combiner 157 for hydraulic control systems 710 and 810 as illustrated in FIGS. 47, 47B, 47E, 48, 48B, and 48E) and therefore the dual cylinders for each wing are not synchronized with one another. In exemplary embodiments utilizing hydraulic control system 910, the synchronizer 156 illustrated in FIGS. 19 and 19A and described above may be utilized to mechanically coordinate the strokes of hydraulic cylinders in a dual-cylinder plow wing actuation system (e.g. cylinders 144 and 146), for example. It will be appreciated that any other suitable control system may be utilized alternative to a hydraulic system, such as electric actuators, for example.

The hydraulic systems (e.g. hydraulic systems 111 and 511) for apparatuses 110, 210, 310, or 510 may be in communication with (and receive control signals from) a remote control, depicted as an exemplary keypad 1010, to enable a user to operate the apparatus from a location spaced apart from the apparatus 110, 210, 310, 510 (FIG. 50), such as a vehicle cab. As illustrated, the keypad 1010 is configurable for a plurality of snow plow apparatus operation functions which are selectable using various buttons or keys on keypad 1010. Optionally, the keypad 1010 is in wireless communication with the hydraulic system.

The following describes exemplary functions of the keypad 1010 as it relates to respective elements of the apparatuses 110, 210, 310, and 510 including the blade assembly 116 of apparatuses 110 and 210, the blade assembly 316 of apparatus 310, the blade assembly 516 of apparatus 510, the center blade 118 of apparatuses 110 and 210, the center blade 318 of apparatus 310, the center blade 518 of apparatus 510, the extendable plow wings 119, 120 of apparatuses 110 and 210, the extendable plow wings 320 of apparatus 310, and the extendable plow wings 520 of apparatus 510. The exemplary keypad 1010 may be configured with the following key functions that are performed when the respective button is depressed: the middle toggle button upper portion 1012 raises the entire blade assembly (116, 316, 516) relative to the ground surface; middle toggle button lower portion 1014 lowers the entire blade assembly (116, 316, 516) relative to the ground surface; upper-left button 1016 rotates the left wing (119, 319, 519) clockwise (viewed from above) or away from the stowed configuration; lower-left button 1018 rotates the left wing (119, 319, 519) counter-clockwise (viewed from above) or toward the stowed configuration; upper-right button 1020 rotates the right wing (120, 320, 520) counter-clockwise or away from the stowed configuration; lower-right button 1022 rotates the right wing (120, 320, 520) clockwise or toward the stowed configuration; left-center button 1024 rotates the center blade (118, 318, 518) clockwise (i.e. the left end 118*a*, 318*a*, 518*a* of the center blade moves toward the vehicle); right-center button 1026 rotates the center blade (118, 318, 518) counter-clockwise (i.e. the right end 118*b*, 318*b*, 518*b* of the center blade moves toward the vehicle); upper-center button 1028 simultaneously rotates both plow wings (119 and 120, 319 and 320, 519 and 520) away from the stowed configuration; lower-center button 1030 simultaneously rotates both plow wings (119 and 120, 319 and 320, 519 and 520) toward the stowed configuration.

The buttons of keypad 1010 may be configured to perform multiple functions depending on the sequence that the button is depressed or held. For example, a single press or single tap of the upper-left button 1016 may move the left wing (119, 319, 519) from the stowed position to the fully linearly extended position (FIGS. 1, 8, 20, 25, and 33-34), and a double press or double tap may move the left wing (119, 319, 519) to the fully forward-swept position (FIGS. 3, 9, 26, and 30). For another example, a single press or single tap of the lower-right button 1022 may move the right wing (120, 320, 520) from the fully forward-swept position to the fully linearly extended position (FIGS. 1, 16, 20, and 33-34), and a double press or double tap may move the right wing (120, 320, 520) to the stowed position (FIGS. 4, 7, 22 and 35-36). For yet another example, holding the middle toggle button upper portion 1012 will continuously raise the entire blade assembly (116, 316, 416, 516) (at least until it reaches a maximum height), and a double press or double tap of the upper portion 1012 will automatically raise the entire blade assembly to the maximum height (e.g. full up position) as shown in FIGS. 5, 12, 13, and 24. It will be appreciated that other configurations, functions, operations, and combinations thereof, are contemplated for the various buttons of the exemplary keypad 1010 to provide desired controls for the apparatus (e.g. 110, 210, 310, 510).

Thus, a vehicle mounted snow plow apparatus is capable of clearing snow from roads and driveways having a wide range of widths. The snow plow includes a configurable blade assembly with a center blade and a pair of extendable wing blades pivotably coupled to respective ends of the center blade. The blade assembly is coupled to the vehicle via a support frame, such as in the form or a four-bar linkage or a pivotable rigid frame, and can be raised and lowered relative to the vehicle and the ground surface. The blade assembly is rotatable about a vertical axis to allow an operator to direct snow away from the blade assembly to either side of the road or driveway, as desired. Each extendable blade is moveable relative to the center blade at least one-hundred eighty degrees (180°) about a vertical axis, and preferably movable up to about two-hundred seventy degrees (270°) relative to the center blade. In a stowed configuration, the extendable blades are tucked inside of or positioned alongside the center blade to reduce the lateral footprint of the snow plow apparatus, and may even be narrower than the typical width of a plow vehicle, which is particularly beneficial when driving the vehicle on roadways with the plow retracted. In a fully linearly extended configuration, the extendable blades are outboard of and parallel to the center blade to define a maximum plowing width. The extendable blades can be independently positioned at increments between a fully-forward swept position and the stowed position that is alongside the center blade. The blade assembly includes an actuation mechanism to rotate the extendable blade relative to the center plate. The actuation mechanism includes at least one sweep actuator to move the extendable blade more than one-hundred eighty degrees relative to the center blade. The actuation mechanism may include an articulating linkage coupled with the sweep actuator to move the extendable blade relative to the center blade. Additional actuators are provided to raise and lower the blade assembly relative to the vehicle and to rotate the blade assembly relative to the support frame. The blade assembly may include float or oscillation functionality to automatically adjust to uneven or slanted ground surfaces. Additional features include blade angle sensors, trip releasable plates on the bottom edges of the center and extendable blades, and an excluder configured to fill a gap near the ground surface between the center blade and extendable blade Changes and modifications in the specifically described embodiments can be carried out without departing from the principles of the present invention which is intended to be limited only by the scope of the appended claims, as interpreted according to the principles of patent law including the doctrine of equivalents.

The invention claimed is:

1. A plow apparatus for use with a vehicle, said plow apparatus comprising:

a support frame configured to couple to the vehicle having a forward travel direction and vertical and lateral axes perpendicular to the forward travel direction;

a debris-pushing plate assembly coupled to said support frame and comprising:

a center plate having a center portion coupled to said support frame;

an extendable plate having a first end pivotably coupled to an outboard end of said center plate and pivotable about a sweep axis that is parallel to the vertical axis of the vehicle, wherein a second end of said extendable plate is pivotable more than two hundred (200) degrees about the sweep axis, said extendable plate is pivotable between a stowed configuration in which said extendable plate extends laterally inboard alongside said center plate, and an extended configuration in which said extendable plate is laterally outboard of said center plate; and a sweep actuation mechanism comprising:

a linkage coupled to and extending between said center plate and said extendable plate;

a first sweep actuator coupled between said center plate and said linkage; and a second sweep actuator coupled between said extendable plate and said linkage;

wherein said first and second sweep actuators are operable together with said linkage to pivot said extendable plate about the sweep axis from the stowed configuration to the extended configuration;

wherein said plow apparatus is operable to clear snow or debris from a ground surface adjacent the vehicle with said center plate and said extendable plate in both the stowed and extended configurations.

2. The plow apparatus of claim 1, wherein when said extendable plate is in the stowed configuration said extendable plate is substantially parallel to a debris-pushing surface of said center plate.

3. The plow apparatus of claim 1, wherein said center plate is pivotable relative to said support frame about a twist axis that is parallel to the vertical axis of the vehicle when said plate assembly is in an upright position, and said plow apparatus further comprising a twist actuator coupled between a portion of said support frame and said center plate and selectively operable to pivot said center plate about the twist axis to direct debris toward a particular side of said plate assembly.

4. The plow apparatus of claim 3, further comprising a plate angle sensor to monitor at least one chosen from (i) an angle between said extendable plate and said center plate and (ii) an angle between said center plate and said support frame.

5. The plow apparatus of claim 1, wherein said plate assembly is pivotable relative to the vehicle about a tilt axis that is parallel to the lateral axis of the vehicle when said plate assembly is parallel to the lateral axis of the vehicle, said plate assembly pivotable about the tilt axis between an upright position and a tilted position in which a lower portion of said plate assembly is extended away from the vehicle.

6. The plow apparatus of claim 1, wherein said plate assembly further comprises an elastically deformable excluder disposed at a lower portion of a hinge that is disposed between said extendable plate and said center plate, said excluder configured to fill a gap between the lower portion of the first end of said extendable plate and the lower portion of the outboard end of said center plate and to contact the ground surface substantially simultaneously with said plate assembly when said plate assembly is in a lowered position.

7. The plow apparatus of claim 1, wherein a debris pushing face of at least one of said extendable plate and said center plate comprises at least one of (i) a moldboard having a fixed profile shape chosen from either of (a) a flat profile and (b) a contoured profile and (ii) a selectively deformable moldboard.

8. The plow apparatus of claim 1, further comprising a respective pivotable contact plate disposed at a lower portion of each of said extendable plate and said center plate, wherein said contact plates are configured to pivotably release upon impact with heavy and immovable objects.

9. The plow apparatus of claim 1, comprising a pair of said extendable plates, each of said extendable plates pivotably coupled to a respective outboard end of said center plate.

10. The plow apparatus of claim 1, wherein said linkage is configured to synchronize the operation of said first sweep actuator and said second sweep actuator during operation of said sweep actuation mechanism.

11. The plow apparatus of claim 1, wherein said linkage comprises:

a first joint at said outboard end of said center plate, a second joint at said first end of said extendable plate, and a third joint positioned between said first and second joints;

a tracking pin disposed at said third joint; and a pin guide bracket pivotably coupled to a hinge disposed between said extendable plate and said center plate, said pin guide bracket comprising a channel extending outwardly from the hinge and configured to receive and guide said tracking pin as said extendable plate moves relative to said center plate.

12. The plow apparatus of claim 1, wherein said support frame is coupled between the front end of the vehicle and said center portion of said center plate such that when said extendable plate is in said extended configuration, a debris pushing face of each of said extendable plate and said center plate are facing away from the vehicle.

13. The plow apparatus of claim 1, wherein said support frame is coupled between the rear end of the vehicle and said center portion of said center plate such that when said extendable plate is in said extended configuration, a debris pushing face of each of said extendable plate and said center plate are facing toward the vehicle.

14. The plow apparatus of claim 3, wherein said support frame comprises a primary support arm disposed between the vehicle and said center portion of said center plate, said center plate pivotably coupled to a distal end of said primary support arm with a coupling shaft that is coaxial with the twist axis, and said apparatus further comprising an oscillation bushing disposed between said primary support arm and said coupling shaft to permit said plate assembly to oscillate relative to said primary support arm.

15. A plow apparatus for use with a vehicle, said plow apparatus comprising:

a support frame configured to couple to the vehicle having a forward travel direction and vertical and lateral axes perpendicular to the forward travel direction, said support frame having a portion selectively operable to raise and lower relative to the vehicle; and a debris pushing plate assembly coupled to said support frame and comprising:

a center plate coupled at a center portion to said support frame and pivotable relative to said support frame about a twist axis that is parallel to the vertical axis of the vehicle; and a pair of extendable side plates each having a first end pivotably coupled to a respective outboard end of said center plate, and each extendable plate pivotable about a respective sweep axis that is parallel to the vertical axis of the vehicle, wherein a second end of each of said extendable plates is moveable through an arc of greater than two hundred (200) degrees about its sweep axis, wherein each of said extendable plates is selectively extendable and retractable between a stowed configuration in which said extendable plates extend laterally inboard and alongside said center plate, and a linearly extended configuration in which said extendable plates are outboard of said center plate; and a sweep actuation mechanism comprising:

first and second linkages coupled to and extending between said center plate and respective ones of said extendable side plates;

a first sweep actuator at each end of said center plate and coupled to said first linkage; and a second sweep actuator at each of said extendable side plates and coupled to said second linkage;

wherein said sweep actuators are operable to pivot the respective ones of said extendable plates about their sweep axes;

wherein said plow apparatus is operable to clear snow or debris from a ground surface adjacent the vehicle with said extendable plates in both the stowed and extended configurations.

16. The plow apparatus of claim 15, wherein said support frame comprises a first portion and a second portion selectively movable relative to one another and a lift actuator operably coupled between said first portion and said second portion to move said first portion and said second portion relative to one another to selectively raise and lower said plate assembly relative to the ground surface adjacent the vehicle.

17. The plow apparatus of claim 16, further comprising an extendable link coupled between said support frame and said plate assembly and operable to control tilting of said plate assembly, wherein said extendable link is configured to direct pressurized fluid into said lift actuator and force said plate assembly to move upwardly away from an object impacted by said plate assembly, to thereby protect said plow apparatus from damage.

18. The plow apparatus of claim 15, wherein said plate assembly is pivotable relative to said support frame about a tilt axis that is parallel to the lateral axis of the vehicle when said plate assembly is parallel to the lateral axis of the vehicle, said plate assembly pivotable about the tilt axis between an upright position and a tilted position in which a lower portion of said plate assembly is extended away from the vehicle.

19. The plow apparatus of claim 15, wherein when said extendable plates are in the stowed configuration said extendable plates are substantially parallel to a debris-pushing surface of said center plate.

20. A plow apparatus for use with a vehicle, said plow apparatus comprising:

a support frame configured to couple to the vehicle having a forward travel direction and vertical and lateral axes perpendicular to the forward travel direction, said support frame having a portion selectively operable to raise and lower relative to the vehicle; and a debris pushing plate assembly coupled to said support frame and comprising:

a center plate coupled at a center portion to said support frame and pivotable relative to said support frame about a twist axis that is parallel to the vertical axis of the vehicle; and a pair of extendable side plates each having a first end pivotably coupled to a respective outboard end of said center plate, and each extendable plate pivotable about a respective sweep axis that is parallel to the vertical axis of the vehicle, wherein a second end of each of said extendable plates is moveable through an arc of greater than two hundred (200) degrees about its sweep axis, each of said extendable plates selectively extendable and retractable between a stowed configuration in which said extendable plates extend laterally inboard and alongside said center plate, and a linearly extended configuration in which said extendable plates are outboard of said center plate;

a sweep actuator at each end of said center plate, each sweep actuator operable to pivot a respective one of said extendable plates about its sweep axis; and an oscillation bushing coupled to said center plate and to said support frame, wherein said oscillation bushing permits limited tilt of said debris pushing plate assembly relative to said support frame about a longitudinal axis that is aligned with the forward travel direction;

wherein said apparatus is operable to clear snow or debris from a ground surface adjacent the vehicle with said extendable plates in both the stowed and extended configurations.

* * * * *